US009803917B2

(12) United States Patent
Burmberger et al.

(10) Patent No.: US 9,803,917 B2
(45) Date of Patent: Oct. 31, 2017

(54) INTEGRATED PROCESS FOR NGL (NATURAL GAS LIQUIDS RECOVERY) AND LNG (LIQUEFACTION OF NATURAL GAS)

(71) Applicant: LINDE PROCESS PLANTS, INC., Tulsa, OK (US)

(72) Inventors: Stephan Burmberger, Neuried (DE); Danielle R. Goldbeck, Tulsa, OK (US); Christoph Hertel, Wolfratshausen (DE); Aleisha Marty, Broken Arrow, OK (US); Heinz Bauer, Ebenhausen (DE); Ronald D. Key, Broken Arrow, OK (US)

(73) Assignee: LINDE ENGINEERING NORTH AMERICA, INC., Blue Bell, PA (US)

( * ) Notice: Subject to any disclaimer, the term of this patent is extended or adjusted under 35 U.S.C. 154(b) by 297 days.

(21) Appl. No.: 14/143,755

(22) Filed: Dec. 30, 2013

(65) Prior Publication Data

US 2014/0182331 A1 Jul. 3, 2014

Related U.S. Application Data

(60) Provisional application No. 61/746,727, filed on Dec. 28, 2012.

(51) Int. Cl.
*F25J 3/00* (2006.01)
*F25J 3/02* (2006.01)
(Continued)

(52) U.S. Cl.
CPC ..... *F25J 3/0233* (2013.01); *F25J 1/004* (2013.01); *F25J 1/005* (2013.01); *F25J 1/0022* (2013.01);
(Continued)

(58) Field of Classification Search
CPC F25J 1/0022; F25J 1/005; F25J 1/0052; F25J 1/0204; F25J 1/0212; F25J 1/0241;
(Continued)

(56) References Cited

U.S. PATENT DOCUMENTS 4,121,917 A 10/1978 Baker et al.
4,157,904 A 6/1979 Campbell et al.
(Continued)

OTHER PUBLICATIONS

International Preliminary Report on Patentability dated Jun. 30, 2015 in corresponding PCT/US2013/078298.
(Continued)

*Primary Examiner* — Keith Raymond
(74) *Attorney, Agent, or Firm* — Millen, White, Zelano, Branigan, P.C.

(57) ABSTRACT

The invention relates to an integrated process and apparatus for liquefaction of natural gas and recovery of natural gas liquids. In particular, the improved process and apparatus reduces the energy consumption of a Liquefied Natural Gas (LNG) unit by using a portion of the already cooled overhead vapor from a fractionation column from an NGL (natural gas liquefaction) unit to, depending upon composition, provide, for example, reflux for fractionation in the NGL unit and/or a cold feed for the LNG unit, or by cooling, within the NGL unit, a residue gas originating from a fractionation column of the NGL unit and using the resultant cooled residue gas to, depending upon composition, provide, for example, reflux/feed for fractionation in the NGL and/or a cold feed for the LNG unit, thereby reducing the energy consumption of the LNG unit and rendering the process more energy-efficient.

18 Claims, 27 Drawing Sheets

(51) Int. Cl.
*F25J 1/00* (2006.01)
*F25J 1/02* (2006.01)

(52) U.S. Cl.
CPC ..... *F25J 1/0035* (2013.01); *F25J 1/0045* (2013.01); *F25J 1/0052* (2013.01); *F25J 1/0072* (2013.01); *F25J 1/021* (2013.01); *F25J 1/023* (2013.01); *F25J 1/0204* (2013.01); *F25J 1/0205* (2013.01); *F25J 1/0208* (2013.01); *F25J 1/0212* (2013.01); *F25J 1/0215* (2013.01); *F25J 1/0219* (2013.01); *F25J 1/0241* (2013.01); *F25J 3/0209* (2013.01); *F25J 3/0238* (2013.01); *F25J 2200/02* (2013.01); *F25J 2200/30* (2013.01); *F25J 2200/70* (2013.01); *F25J 2200/74* (2013.01); *F25J 2200/76* (2013.01); *F25J 2200/78* (2013.01); *F25J 2205/04* (2013.01); *F25J 2220/62* (2013.01); *F25J 2240/02* (2013.01); *F25J 2245/90* (2013.01); *F25J 2260/20* (2013.01); *F25J 2270/42* (2013.01); *F25J 2270/66* (2013.01); *F25J 2270/90* (2013.01); *F25J 2290/40* (2013.01)

(58) Field of Classification Search
CPC .. F25J 2260/20; F25J 2200/70; F25J 2200/74; F25J 2200/78; F25J 3/0209; F25J 3/0233; F25J 3/0238; F25J 3/0242; F25J 2205/04
USPC ..... 62/630, 631
See application file for complete search history.

(56) References Cited

U.S. PATENT DOCUMENTS 4,617,039 A * 10/1986 Buck ..... C07C 7/005 62/621
4,895,584 A 1/1990 Buck et al.
5,600,969 A 2/1997 Low
5,615,561 A 4/1997 Houshmand et al.
5,881,569 A 3/1999 Campbell et al.
6,125,653 A 10/2000 Shu et al.
6,278,035 B1 8/2001 Key et al.
6,311,516 B1 11/2001 Key et al.
6,401,486 B1 6/2002 Lee et al.
6,526,777 B1 3/2003 Campbell et al.
6,662,589 B1 12/2003 Roberts et al.
6,742,358 B2 6/2004 Wilkinson et al.
6,823,692 B1 11/2004 Patel
6,889,523 B2 * 5/2005 Wilkinson ..... F25J 1/0201 62/613
6,941,771 B2 9/2005 Reddick et al.
7,010,937 B2 3/2006 Wilkinson et al.
7,155,931 B2 1/2007 Wilkinson et al.
7,168,265 B2 1/2007 Briscoe et al.
7,204,100 B2 4/2007 Wilkinson et al.
7,210,311 B2 5/2007 Wilkinson
7,216,507 B2 5/2007 Cuellar et al.
7,237,407 B2 7/2007 Paradowski
7,458,232 B2 * 12/2008 Paradowski ..... F25J 3/0209 62/630
7,565,815 B2 7/2009 Wilkinson et al.
7,631,516 B2 12/2009 Cuellar et al.
2004/0079107 A1 4/2004 Wilkinson et al.
2004/0244415 A1 12/2004 Paradowski
2006/0260355 A1 11/2006 Roberts et al.
2006/0260356 A1 11/2006 Schroeder et al.
2007/0012072 A1 1/2007 Qualls et al.
2007/0157663 A1 7/2007 Mak et al.
2008/0016910 A1 1/2008 Brostow et al.
2008/0271480 A1 11/2008 Mak
2009/0293538 A1 12/2009 Wilkinson et al.
2010/0024477 A1 2/2010 Roberts et al.
2012/0096895 A1 4/2012 Patel et al.
2012/0137726 A1 6/2012 Currence et al.

OTHER PUBLICATIONS

K.T. Cuellar et al., "Co-Producing LNG from Cryogenic NGL Recovery Plants", Presented at the 81st Annual Convention of the Gas Processors Association—Mar. 12, 2002—Dallas, Texas pp. 1-8.
D. Elliot et al., "Benefits of Integrating NGL Extraction and LNG Liquefaction Technology", Prepared for Presentation at AIChE 2005 Spring National Meeting 5th Topical Conference on Natural Gas Utilization (TI) Session 16c—Gas.
P. Hagyard et al., "Simultaneous Production of LNG and NGL Productions Simultanees DE GNL ET DE LGN", Paper PS2-2, (Feb. 16, 2004) pp. PS2-2.1-PS2-2.18.
International Search Report dated Apr. 22, 2014 issued in corresponding PCT/US2013/078298 application (pp. 1-4).
Written Opinion of the International Searching Authority dated Apr. 22, 2014 issued in corresponding PCT/US2013/078298 application (pp. 1-4).
Search Report in corresponding EP 13868808.0 dated Jul. 4, 2017.

* cited by examiner

INTEGRATED PROCESS FOR NGL (NATURAL GAS LIQUIDS RECOVERY) AND LNG (LIQUEFACTION OF NATURAL GAS)

The invention relates to an integrated process and apparatus for liquefaction of natural gas and recovery of natural gas liquids. In particular, the improved process and apparatus reduces the energy consumption of a Liquefied Natural Gas (LNG) unit by using a portion of the already cooled overhead vapor from a fractionation column (e.g., a light-ends fractionation column (LEFC) or a demethanizer/deethanizer) from an NGL (natural gas liquefaction) unit to, depending upon composition, provide, for example, reflux for fractionation in the NGL unit and/or a cold feed for the LNG unit, or by cooling, within the NGL unit (e.g., via a standalone refrigeration system), a residue gas originating from a fractionation column of the NGL unit and using the resultant cooled residue gas to, depending upon composition, provide, for example, reflux/feed for fractionation in the NGL and/or a cold feed for the LNG unit, thereby reducing the energy consumption of the LNG unit and rendering the process more energy-efficient.

Natural gas is an important commodity throughout the world, as both an energy source and a source a raw materials. Worldwide natural gas consumption is expected to rise from 110.7 trillion cubic feet in 2008 to 123 trillion cubic feet in 2015, and 168.7 trillion cubic feet in 2035 [U.S Energy Information Administration, International Energy Outlook 2011, Sep. 19, 2011, Report Number DOE/EIA-0484 (2011)].

Natural gas obtained from oil and gas production wellheads mainly contains methane, but also may contain hydrocarbons of higher molecular weight including ethane, propane, butane, pentane, their unsaturated analogs, and heavy hydrocarbons including aromatics (e.g., benzene). Natural gas often also contains non-hydrocarbon impurities such as water, hydrogen, nitrogen, helium, argon, hydrogen sulfide, carbon dioxide, and/or mercaptans.

Before being introduced into high pressure gas pipelines for delivery to consumers, natural gas is treated to remove impurities such as carbon dioxide and sulfur compounds. In addition, the natural gas may be treated to remove a portion of the natural gas liquids (NGL). These include lighter hydrocarbons, namely ethane, propane, and butane, as well as the heavier C5+ hydrocarbons. Such treatment yields a leaner natural gas, which the consumer may require, but also provides a source of valuable materials. For example, the lighter hydrocarbons can be used as feedstock for petrochemical processes and as fuel. The C5+ hydrocarbons can be used in gasoline blending.

Often factors such as the location of the wellhead and/or the absence of requisite infrastructure may preclude the possibility of transporting natural gas via pipeline. In such cases, the natural gas can be liquefied (LNG) and transported in liquid form via a cargo carrier (truck, train, ship). However, during liquefaction of natural gas by cryogenic processes, heavier hydrocarbons within the natural gas can solidify which can then lead to damage to the cryogenic equipment and interruption of the liquefaction process. Thus, in this case also it is desirable to remove heavier hydrocarbons from the natural gas.

Numerous processes are known for the recovery of natural gas liquids. For example, Buck (U.S. Pat. No. 4,617,039) describes a process wherein a natural gas feed stream is cooled, partially condensed, and then separated in a high pressure separator. The liquid stream from the separator is warmed and fed into the bottom of a distillation (deethanizer) column. The vapor stream from the separator is expanded and introduced into a separator/absorber. Bottom liquid from separator/absorber is used as liquid feed for the deethanizer column. The overhead stream from the deethanizer column is cooled and partially condensed by heat exchange with the vapor stream removed from the top of the separator/absorber. The partially condensed overhead stream from the deethanizer column is then introduced into the upper region of the separator/absorber. The vapor stream removed from the top of the separator/absorber can be further warmed by heat exchange and compressed to provide a residue gas which, upon further compression, can be reintroduced into a natural gas pipeline.

Other C2+ and/or C3+ recovery processes are known in which the fed gas is subjected to cooling and expansion to yield a vapor stream that is introduced into the bottom region of a light ends fractionation column and a liquid stream that is introduced into a high ends fractionation column. Residue gas is removed from the top of the light ends fractionation column and product liquid is removed from the bottom of the high ends fractionation column. Liquid from the bottom of the light ends fractionation column is fed to the upper region of the heavy ends fractionation column. Overhead vapor from the heavy ends fractionation column is partially condensed and the condensate portion is used as reflux in the light ends fractionation column. The gaseous portion may be combined with the residue gas. See, for example, Buck et al. (U.S. Pat. No. 4,895,584), Key et al. (U.S. Pat. No. 6,278,035), Key et al. (U.S. Pat. No. 6,311,516), and Key et al. (U.S. Pat. No. 7,544,272).

Further, there are many known processes for liquefaction of natural gas. Typically, the natural gas is distilled in a demethanizer and the resultant methane-enriched gas is subjected to cooling and expansion to produce LNG product. The bottom liquid from the demethanizer can be sent for further processing for recovery of natural gas liquids. See, for example, Shu et al. (U.S. Pat. No. 6,125,653), Wilkinson et al. (U.S. Pat. No. 6,742,358), Wilkinson et al. (U.S. Pat. No. 7,155,931), Wilkinson et al. (U.S. Pat. No. 7,204,100), Cellular et al. (U.S. Pat. No. 7,216,507), Cellular et al. (U.S. Pat. No. 7,631,516), Wilkinson et al. (US 2004/0079107). In other systems, the natural gas is cooled and partially liquefied and then separated in a gas/liquid separator. The resultant gas and liquid streams are both used as feeds to a demethanizer. A liquid product stream is removed from the bottom of the demethanizer, and the vapor stream removed from the top of the demethanizer, after providing cooling to process streams, is removed as residue gas. See, for example, Campbell et al. (U.S. Pat. No. 4,157,904) and Campbell et al. (U.S. Pat. No. 5,881,569).

In addition, many attempts have been made to integrate a NGL recovery process with a LNG process for liquefaction of natural gas. See, for example, Houshmand et al. (U.S. Pat. No. 5,615,561), Campbell et al. (U.S. Pat. No. 6,526,777), Wilkinson et al. (U.S. Pat. No. 6,889,523), Qualls et al. (US 2007/0012072), Mak et al. (US 2007/0157663), Mak (US 2008/0271480), and Roberts et al. (US 2010/0024477).

However, while these processes provide some integration of NGL recovery and LNG production, improvements are still needed with regards to achieving such integration in a simple and efficient manner, particularly in a manner which reduces energy consumption.

Therefore, an aspect of the present invention is to provide a process and apparatus which integrate NGL recovery and LNG production in a cost effective manner, and in particular reduces the energy consumption of the LNG production.

In particular, the invention provides improvements to NGL recovery processes, such as the CRYO-PLUS™ process (see, e.g., Buck (U.S. Pat. No. 4,617,039), Key et al. (U.S. Pat. No. 6,278,035), and Key et al. (U.S. Pat. No. 7,544,272)), the Gas Subcooled (GSP) process (see, e.g., Campbell et al. (U.S. Pat. No. 4,157,904)), and the Recycle Split Vapor (RSV) process (see, e.g., Campbell et al. (U.S. Pat. No. 5,881,569), that is improvements which integrate these NGL recovery processes with an LNG production process.

The specification provides other aspects and advantages of the invention.

These aspects are achieved, according to the invention, by using a side stream of the already cooled overhead vapor from a fractionation column of an NGL recovery unit, such as a light ends fractionation column or a demethanizer/de-ethanizer, to, depending upon composition, provide reflux for fractionation in the NGL and/or a cold feed for the LNG unit, thereby reducing the energy consumption of the LNG production unit while having a minimal impact on the NGL recovery unit. Alternatively, these aspects are achieved by cooling, within the NGL unit (e.g., via a standalone refrigeration system), a residue gas originating from a fractionation column of the NGL unit and using the resultant cooled residue gas to, depending upon composition, provide reflux/feed for fractionation in the NGL and/or a cold feed for the LNG unit, thereby reducing the energy consumption of the LNG unit and rendering the process more energy-efficient.

Although the inventive processes and apparatuses are generally described herein as being suitable for the treatment of natural gas, i.e., gas resulting from oil or gas production wells, the invention is suitable for treating any feed stream which contains a predominant amount of methane along with other light hydrocarbons such as ethane, propane, butane and/or pentane.

In general, the invention provides a process and an apparatus wherein a feed stream containing light hydrocarbons (e.g., a natural gas feed stream) is processed in a natural gas liquefaction recovery (NGL) unit that comprises a main heat exchanger, a cold separator, and a fractionation system comprising either (a) a light ends fractionation column and a heavy ends fractionation column, or (b) a demethanizer/de-ethanizer, wherein at least a part of the overhead vapor stream originating from the fractionation system of the NGL unit (e.g., a part of already overhead or residue gas that is cooled by supplemental refrigeration) is used, depending upon composition, provide reflux/feed for fractionation in the NGL and/or a cold feed for the LNG unit.

According to a general process aspect of the invention there is provided a process comprising:

cooling a feed stream containing light hydrocarbons (e.g., a natural gas feed stream) in one or more heat exchangers, wherein the feed stream is cooled and partially condensed by indirect heat exchange;

introducing the partially condensed feed stream into a gas/liquid cold separator to produce an overhead gaseous stream and bottoms liquid stream which are to be introduced into a fractionation system comprising (a) a light ends fractionation column and a heavy ends fractionation column, or (b) a demethanizer (or deethanizer) column;

expanding at least a portion of the overhead gaseous stream from the gas/liquid cold separator and introducing this expanded overhead gaseous stream into (a) a lower region of a light ends fractionation column or (b) an upper region of a demethanizer (or deethanizer) column;

introducing at least a portion of the bottoms liquid stream from the gas/liquid cold separator into (a) a heavy ends fractionation column at an intermediate point thereof or (b) a demethanizer (or deethanizer) column at an intermediate point thereof;

removing a liquid product stream from the bottom of (a) the heavy ends fractionation column or (b) the bottom of the demethanizer (or deethanizer) column;

removing a overhead gaseous stream from the top of (a) the light ends fractionation column or (b) the demethanizer (or deethanizer) column; and if the fractionation system comprises a light ends fractionation column and a heavy ends fractionation column, removing a bottoms liquid stream from a lower region of the light ends fractionation column, and introducing this bottoms liquid stream from the light ends fractionation column into an upper region of the heavy ends fractionation column;

(a) when the fractionation system comprises a light ends fractionation column and a heavy ends fractionation column, (i) subjecting a first portion of the overhead gaseous stream from the light ends fractionation column to indirect heat exchange (e.g., in a subcooler) with an overhead gaseous stream removed from the top of the heavy ends fractionation column, whereby the overhead gaseous stream from the top of the heavy ends fractionation column is cooled and partially condensed, and introducing this cooled and partially condensed overhead gaseous stream from the top of the heavy ends fractionation column into the light ends fractionation column;

(ii) removing a second portion of the overhead gaseous stream from the light ends fractionation column as a side stream, and subjecting the side stream to indirect heat exchange for further cooling, and partially liquefying the side stream;

(iii) introducing the partially liquefied side stream into a further separation means, recovering liquid product from the further separation means and introducing the recovered liquid product into the light ends fractionation column as a liquid reflux stream and/or into the heavy ends fractionation column as a liquid reflux stream, (iv) recovering an overhead vapor stream from the further separation means, subjecting this overhead vapor stream to indirect heat exchange for additional cooling and partial condensation, and feeding the resultant vapor and condensate to an LNG separator wherein a LNG liquid product is produced; and (v) recovering an overhead vapor stream from the further separation means, compressing this overhead vapor stream to form a residue gas; or (b) when the fractionation system comprises a light ends fractionation column and a heavy ends fractionation column, (i) subjecting the overhead gaseous stream from the light ends fractionation column to indirect heat exchange (e.g., in a subcooler) with an overhead gaseous stream removed from the top of the heavy ends fractionation column, whereby the overhead gaseous stream from the light ends fractionation column Is heated and the overhead gaseous stream from the top of the heavy ends fractionation column is cooled and partially condensed, and introducing this cooled and partially condensed overhead gaseous stream from the top of the heavy ends fractionation column into the light ends fractionation column;

(ii) further heating and compressing the overhead gaseous stream from the light ends fractionation column to produce a residue gas;

(iii) cooling at least a portion of the residue gas whereby the portion of the residue gas is partially liquefied;

(iv) introducing an expanded portion of the partially liquefied residue gas into the light ends fractionation column;

(vi) expanding another portion of the partially liquefied residue gas and introducing this expanded portion into a further separation means;

(vii) recovering liquid product from the further separation means as LNG liquid product; and (viii) recovering an overhead vapor stream from the further separation means, and compressing this overhead vapor stream to form a residue gas; or (c) when the fractionation system comprises a demethanizer (or deethanizer) column, (i) subjecting a first portion of the overhead gaseous stream from the demethanizer (or deethanizer) column to indirect heat exchange (e.g., in a subcooler) with a stream obtained by combining a portion of the overhead gaseous stream from the gas/liquid cold separator and a portion of the bottoms liquid stream from the gas/liquid cold separator;

(ii) removing a second portion of the overhead gaseous from the demethanizer (or deethanizer) column as a side stream, and partially liquefying the side stream by heat exchange;

(iii) introducing the partially liquefied side stream into a further separation means, recovering liquid product from the further separation means and introducing the recovered liquid product into the demethanizer (or deethanizer) column as a liquid reflux stream, and (iv) recovering an overhead vapor stream from the further separation means, subjecting this overhead vapor stream to indirect heat exchange for additional cooling and partial condensation, and removing the resultant condensate as an LNG liquid product; or (d) when the fractionation system comprises a demethanizer (or deethanizer) column, (i) subjecting the overhead gaseous stream from the demethanizer (or deethanizer) column to indirect heat exchange (e.g., in a subcooler) with a stream obtained by combining a portion of the overhead gaseous stream from the gas/liquid cold separator and a portion of the bottoms liquid stream from the gas/liquid cold separator;

(ii) further heating and compressing the overhead gaseous stream from the demethanizer (or deethanizer) column to produce a residue gas;

(iii) cooling at least a portion of the residue gas whereby the portion of the residue gas is partially liquefied;

(iv) introducing this partially liquefied residue gas into a further separation means;

(v) recovering liquid product from the further separation means and introducing the recovered liquid product as reflux to the demethanizer (or deethanizer) column;

(vi) recovering an overhead vapor stream from the further separation means, cooling this overhead vapor stream whereby the overhead vapor stream is partially liquefied;

(vii) introducing this partially liquefied overhead vapor stream into another further separation means; and (viii) recovering liquid product from the another further separation means as an LNG product.

In accordance with a first process aspect of the invention, there is provided a process comprising:

introducing a feed stream containing light hydrocarbons (e.g., a natural gas feed stream) into a main heat exchanger (e.g., a plate-fin heat exchanger or shell and tube heat exchanger) wherein the feed stream is cooled and partially condensed by indirect heat exchange;

introducing the partially condensed feed stream into a gas/liquid cold separator producing an overhead gaseous stream and bottoms liquid stream;

expanding the overhead gaseous stream from the gas/liquid cold separator and then introducing the expanded overhead gaseous stream into a lower region of a light ends fractionation column;

introducing the bottoms liquid stream from the gas/liquid cold separator into a heavy ends fractionation column at an intermediate point thereof;

removing a liquid product stream from the bottom of the heavy ends fractionation column and introducing the liquid product stream into the main heat exchanger where it undergoes indirect heat exchanger with the feed stream;

removing a bottoms liquid stream from a lower region of the light ends fractionation column, and introducing the bottoms liquid stream from the light ends fractionation column into an upper region of the heavy ends fractionation column;

removing a overhead gaseous stream from the top of the light ends fractionation column, and subjecting a first portion of this overhead gaseous stream to indirect heat exchange (e.g., in a subcooler) with an overhead gaseous stream removed from the top of the heavy ends fractionation column, whereby the overhead gaseous stream from the top of the heavy ends fractionation column is cooled and partially condensed, and discharging the first portion of the second overhead gaseous stream from the light ends fractionation column as residue gas;

removing a bottoms liquid stream from a lower region of the heavy ends fractionation column, heating the bottoms liquid stream from the heavy ends fractionation column by indirect heat exchange and returning the bottoms liquid stream from the heavy ends fractionation column to the lower region of the heavy ends fractionation column as a reboiler stream;

introducing the cooled and partially condensed overhead gaseous stream from the top of the heavy ends fractionation column into the light ends fractionation column;

removing a second portion of the overhead gaseous from the light ends fractionation column as a side stream, partially liquefying the side stream across a flow-control valve, and subjecting the partially liquefied side stream to indirect heat exchange with a refrigerant fluid for further cooling, introducing the partially liquefied side stream into a further separation means (e.g., a further gas/liquid separator or a further distillation column), recovering liquid product (containing the majority of ethane, as well as heavier hydrocarbon components, of the partially liquefied side stream) and introducing the recovered liquid product into the light ends fractionation column as a liquid reflux stream and/or into the heavy ends fractionation column as a liquid reflux stream, and recovering an overhead vapor stream rich in methane, from the further separation means, subjecting the overhead vapor stream to indirect heat exchange with a refrigerant fluid for additional cooling and partial condensation, feeding the resultant condensate to an LNG exchanger, where liquefaction is performed.

The LNG process may be an industry standard mixed refrigerant or nitrogen refrigeration process. Thus, in the process according to the invention, a single refrigerant stream may be used to provide the cooling necessary to liquefy the natural gas into LNG. In a typical LNG process, a refrigerant cycle compressor increases the pressure of the circulating refrigerant. This high pressure refrigerant is cooled via exchange with air, water or other cooling media. The resulting cool, high pressure refrigerant, often present in both a liquid and gas phase, passes through the LNG exchanger where the refrigerant is fully liquefied or becomes a cooled vapor at high pressure. The cold refrigerant is then reduced in pressure via a Joule-Thomson valve (isenthalpic, i.e., a process that generally proceeds without any change in enthalpy) or via a turboexpander (isentropic, i.e., a process that generally proceeds without any change in entropy) to a lower pressure resulting in the flashing of the cold, high pressure refrigerant into a two-phase vapor and liquid mixture or single phase vapor that is colder than the preceding stream and is also colder in temperature than the liquefaction point (bubble point) of the LNG feed stream. This low pressure, cold, two-phase vapor and liquid mixture or single phase vapor refrigerant stream returns to the LNG exchanger to provide sufficient liquefaction cooling for both the refrigerant as well as the natural gas feed stream that is to be liquefied. Along the course of flowing through the LNG exchanger, the refrigerant stream is fully vaporized. This vapor flows to the refrigerant cycle compressor to begin the cooling cycle again.

Thus, in accordance with the invention, when a refrigerant system is used to cool a residue gas stream or a side stream from the overhead vapors of light ends fractionation column or a demethanizer, the refrigerant system can involve the use of a single refrigerant system or mixed refrigerant cooling system or an expander based system or a combination of a mixed refrigerant system and an expander based refrigeration system.

Additionally, the refrigerant system can use a refrigerant composition: either it is a pure single refrigerant (concentration >95 vol %) or a mixture of two or more components with concentrations >5 vol % each. Suitable refrigerant components include light paraffinic or olefinic hydrocarbons like methane, ethane, ethylene, propane, propylene, butane, pentane, and inorganic components like nitrogen, argon as well as possibly carbon monoxide, carbon dioxide, hydrogen sulfide, ammonia. Further, the refrigerant system can involve (a) a closed or open loop refrigeration cycle, (b) two or more pressure levels in the entire refrigeration cycle, (c) pressure reduction from a higher pressure to a lower pressure either via work expansion (turbo expander) and/or via isenthalpic throttling (control valve, restriction orifice), or (d) phase condition of the refrigerant either all vapor phase or changing from vapor to liquid and back to vapor. For example, this refrigeration system can utilize (a) a phase-change mixed refrigerant cycle without work expansion of a high pressure gas fraction, (b) a phase-change mixed refrigerant cycle with work expansion of a high pressure gas fraction, (c) a vapor phase mixed refrigerant cycle with work expansion of a high pressure gas fraction in one or more stages, or (d) a vapor phase pure refrigerant cycle with work expansion of a high pressure gas fraction in one or more stages.

In the description herein and in the drawings, expansions of fluids are often characterized as being performed by an expansion valve or "expansion across a valve." One skilled in the art would recognize that these expansion can be performed using various types expansion devices such as an expander, a control valve, a restrictive orifice or other device intended to reduce the pressure of the circulating fluid. The use of these expansion devices to perform the expansions described herein is included within the scope of the invention.

By removing a side stream from the overhead gaseous stream of the light ends fractionation column, cooling and partially condensing this side stream, and then delivering at least part of the resulting condensate to an LNG exchanger, an integration of the NGL and LNG processes is achieved in a manner which does not compromise the NGL recovery process. The utilization of a portion of the cold overhead gaseous stream from the LEFC of the NGL process reduces refrigeration requirements of the LNG process, thereby reducing overall energy consumption, and improving recoveries for both processes.

According to one embodiment of the invention, the liquid product recovered from the further separation means (e.g., further distillation column) is introduced into the light ends fractionation column as a liquid reflux stream. According to another embodiment of the invention, the liquid product recovered from the further separation means (e.g., further distillation column) is introduced into the heavy ends fractionation column as a liquid reflux stream.

In accordance with a second process aspect of the invention, there is provided a further process comprising:

introducing a feed stream containing light hydrocarbons (e.g., a natural gas feed stream) into a main heat exchanger (e.g., a plate-fin heat exchanger or shell and tube heat exchanger) wherein the feed stream is cooled and partially condensed by indirect heat exchange;

introducing the partially condensed feed stream into a gas/liquid cold separator producing an overhead gaseous stream and bottoms liquid stream;

expanding the overhead gaseous stream from the gas/liquid cold separator and then introducing the expanded overhead gaseous stream into a lower region of a light ends fractionation column;

introducing the bottoms liquid stream from the gas/liquid cold separator into a heavy ends fractionation column at an intermediate point thereof;

removing a liquid product stream from the bottom of the heavy ends fractionation column and introducing the liquid product stream from the bottom of the heavy ends fractionation column into the main heat exchanger where it undergoes indirect heat exchanger with the feed stream;

removing a bottoms liquid stream from a lower region of the light ends fractionation column, and introducing the bottoms liquid stream from the light ends fractionation column into an upper region of the heavy ends fractionation column;

removing a overhead gaseous stream from the top of the light ends fractionation column, and subjecting this overhead gaseous stream to indirect heat exchange (e.g., in a subcooler) with an overhead gaseous stream removed from the top of the heavy ends fractionation column, whereby the overhead gaseous stream from the top of the heavy ends fractionation column is cooled and partially condensed, and then discharging the overhead gaseous stream from the light ends fractionation column as residue gas;

removing a bottoms liquid stream from a lower region of the heavy ends fractionation column, heating the bottoms liquid stream from the heavy ends fractionation column by indirect heat exchange and returning the bottoms liquid stream from the heavy ends fractionation column to the lower region of the heavy ends fractionation column as a reboiler stream;

introducing the cooled and partially condensed overhead gaseous stream from the top of the heavy ends fractionation column into the light ends fractionation column;

introducing a residue gas stream into the main heat exchanger wherein the residue gas stream is cooled by indirect heat exchange, and then subjecting the cooled residue gas stream to further indirect heat exchange (e.g., in the subcooler) with an overhead gaseous stream removed from the top of the heavy ends fractionation column whereby the residue gas stream is further cooled;

expanding the further cooled residue gas stream and introducing the resultant partially liquefied residue gas stream into a further separation means (e.g., a further gas/liquid separator or a further distillation column), recovering an overhead residue gas stream from the further separation means, recovering a liquid stream from the further separation means and feeding this liquid stream to an LNG exchanger, where liquefaction is performed.

In accordance with a third process aspect of the invention, there is provided a further process comprising:

introducing a feed stream containing light hydrocarbons (e.g., a natural gas feed stream) into a main heat exchanger (e.g., a plate-fin heat exchanger or shell and tube heat exchanger) wherein the feed stream is cooled and partially condensed by indirect heat exchange;

introducing the partially condensed feed stream into a gas/liquid cold separator producing an overhead gaseous stream and bottoms liquid stream;

expanding the overhead gaseous stream from the gas/liquid cold separator and then introducing the expanded overhead gaseous stream from the gas/liquid cold separator into a lower region of a light ends fractionation column;

introducing the bottoms liquid stream from gas/liquid cold separator into a heavy ends fractionation column at an intermediate point thereof;

removing a liquid product stream from the bottom of the heavy ends fractionation column and introducing the liquid product stream from the bottom of the heavy ends fractionation column into the main heat exchanger where it undergoes indirect heat exchanger with the feed stream;

removing a bottoms liquid stream from a lower region of the light ends fractionation column, and introducing the bottoms liquid stream from the light ends fractionation column into an upper region of the heavy ends fractionation column;

removing a overhead gaseous stream from the top of the light ends fractionation column, and subjecting this overhead gaseous stream to indirect heat exchange (e.g., in a subcooler) with an overhead gaseous stream removed from the top of the heavy ends fractionation column, whereby the overhead gaseous stream from the top of the heavy ends fractionation column is cooled and partially condensed;

removing a bottoms liquid stream from a lower region of the heavy ends fractionation column, heating the bottoms liquid stream from the heavy ends fractionation column by indirect heat exchange and returning the bottoms liquid stream from the heavy ends fractionation column to the lower region of the heavy ends fractionation column as a reboiler stream;

introducing the cooled and partially condensed overhead gaseous stream from the top of the heavy ends fractionation column into the light ends fractionation column;

introducing the overhead gaseous stream from the light ends fractionation column, after being heated by heat exchange and compressed, as a residue gas into a heat exchanger wherein the residue gas is cooled and partially liquefied by indirect heat exchange; and introducing the resultant partially liquefied residue gas stream into a further separation means (e.g., a further gas/liquid separator or a further distillation column), recovering a liquid stream from the further separation means which is introduced into the light ends fractionation column as reflux, recovering an overhead residue gas stream from the further separation means, and feeding at least a portion of the overhead residue gas stream from the further separation means to an LNG exchanger where liquefaction is performed.

According to a further embodiment of the above described processes, the bottoms liquid stream removed from the lower region of the heavy ends fractionation column that is recycled as a reboiler stream is heated in the main heat exchanger by indirect heat exchange with the feed stream (e.g., natural gas), before being returned to the lower region of the heavy ends fractionation column.

In addition, a further liquid stream can be removed from an intermediate point of the heavy ends fractionation column and also used for cooling the natural gas feed stream in the main heat exchanger. The further liquid stream is removed from a first intermediate point of the heavy ends fractionation column, heated by indirect heat exchange with the natural gas feed stream in the main heat exchanger, and then reintroduced into the heavy ends fractionation column at another intermediate point below the first intermediate point.

According to another embodiment of the invention, additional reflux streams are provided for the light ends fractionation column. A portion of the gaseous overhead stream removed from the top of cold separator, prior to expansion, is fed to a subcooler where it undergoes indirect heat exchange with the overhead vapor from the light ends fractionation column. This portion of the gaseous overhead stream is cooled and partially liquefied in the subcooler and introduced into the top region of the light ends fractionation column to provide additional reflux.

Additionally or alternatively, a portion of bottoms liquid stream from the gas/liquid cold separator is delivered to a liquid/liquid heat exchanger where it undergoes indirect heat exchange with the bottom liquid stream removed from the light ends fractionation column. Thereafter, the stream is then fed to an intermediate region of the light ends fractionation column as a liquid reflux. Each of these two additional reflux streams improves recovery of ethane and heavier hydrocarbon components.

In accordance with a further embodiment an additional reflux for the light ends fractionation column is provided through a combination of a portion of the gaseous overhead stream removed from the top of cold separator and a portion of bottoms liquid stream from cold separator. In this embodiment, prior to expansion, a portion of the gaseous overhead stream removed from the top of cold separator is combined with a portion of the bottoms liquid stream from cold separator, and the combined stream is fed to the subcooler. In the subcooler it undergoes indirect heat exchange with the overhead vapor from the light ends fractionation column. The combined stream is cooled and partially liquefied in the subcooler and introduced into the top region of the light ends fractionation column to provide additional reflux. This additional reflux stream for the light ends fractionation column improves recovery of ethane and heavier hydrocarbon components.

In one version of the above mentioned embodiment, the side stream from the overhead gaseous stream of the light ends fractionation column is eventually introduced into the light ends fractionation column. According to a modification, the side stream from the overhead gaseous stream of the light ends fractionation column is eventually introduced into the heavy ends fractionation column, rather than the light ends fractionation column. As described previously, the side stream is partially liquefied across a flow-control valve. The partially liquefied vapor undergoes indirect heat exchange with a refrigerant fluid for further cooling and is then fed into the further distillation column. The methane-rich overhead vapor stream from the further separation means (e.g., further distillation column) undergoes indirect heat exchange with the refrigerant fluid for additional cooling, and is then fed into the LNG exchanger, where liquefaction occurs. The majority of ethane as well as heavier hydrocarbon components are recovered from the bottom of the further separation means (e.g., further distillation column) as liquid product. This liquid product is introduced into the top of the heavy ends fractionation column as a liquid reflux stream.

According to a further embodiment of the invention, the system can incorporate a refrigeration loop through the NGL process which results in a reduction in energy consumption. For example, a stream of refrigerant fluid from the refrigerant system is fed through the main heat exchanger where it undergoes indirect heat exchange with the natural gas feed stream and possibly other streams (e.g., the liquid product stream from the bottom of the heavy ends fractionation column, the further liquid stream from an intermediate point of the heavy ends fractionation column, the reboiler stream removed from the bottom region of the heavy ends fractionation column, and/or the overhead vapor product stream removed from the top of the light ends fractionation column). The refrigerant stream is cooled and partially liquefied in the main heat exchanger and is then introduced into the subcooler where it is further cooled and liquefied. The refrigerant stream is then flashed across a valve, causing the fluid to reach even colder temperatures, and is then fed back to the subcooler to provide cooling for the additional reflux streams of the light ends fractionation column. The refrigerant stream then returns to the main heat exchanger, where it functions as a coolant for the NGL process streams. Thereafter, the refrigerant stream is returned to the refrigeration system for compression.

According to a further embodiment, a modified refrigeration loop is used. A stream of refrigerant fluid from the refrigerant system is fed through the main heat exchanger where it undergoes indirect heat exchange with the natural gas feed stream and possibly other streams (e.g., the liquid product stream from the bottom of the heavy ends fractionation column, the further liquid stream from an intermediate point of the heavy ends fractionation column, the reboiler stream removed from the bottom region of the heavy ends fractionation column, and/or the overhead vapor product stream removed from the top of the light ends fractionation column). In the main heat exchanger, the refrigerant stream is cooled and partially liquefied and is then introduced into the subcooler where it is further cooled and liquefied. This stream is then introduced into the heat exchanger used for cooling the side stream of the overhead vapor product stream from the light ends fractionation column. The refrigerant stream exits the heat exchanger and is flashed across a valve, causing the fluid to reach even colder temperatures. The resultant stream is then fed back to the same heat exchanger to provide further cooling. Thereafter, the refrigerant passes through the subcooler and then into the main heat exchanger, where it serves as a coolant to the NGL process streams. The refrigerant stream then flows back to the refrigeration system for compression.

According to a further embodiment, a residue gas stream is recovered from the partially condensed overhead vapor stream obtained from the further separation means, and this residue gas stream is used to cool, by indirect heat exchange, the overhead vapor stream from the further separation means and/or the side stream of the overhead vapor product stream from the light ends fractionation column. Thereafter, the residue gas stream can be compressed to the desired pressure. According to a further modification, the residue gas stream can be compressed and then optionally used for indirect heat exchange with the overhead vapor stream from the further separation means and/or the side stream of the overhead vapor product stream from the light ends fractionation column.

In accordance with a fourth process aspect of the invention, there is provided a further process comprising:

splitting a feed stream containing light hydrocarbons (e.g., a natural gas feed stream) into at least a first partial stream and a second partial stream;

introducing the first partial stream of the feed stream into a main heat exchanger (e.g., a plate-fin heat exchanger or shell and tube heat exchanger) wherein the first partial stream of the feed stream is cooled and partially condensed by indirect heat exchange;

introducing the second partial stream of the feed stream into a heat exchanger wherein the second partial stream of the feed stream is cooled and partially condensed by indirect heat exchange;

recombining the first and second partial streams of the feed stream, and optionally subjecting the resultant recombined feed stream to heat exchange with a refrigerant (e.g., a propane refrigerant);

introducing the cooled recombined feed stream into a gas/liquid cold separator to produce an overhead gaseous stream and bottoms liquid stream;

expanding a portion of the overhead gaseous stream from the gas/liquid cold separator and then introducing the expanded portion of the overhead gaseous stream into an upper region of a demethanizer column;

expanding a portion of the bottoms liquid stream from the gas/liquid cold separator and introducing this expanded portion of the bottoms liquid stream into an intermediate region of the demethanizer;

combining another portion of the bottoms liquid stream from the gas/liquid cold separator with another portion of the overhead gaseous stream from the gas/liquid cold separator, cooling the resultant combined cold separator stream by indirect heat exchange (e.g., in a subcooler) with overhead vapor from the demethanizer, expanding the cooled resultant combined cold separator stream, and then introducing the expanded cooled combined cold separator stream into the top of the demethanizer;

removing a liquid product stream from the bottom of the demethanizer and introducing the liquid product stream into the main heat exchanger where it undergoes indirect heat exchanger with the first partial stream of the feed stream;

removing a overhead gaseous stream from the top of the demethanizer, and subjecting this overhead gaseous stream to indirect heat exchange (e.g., in a subcooler) with the combined cold separator streams, whereby the combined cold separator streams is cooled and partially condensed and the overhead gaseous stream from the top of the demethanizer is heated, further heating the overhead gaseous stream from the top of the demethanizer by indirect heat exchange with the second partial feed stream, and then compressing and removing at least a portion of the overhead gaseous stream from the demethanizer as residue gas (another optional portion can be removed as fuel gas);

introducing at least a portion of the residue gas stream from the overhead gaseous stream of the demethanizer into the main heat exchanger wherein the residue gas stream is cooled by indirect heat exchange, and then subjecting the cooled residue gas stream to further indirect heat exchange (e.g., in the subcooler) with the overhead gaseous stream from the top of the demethanizer whereby the residue gas stream is further cooled;

expanding a first portion of the further cooled residue gas stream and introducing the resultant partially liquefied first portion of the residue gas stream into an upper region of the demethanizer; and introducing a second portion of the further cooled residue gas stream into a further separation means (e.g., a further gas/liquid separator (LNGL separator, i.e., a separator that integrates and combines the NGL and LNG units)) or a further distillation column), recovering an overhead residue gas stream from said further separation means, recovering a liquid stream from the further separation means, and feeding this liquid stream from the further separation means to an LNG exchanger, where liquefaction is performed.

In accordance with a fifth process aspect of the invention, there is provided a further process comprising:

splitting a feed stream containing light hydrocarbons (e.g., a natural gas feed stream) into at least a first partial stream and a second partial stream;

introducing the first partial stream of the feed stream into a main heat exchanger (e.g., a plate-fin heat exchanger or shell and tube heat exchanger) wherein the first partial stream of the feed stream is cooled and partially condensed by indirect heat exchange;

introducing the second partial stream of the feed stream into a heat exchanger wherein the second partial stream of the feed stream is cooled and partially condensed by indirect heat exchange;

recombining the first and second partial streams of the feed stream, and optionally subjecting the resultant recombined feed stream to heat exchange with a refrigerant (e.g., a propane refrigerant);

introducing the cooled recombined feed stream into a gas/liquid cold separator to produce an overhead gaseous stream and bottoms liquid stream;

expanding a portion of the overhead gaseous stream from the gas/liquid cold separator and then introducing the expanded portion of the overhead gaseous stream into an upper region of a demethanizer column;

expanding a portion of the bottoms liquid stream from the gas/liquid cold separator and introducing this expanded portion of the bottoms liquid stream into an intermediate region of the demethanizer;

combining another portion of the bottoms liquid stream from the gas/liquid cold separator with another portion of the overhead gaseous stream from the gas/liquid cold separator, cooling the resultant combined cold separator stream by indirect heat exchange (e.g., in a subcooler) with overhead vapor from the demethanizer, expanding the cooled resultant combined cold separator stream, and then introducing the expanded cooled combined cold separator stream into the top of the demethanizer;

removing a liquid product stream from the bottom of the demethanizer and introducing the liquid product stream into the main heat exchanger where it undergoes indirect heat exchanger with the first partial stream of the feed stream;

removing a first portion of an overhead gaseous stream from the top of the demethanizer, and subjecting this first portion of the overhead gaseous stream to indirect heat exchange (e.g., in a subcooler) with the combined cold separator stream, whereby the combined cold separator stream is cooled and partially condensed and the overhead gaseous stream from the top of the demethanizer is heated, further heating the overhead gaseous stream from the top of the demethanizer by indirect heat exchange with the second partial feed stream, and then compressing and removing at least a portion of the overhead gaseous stream from the demethanizer as residue gas (another optional portion can be removed as fuel gas);

removing a second portion of the overhead gaseous from the demethanizer as a side stream, and subjecting the side stream to indirect heat exchange with a refrigerant fluid whereby the side stream is further cooled and partially liquefied:

introducing the partially liquefied side stream into a further separation means (e.g., a further gas/liquid separator or a further distillation column), recovering a liquid stream (containing ethane and heavier hydrocarbon components, of the partially liquefied side stream) and introducing the recovered liquid stream into the demethanizer as a liquid reflux stream, and recovering an overhead vapor stream rich in methane, from the further separation means, subjecting the overhead vapor stream to indirect heat exchange with a refrigerant fluid for additional cooling and partial condensation, and feeding the resultant condensate to an LNG exchanger, where liquefaction is performed.

In accordance with a sixth process aspect of the invention, there is provided a further process comprising:

splitting a feed stream containing light hydrocarbons (e.g., a natural gas feed stream) into at least a first partial stream and a second partial stream;

introducing the first partial stream of the feed stream into a main heat exchanger (e.g., a plate-fin heat exchanger or shell and tube heat exchanger) wherein the first partial stream of the feed stream is cooled and partially condensed by indirect heat exchange;

introducing the second partial stream of the feed stream into a heat exchanger wherein the second partial stream of the feed stream is cooled and partially condensed by indirect heat exchange;

recombining the first and second partial streams of the feed stream, and optionally subjecting the resultant recombined feed stream to heat exchange with a refrigerant (e.g., a propane refrigerant);

introducing the cooled recombined feed stream into a gas/liquid cold separator to produce an overhead gaseous stream and bottoms liquid stream;

expanding a portion of the overhead gaseous stream from the gas/liquid cold separator and then introducing the expanded portion of the overhead gaseous stream into an upper region of a demethanizer column;

expanding a portion of the bottoms liquid stream from the gas/liquid cold separator and introducing this expanded portion of the bottoms liquid stream into an intermediate region of the demethanizer;

combining another portion of the bottoms liquid stream from the gas/liquid cold separator with another portion of the overhead gaseous stream from the gas/liquid cold separator, cooling the resultant combined cold separator stream by indirect heat exchange (e.g., in a subcooler) with overhead vapor from the demethanizer, expanding the cooled resultant combined cold separator stream, and then introducing the expanded cooled combined cold separator stream into the top of the demethanizer;

removing a liquid product stream from the bottom of the demethanizer and introducing the liquid product stream into the main heat exchanger where it undergoes indirect heat exchanger with the first partial stream of the feed stream;

removing a overhead gaseous stream from the top of the demethanizer, and subjecting this overhead gaseous stream to indirect heat exchange (e.g., in a subcooler) with the combined cold separator stream, whereby the combined cold separator stream is cooled and partially condensed and the overhead gaseous stream from the top of the demethanizer is heated, further heating the overhead gaseous stream from the top of the demethanizer by indirect heat exchange with the second partial feed stream;

recycling at least a portion of overhead gaseous stream from the top of the demethanizer, after indirect heat exchange with the second partial feed stream, as a residue gas stream to a heat exchanger wherein the residue gas stream is cooled and partially condensed by indirect heat exchange (e.g., with a refrigerant), and then introducing the cooled and partially condensed residue gas stream into a further separation means (e.g., a further gas/liquid separator or a further distillation column), recovering a residue liquid stream from the further separation means and introducing the residue liquid stream into the top region of the demethanizer as reflux; and recovering an overhead gas stream from the further separation means, cooling the overhead gas stream by indirect heat exchange (e.g., with a refrigerant), expanding the further cooled overhead gas stream and introducing this expanded further cooled overhead gas stream into a second further separation means (e.g., a further gas/liquid separator (LNGL separator) or a further distillation column), recovering an overhead stream from the second further separation means as a further residue gas (boil off gas), recovering a liquid stream from the second further separation means, and feeding this liquid stream from the second further separation means to an LNG exchanger, where liquefaction is performed.

In accordance with a seventh process aspect of the invention, there is provided a further process comprising:

splitting a feed stream containing light hydrocarbons (e.g., a natural gas feed stream) into at least a first partial stream and a second partial stream;

introducing the first partial stream of the feed stream into a main heat exchanger (e.g., a plate-fin heat exchanger or shell and tube heat exchanger) wherein the first partial stream of the feed stream is cooled and partially condensed by indirect heat exchange;

introducing the second partial stream of the feed stream into a heat exchanger wherein the second partial stream of the feed stream is cooled and partially condensed by indirect heat exchange;

recombining the first and second partial streams of the feed stream, and optionally subjecting the resultant recombined feed stream to heat exchange with a refrigerant (e.g., a propane refrigerant);

introducing the cooled recombined feed stream into a gas/liquid cold separator to produce an overhead gaseous stream and bottoms liquid stream;

expanding a portion of the overhead gaseous stream from the gas/liquid cold separator and then introducing the expanded portion of the overhead gaseous stream into an upper region of a demethanizer column;

expanding a portion of the bottoms liquid stream from the gas/liquid cold separator and introducing this expanded portion of the bottoms liquid stream into an intermediate region of the demethanizer;

combining another portion of the bottoms liquid stream from the gas/liquid cold separator with another portion of the overhead gaseous stream from the gas/liquid cold separator, cooling the resultant combined cold separator stream by indirect heat exchange in a heat exchanger (e.g. a subcooler) with overhead vapor from the demethanizer, expanding the cooled resultant combined cold separator stream, and then introducing the expanded cooled combined cold separator stream into the top of the demethanizer;

removing a liquid product stream from the bottom of the demethanizer and introducing the liquid product stream into the main heat exchanger where it undergoes indirect heat exchanger with the first partial stream of the feed stream;

removing a overhead gaseous stream from the top of the demethanizer, and subjecting this overhead gaseous stream to indirect heat exchange in with the combined cold separator stream (e.g., in the subcooler), whereby the combined cold separator stream is cooled and partially condensed and the overhead gaseous stream from the top of the demethanizer is heated, further heating the overhead gaseous stream from the top of the demethanizer by indirect heat exchange with the second partial feed stream, and then compressing and removing at least a portion of the overhead gaseous stream from the demethanizer as residue gas (another optional portion can be removed as fuel gas);

subjecting at least a portion of the residue gas stream from the overhead gaseous stream of the demethanizer to heat exchange (e.g., in the subcooler) wherein the residue gas stream is cooled by indirect heat exchange with the overhead gaseous stream from the top of the demethanizer;

expanding a portion of the cooled residue gas stream and introducing the resultant expanded portion of the cooled residue gas stream into an upper region of the demethanizer, expanding another portion of the residue gas stream and introducing the resultant expanded another portion into a further separation means (e.g., a further gas/liquid separator (LNGL separator) or a further distillation column), recovering an overhead residue gas stream from the further separation means as a further residue gas (boil off gas), recovering a liquid stream from the further separation means, and feeding this liquid stream from the further separation means to an LNG exchanger where liquefaction is performed.

In accordance with a eighth process aspect of the invention, there is provided a further process comprising:

splitting a feed stream containing light hydrocarbons (e.g., a natural gas feed stream) into at least a first partial stream and a second partial stream;

introducing the first partial stream of the feed stream into a main heat exchanger (e.g., a plate-fin heat exchanger or shell and tube heat exchanger) wherein the first partial stream of the feed stream is cooled and partially condensed by indirect heat exchange;

introducing the second partial stream of the feed stream into a heat exchanger wherein the second partial stream of the feed stream is cooled and possibly partially condensed (depending upon the composition of the feed gas stream) by indirect heat exchange;

recombining the first and second partial streams of the feed stream, and optionally subjecting the resultant recombined feed stream to heat exchange with a refrigerant (e.g., a propane refrigerant);

introducing the cooled recombined feed stream into a gas/liquid cold separator to produce an overhead gaseous stream and bottoms liquid stream;

expanding a portion of the overhead gaseous stream from the gas/liquid cold separator and then introducing the expanded portion of the overhead gaseous stream into an upper region of a demethanizer column;

expanding a portion of the bottoms liquid stream from the gas/liquid cold separator and introducing this expanded portion of the bottoms liquid stream into an intermediate region of the demethanizer;

combining another portion of the bottoms liquid stream from the gas/liquid cold separator with another portion of the overhead gaseous stream from the gas/liquid cold separator, cooling the resultant combined cold separator stream by indirect heat exchange in a heat exchanger (e.g., a subcooler) with overhead vapor from the demethanizer, expanding the cooled resultant combined cold separator stream, and then introducing the expanded cooled combined cold separator stream into the top of the demethanizer;

removing a liquid product stream from the bottom of the demethanizer and introducing the liquid product stream into the main heat exchanger where it undergoes indirect heat exchanger with the first partial stream of the feed stream;

removing a overhead gaseous stream from the top of the demethanizer, and subjecting this overhead gaseous stream to indirect heat exchange with the combined cold separator stream expanding the cooled resultant combined cold separator stream, whereby the combined cold separator stream is cooled and partially condensed (depending upon the composition of the stream) and the overhead gaseous stream from the top of the demethanizer is heated, further heating the overhead gaseous stream from the top of the demethanizer by indirect heat exchange with the second partial feed stream, and then compressing and removing at least a portion of the overhead gaseous stream from the demethanizer as residue gas (another optional portion can be removed as fuel gas);

subjecting at least a portion of the residue gas stream from the overhead gaseous stream of the demethanizer to heat exchange (e.g., in the subcooler) wherein the residue gas stream is cooled by indirect heat exchange with the overhead gaseous stream from the top of the demethanizer;

separating the cooled residue gas stream into a first portion and a second portion, expanding the first portion of the cooled residue gas stream and introducing the resultant expanded first portion of the cooled residue gas stream into an upper region of the demethanizer, further cooling and partially condensing the second portion of the cooled residue gas stream by indirect heat exchange in a heat exchanger (e.g., against a refrigerant), and then introducing the cooled and partially condensed second portion of the residue gas stream into a further separation means (e.g., a further gas/liquid separator or a further distillation column), recovering a residue liquid stream from the further separation means and introducing the residue liquid stream into the top region of the demethanizer as reflux; and recovering an overhead gas stream from the further separation means, cooling the overhead gas stream by indirect heat exchange (e.g., with a refrigerant), expanding the further cooled overhead residue gas stream and introducing this expanded further cooled overhead residue gas stream into a second further separation means (e.g., a further gas/liquid separator (LNGL separator) or a further distillation column), recovering an overhead stream from the second further separation means as a further residue gas (boil off gas), recovering a liquid stream from the second further separation means, and feeding this liquid stream from the second further separation means to an LNG exchanger, where liquefaction is performed.

In accordance with a ninth process aspect of the invention, there is provided a further process comprising:

splitting a feed stream containing light hydrocarbons (e.g., a natural gas feed stream) into at least a first partial stream and a second partial stream;

introducing the first partial stream of the feed stream into a main heat exchanger (e.g., a plate-fin heat exchanger or shell and tube heat exchanger) wherein the first partial stream of the feed stream is cooled and partially condensed by indirect heat exchange;

introducing the second partial stream of the feed stream into a heat exchanger wherein the second partial stream of the feed stream is cooled and partially condensed by indirect heat exchange;

recombining the first and second partial streams of the feed stream, and optionally subjecting the resultant recombined feed stream to heat exchange with a refrigerant (e.g., a propane refrigerant);

introducing the cooled recombined feed stream into a gas/liquid cold separator to produce an overhead gaseous stream and bottoms liquid stream;

expanding a portion of the overhead gaseous stream from the gas/liquid cold separator and then introducing the expanded portion of the overhead gaseous stream into an upper region of a demethanizer column;

expanding a portion of the bottoms liquid stream from the gas/liquid cold separator and introducing this expanded portion of the bottoms liquid stream into an intermediate region of the demethanizer;

combining another portion of the bottoms liquid stream from the gas/liquid cold separator with another portion of the overhead gaseous stream from the gas/liquid cold separator, cooling the resultant combined cold separator stream by indirect heat exchange in a heat exchanger (e.g., a subcooler) with overhead vapor from the demethanizer, expanding the cooled resultant combined cold separator stream, and then introducing the expanded cooled combined cold separator stream into the top of the demethanizer;

removing a liquid product stream from the bottom of the demethanizer and introducing the liquid product stream into the main heat exchanger where it undergoes indirect heat exchanger with the first partial stream of the feed stream;

removing a overhead gaseous stream from the top of the demethanizer, and subjecting this overhead gaseous stream to indirect heat exchange with the combined cold separator stream, (e.g., in the subcooler) whereby the combined cold separator stream is cooled and partially condensed (depending upon the composition of the stream) and the overhead gaseous stream from the top of the demethanizer is heated, further heating the overhead gaseous stream from the top of the demethanizer by indirect heat exchange with the second partial feed stream, and then compressing and removing at least a portion of the overhead gaseous stream from the demethanizer as a residue gas stream (another optional portion can be removed as fuel gas);

cooling a portion of the residue gas stream by indirect heat exchange in a heat exchanger (e.g., against a refrigerant), and then introducing the cooled portion of the residue gas stream into a further separation means (e.g., a further gas/liquid separator or a further distillation column), recovering a residue liquid stream from the further separation means and introducing the residue liquid stream into the top region of the demethanizer as reflux; and recovering an overhead gas stream from the further separation means, cooling the overhead gas stream by indirect heat exchange (e.g., with a refrigerant), expanding the further cooled overhead residue gas stream and introducing this expanded further cooled overhead gas stream into a second further separation means (e.g., a further gas/liquid separator (LNGL separator) or a further distillation column), recovering an overhead stream from the second further separation means as a further residue gas (boil off gas), recovering a liquid stream from the second further separation means, and feeding this liquid stream from the second further separation means to an LNG exchanger, where liquefaction is performed.

According to a general apparatus aspect of the invention there is provided an apparatus comprising:

one or more heat exchangers for cooling and partially condensing by indirect heat exchange a feed stream containing light hydrocarbons (e.g., a natural gas feed stream);

gas/liquid cold separator and means (e.g., piping conduits) for introducing a partially condensed feed stream from the one or more heat exchangers into the gas/liquid cold separator, the gas/liquid cold separator having upper outlet means (e.g., piping conduits) for removing an overhead gaseous stream and lower outlet means (e.g., piping conduits) for removing a bottoms liquid stream;

means for introducing overhead gaseous stream and bottoms liquid stream from the gas/liquid cold separator into a fractionation system comprising (a) a light ends fractionation column and a heavy ends fractionation column, or (b) a demethanizer (or deethanizer) column, the means comprising an expansion device for expanding at least a portion of overhead gaseous stream from the gas/liquid cold separator and means (e.g., piping conduits) for introducing expanded overhead gaseous stream into (a) a lower region of a light ends fractionation column or (b) an upper region of a demethanizer (or deethanizer) column, and means (e.g., piping conduits) for introducing at least a portion of bottoms liquid stream from the gas/liquid cold separator into (a) a heavy ends fractionation column at an intermediate point thereof or (b) a demethanizer (or deethanizer) column at an intermediate point thereof;

means (e.g., piping conduits) for removing a liquid product stream from the bottom of (a) the heavy ends fractionation column or (b) the demethanizer (or deethanizer) column;

means (e.g., piping conduits) for removing a overhead gaseous stream from the top of (a) the light ends fractionation column or (b) the demethanizer (or deethanizer) column, and if the fractionation system comprises a light ends fractionation column and a heavy ends fractionation column, the apparatus further comprises means (e.g., piping conduits) for removing a bottoms liquid stream from a lower region of the light ends fractionation column, and introducing this bottoms liquid stream from the light ends fractionation column into the upper region of the heavy ends fractionation column;

said apparatus further comprising:

(a) when the fractionation system comprises a light ends fractionation column and a heavy ends fractionation column, (i) a heat exchanger for subjecting a first portion of the light ends fractionation column overhead gaseous stream to indirect heat exchange (e.g., a subcooler) with an overhead gaseous stream removed from the top of the heavy ends fractionation column, whereby the overhead gaseous stream from the top of the heavy ends fractionation column is cooled and partially condensed, and means (e.g., piping conduits) for introducing this cooled and partially condensed overhead gaseous stream from the top of the heavy ends fractionation column into the light ends fractionation column;

(ii) means (e.g., piping conduits) for removing a second portion of the overhead gaseous stream from the light ends fractionation column as a side stream, and a further heat exchanger for subjecting the side stream to indirect heat exchange to further cool, and partially liquefy the side stream;

(iii) means (e.g., piping conduits) for introducing the partially liquefied side stream into a further separation means, means (e.g., piping conduits) for recovering liquid product from the further separation means and means (e.g., piping conduits) for introducing the recovered liquid product into the light ends fractionation column as a liquid reflux stream and/or the heavy ends fractionation column as a liquid reflux stream, (iv) means (e.g., piping conduits) for recovering an overhead vapor stream from the further separation means, a further heat exchanger for subjecting this overhead vapor stream to indirect heat exchange for additional cooling and partial condensation, means (e.g., piping conduits) for feeding the resultant vapor and condensate to an LNG separator, and means (e.g., piping conduits) for recovering LNG liquid product from the LNG separator, and (v) means (e.g., piping conduits) for recovering an overhead vapor stream from the further separation means, a compressor for compressing this overhead vapor stream to form a residue gas; or (b) when the fractionation system comprises a light ends fractionation column and a heavy ends fractionation column, (i) a heat exchanger for subjecting the light ends fractionation column overhead gaseous stream to indirect heat exchange (e.g., in a subcooler) with an overhead gaseous stream removed from the top of the heavy ends fractionation column, whereby the overhead gaseous stream from the light ends fractionation column Is heated and the overhead gaseous stream from the top of the heavy ends fractionation column is cooled and partially condensed, and means (e.g., piping conduits) for introducing this cooled and partially condensed overhead gaseous stream from the top of the heavy ends fractionation column into the light ends fractionation column;

(ii) means (e.g., piping conduits) for introducing the overhead gaseous stream from the light ends fractionation column to a heat exchanger for further heating, and a compressor for compressing the overhead gaseous stream from the light ends fractionation column to produce a residue gas;

(iii) a further heat exchanger for further cooling at least a portion of the residue gas whereby the portion of the residue gas is partially liquefied;

(iv) means (e.g., piping conduits) for introducing a portion of the partially liquefied residue gas into the light ends fractionation column;

(v) an expansion device for expanding another portion of the partially liquefied residue gas and means (e.g., piping conduits) for introducing this expanded portion into a further separation means;

(vi) means (e.g., piping conduits) for recovering liquid product from the further separation means; and (vii) means (e.g., piping conduits) for recovering an overhead vapor stream from the further separation means, a compressor for compressing this overhead vapor stream to form a residue gas; or (c) when the fractionation system comprises a demethanizer (or deethanizer) column, (i) a heat exchanger for subjecting a first portion of the overhead gaseous stream from the demethanizer (or deethanizer) column to indirect heat exchange (e.g., in a subcooler) with a stream obtained by combining a portion of the overhead gaseous stream from the gas/liquid cold separator and a portion of the bottoms liquid stream from gas/liquid cold separator to obtain a residue gas;

(ii) means (e.g., piping conduits) for removing a second portion of the overhead gaseous from the demethanizer (or deethanizer) column as a side stream, and a further heat exchanger for partially liquefying the side stream by heat exchange;

(iii) means (e.g., piping conduits) for introducing the partially liquefied side stream into a further separation means, means (e.g., piping conduits) for recovering liquid product from the further separation means and introducing the recovered liquid product into the demethanizer (or deethanizer) column as a liquid reflux stream, and (iv) means (e.g., piping conduits) for recovering an overhead vapor stream from the further separation means, a further heat exchange means for subjecting this overhead vapor stream to indirect heat exchange for additional cooling and partial condensation, and means (e.g., piping conduits) for removing the resultant condensate as a final LNG liquid product; or (d) when the fractionation system comprises a demethanizer (or deethanizer) column, (i) a heat exchanger for subjecting the demethanizer (or deethanizer) column overhead gaseous stream to indirect heat exchange (e.g., in a subcooler) with a stream obtained by combining a portion of the overhead gaseous stream from the gas/liquid cold separator and a portion of the bottoms liquid stream from gas/liquid cold separator;

(ii) means for subjecting the overhead gaseous stream from the demethanizer (or deethanizer) column to further heating and a compressor for compressing the overhead gaseous stream from the demethanizer (or deethanizer) column to produce a residue gas;

(iii) a further heat exchanger for cooling at least a portion of the residue gas whereby the portion of the residue gas is partially liquefied;

(iv) means (e.g., piping conduits) for introducing this partially liquefied residue gas into a further separation means;

(v) means (e.g., piping conduits) for recovering liquid product from the further separation means and introducing the recovered liquid product as reflux to the demethanizer (or deethanizer) column;

(vi) means (e.g., piping conduits) for recovering an overhead vapor stream from the further separation means, means for subjecting this overhead vapor stream to heat exchange whereby the overhead vapor stream is partially liquefied;

(vii) means (e.g., piping conduits) for introducing this partially liquefied overhead vapor stream into another further separation means; and (viii) means (e.g., piping conduits) for recovering LNG liquid product from the another further separation means.

In accordance with a first apparatus aspect of the invention, there is provided an apparatus for performing the first aspect of the inventive process. The apparatus comprises:

a light ends fractionation column and a heavy ends fractionation column;

a main heat exchanger (e.g., a plate-fin heat exchanger or shell and tube heat exchanger) for cooling and partially condensing a natural gas feed stream by indirect heat exchange;

a gas/liquid cold separator for separating a partially condensed feed stream into an overhead gaseous stream and bottoms liquid stream;

an expansion device (e.g., expansion valve, turbo-expander) for expanding overhead gaseous stream from the gas/liquid cold separator and means for introducing (e.g., pipes, conduits) expanded overhead gaseous stream into a lower region of the light ends fractionation column;

means for introducing (e.g., pipes, conduits) bottoms liquid stream from the gas/liquid cold separator into the heavy ends fractionation column at an intermediate point thereof;

means for removing (e.g., pipes, conduits) a liquid product stream from the bottom of the heavy ends fractionation column and means for introducing (e.g., pipes, conduits) liquid product stream from the bottom of the heavy ends fractionation column into the main heat exchanger for indirect heat exchange with natural gas feed stream;

means for removing (e.g., pipes, conduits, pump) bottoms liquid stream from a lower region of the light ends fractionation column and introducing it into the upper region of the heavy ends fractionation column;

means for removing (e.g., pipes, conduits) overhead gaseous stream from the top of the light ends fractionation column and introducing overhead gaseous stream from the top of the light ends fractionation column into a subcooler for indirect heat exchange with overhead gaseous stream removed from the top of the heavy ends fractionation column;

means for removing (e.g., pipes, conduits) bottoms liquid stream from a lower region of the heavy ends fractionation column, a heat exchanger for heating bottoms liquid stream from a lower region of the heavy ends fractionation column by indirect heat exchange, and means for returning (e.g., pipes, conduits) bottoms liquid stream to the lower region of the heavy ends fractionation column as a reboiler stream;

means for removing (e.g., pipes, conduits) overhead gaseous stream from the top of the heavy ends fractionation column and introducing it into the subcooler for indirect heat exchange with overhead gaseous stream from the top of the light ends fractionation column;

means for removing (e.g., pipes, conduits) cooled and partially condensed overhead gaseous stream from the subcooler and introducing it into the light ends fractionation column;

means for removing (e.g., pipes, conduits) a portion of the overhead gaseous from the light ends fractionation column as a side stream, a flow-control valve for partially liquefying the side stream, and a refrigerant heat exchanger for subjecting partially liquefied side stream to indirect heat exchange with a refrigerant fluid for further cooling;

means for introducing (e.g., pipes, conduits) partially liquefied side stream into a further separation means (e.g., a further gas/liquid separator or a further distillation column), means for recovering (e.g., pipes, conduits) liquid product from the further separation means and introducing it into the light ends fractionation column as a liquid reflux stream and/or the heavy ends fractionation column as a liquid reflux stream, and means for recovering (e.g., pipes, conduits) an overhead vapor stream from the further separation means, a heat exchanger for subjecting overhead vapor stream from the further separation means to indirect heat exchange with a refrigerant fluid for additional cooling and partial condensation, and means for feeding (e.g., pipes, conduits) resultant condensate to an LNG exchanger, where liquefaction is performed.

Second through ninth apparatus aspects of the invention are apparatus systems capable of performing the processes corresponding to each of the second to ninth process aspects described above, examples of which are illustrated in the Figures.

DESCRIPTION OF THE DRAWINGS

The invention as well as further advantages, features and examples of the present invention are explained in more detail by the following descriptions of embodiments based on the Figures, wherein.

The embodiments of FIGS. 1-16 are modifications of the CRYO-PLUS™ process. The embodiments of FIGS. 17-21, on the other hand, are modifications of the so-called Gas Subcooled Process (GSP), and the embodiments of FIGS. 22-26 are modifications of the so-called Recycle Split Vapor (RSV) process.

Figure 1:
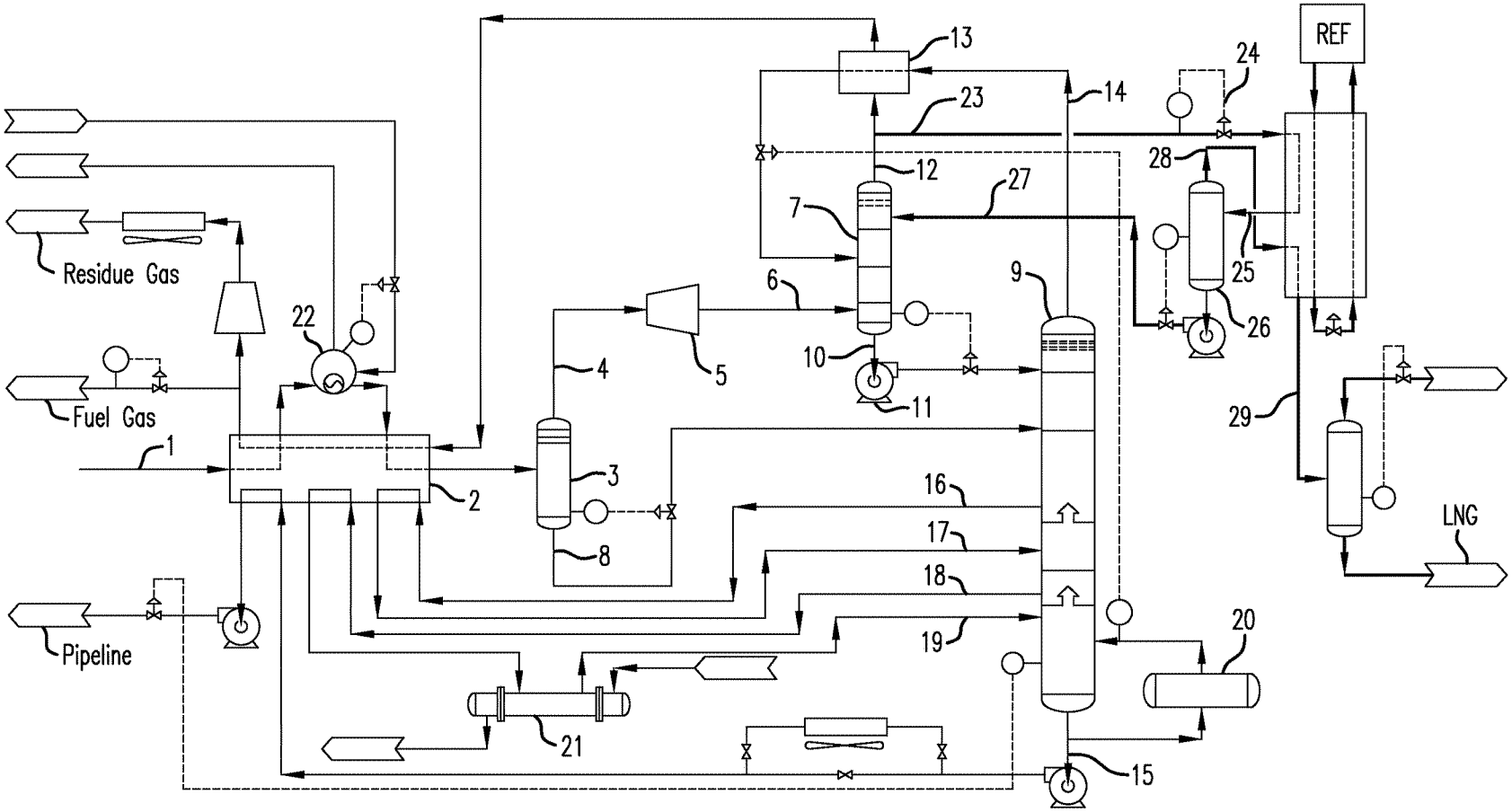
FIGS. 1-27 each schematically show shows exemplary embodiments in accordance with the invention.

In FIG. 1, gas feed stream (1), containing, for example, helium, nitrogen methane, ethane, ethylene, and C3+ hydrocarbons (e.g., a natural gas feed stream) is introduced into the system at a temperature of, e.g., 10 to 50° C. and a pressure of, e.g., 250 to 1400 psig. The gas feed stream (1) is cooled and partially condensed by indirect heat exchange in a main heat exchanger (2) against process streams (15, 16, 18) and then introduced into a gas/liquid cold separator (3). The gaseous overhead stream (4) removed from the top of the cold separator (3) is expanded, for example, in a turbo-expander (5), and then introduced (6) into the lower region of the light ends fractionation column (7) (LEFC). The bottoms liquid stream (8) from the cold separator (3) is introduced into the heavy ends fractionation column (9) (HEFC) at an intermediate point thereof. The light ends fractionation column typically operates at a temperature of −70 to −135° C. and a pressure of 60 to 500 psig. The heavy ends fractionation column typically operates at a temperature of −135 to +70° C. and a pressure of 60 to 500 psig.

A liquid stream (10) is removed from the bottom of the LEFC (7) and delivered, via pump (11), to the top of the HEFC (9). An overhead vapor product (12), also called a residue gas, is removed from the top of the LEFC (7), undergoes indirect heat exchange in a subcooler (13) with a gas stream (14) discharged from the top of the HEFC (9), before being heated in the main heat exchanger (2) and then discharged from the system. A portion of this overhead vapor product can be used as fuel gas. Another portion of the overhead vapor product can be further compressed before being sent to a gas pipeline.

In a typical system, the warm overhead product from the LEFC can be sent to a gas pipeline for delivery to the consumer, or it can be 100% liquefied in an LNG unit, or a portion can flow to the gas pipeline while the remainder can be liquefied by the LNG unit. Liquefying the overhead gas product after warming the gas requires energy. However, as described further below, the inventive process uses overhead gas product from the top of the LEFC as the LNG unit feed, thereby preserving cooling of the overhead gas product and reducing energy consumption.

A liquid product stream (15) is removed from the bottom of the HEFC (9) and passed through the main heat exchanger (2) where it undergoes indirect heat exchanger with the gas feed stream (1). In addition, a further liquid stream (16) is removed from a first intermediate point of the HEFC (9). This further liquid stream (16) is heated by indirect heat exchange with the gas feed stream (1) (e.g., in main heat exchanger (2)), and then reintroduced (17) into the HEFC (9) at a second intermediate point below the first intermediate point. An additional liquid stream (18) is removed from the lower region of the HEFC (9), heated in an indirect heat exchanger (e.g., in main heat exchanger (2) acting as a reboiler for the HEFC (9), and returned (19) to the lower region of the HEFC (9). Further, as noted above, a gas stream (14) is removed from the top of the HEFC (9).

Additional structural elements shown in FIG. 1 are a product surge tank (20) which allows for recycling of a portion of the liquid product stream (15) back to the bottom of the HEFC (9). There also can be a trim reboiler (21) in the reboiler system of the HEFC (9) to supplement the heating provided by the reboiler for the HEFC. Also, in addition to the cooling provided in the main heat exchanger, the refrigeration needed for the cooling and partially condensation of the gas feed stream (1) can be partially provided by passing the gas feed stream (1) through a chiller (22), wherein it undergoes indirect heat exchange with an external refrigerant stream.

In accordance with the invention, a side stream (23) is taken from the overhead vapor product of the LEFC and partially liquefied, via Joule-Thomson effect cooling, across a flow-control valve (24). The partially liquefied vapor stream is then delivered to a refrigerant system wherein it undergoes indirect heat exchange with a refrigerant fluid for further cooling. The resultant stream (25) is then fed into a further separation means (26), such as a further gas/liquid separator or a further distillation column, where the majority of ethane as well as heavier hydrocarbon components are recovered as liquid product (27) and returned to the LEFC as a liquid reflux stream. If a further distillation column is desired as the separation means, it can be integrated into the LNG unit. If the further distillation column requires a reboiler, the reboiler can be integrated into the LNG exchanger.

The overhead vapor stream (28) from the further separation means, rich in methane, undergoes indirect heat exchange with the refrigerant fluid of the refrigerant system for additional cooling. The resultant cooled stream (29) is then fed into the LNG exchanger where it is subjected to liquefaction to form the LNG product. This cooled stream (29) can then be sent to a gas/liquid separator for separating light components, such as nitrogen, before being introduced into the LNG unit.

At an intermediate point in the LNG exchanger, a vapor-liquid stream can be removed and introduced into an intermediate separator to separate heavier hydrocarbons ($C_2$+) and return a lighter (essentially nitrogen, methane and ethane) stream to the LNG exchanger for final liquefaction, to allow the LNG product to meet desired specifications. The resulting liquids are increased in pressure via a pump and can be introduced into the LEFC as an additional reflux stream to further improve the $C_2$+ recovery. The vapor stream from the intermediate separator reenters the LNG exchanger and proceeds, via additional cooling, to liquefy.

This integration of the NGL and LNG processes allows for a significant reduction of energy consumption in the LNG unit without compromising the NGL recovery process. The utilization of a portion of the cold overhead vapor from the LEFC of the NGL process reduces refrigeration requirements, allowing the processes to take place in a more efficient manner that not only reduces overall energy consumption, but also provides improved recoveries for both processes.

Figure 2:
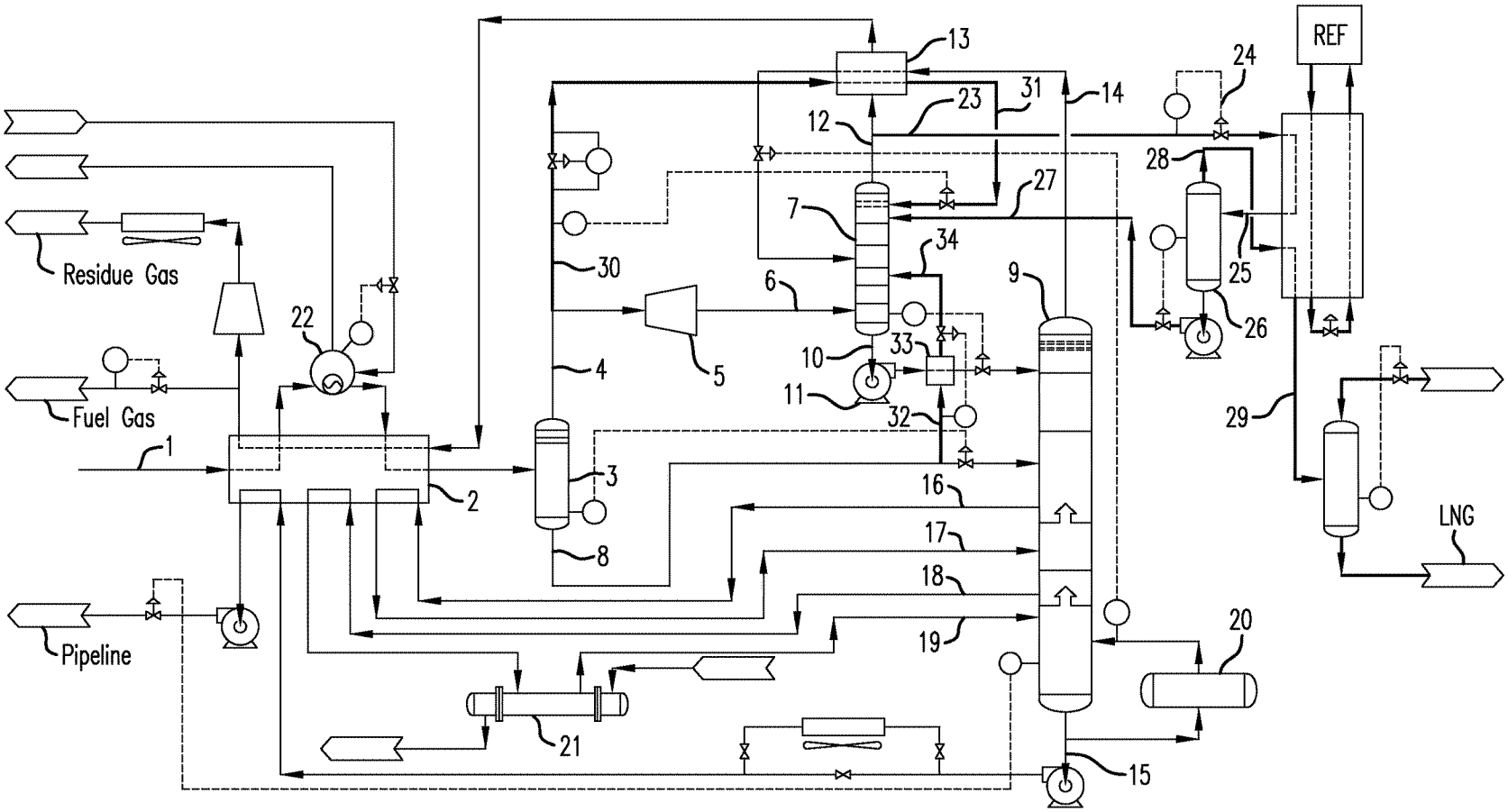

FIG. 2 illustrates an alternative embodiment of the invention. As in FIG. 1, a side stream (23) is taken from the overhead vapor product (12) of the LEFC and partially liquefied across a flow-control valve (24). The partially liquefied vapor undergoes indirect heat exchange with a refrigerant fluid for further cooling and is then fed into a further separation means (e.g., a further gas/liquid separator or further distillation column) where the majority of ethane as well as heavier hydrocarbon components are recovered as liquid product (27) and returned to the LEFC (7) as a liquid reflux stream. The methane-rich overhead vapor stream (28) from the further separation means undergoes indirect heat exchange with the refrigerant fluid for additional cooling, and is then fed as into the LNG exchanger, where liquefaction occurs.

In FIG. 2, however, additional reflux streams are provided for the LEFC (7). Prior to expansion of the gaseous overhead stream (4), obtained from cold separator (3), in the turboexpander (5), a portion (30) of the gaseous overhead stream (4) is fed to the subcooler (13) where it undergoes indirect heat exchange with the overhead vapor from LEFC (7). In the subcooler (13), portion (30) of the gaseous overhead stream (4) is cooled further and partially liquefied, and then is introduced into the top region of the LEFC (7) to thereby provide additional reflux (31).

In addition, a portion (32) of bottoms liquid stream (8) from cold separator (3) is delivered to a liquid/liquid heat exchanger (33), where it undergoes indirect heat exchange with bottom liquid (10) removed from the bottom of the LEFC (7). The resultant stream (34) is then fed to an intermediate region of the LEFC (7) as a liquid reflux. These two additional reflux streams for the LEFC (7) improve recovery of the ethane and heavier hydrocarbon components.

Figure 3:
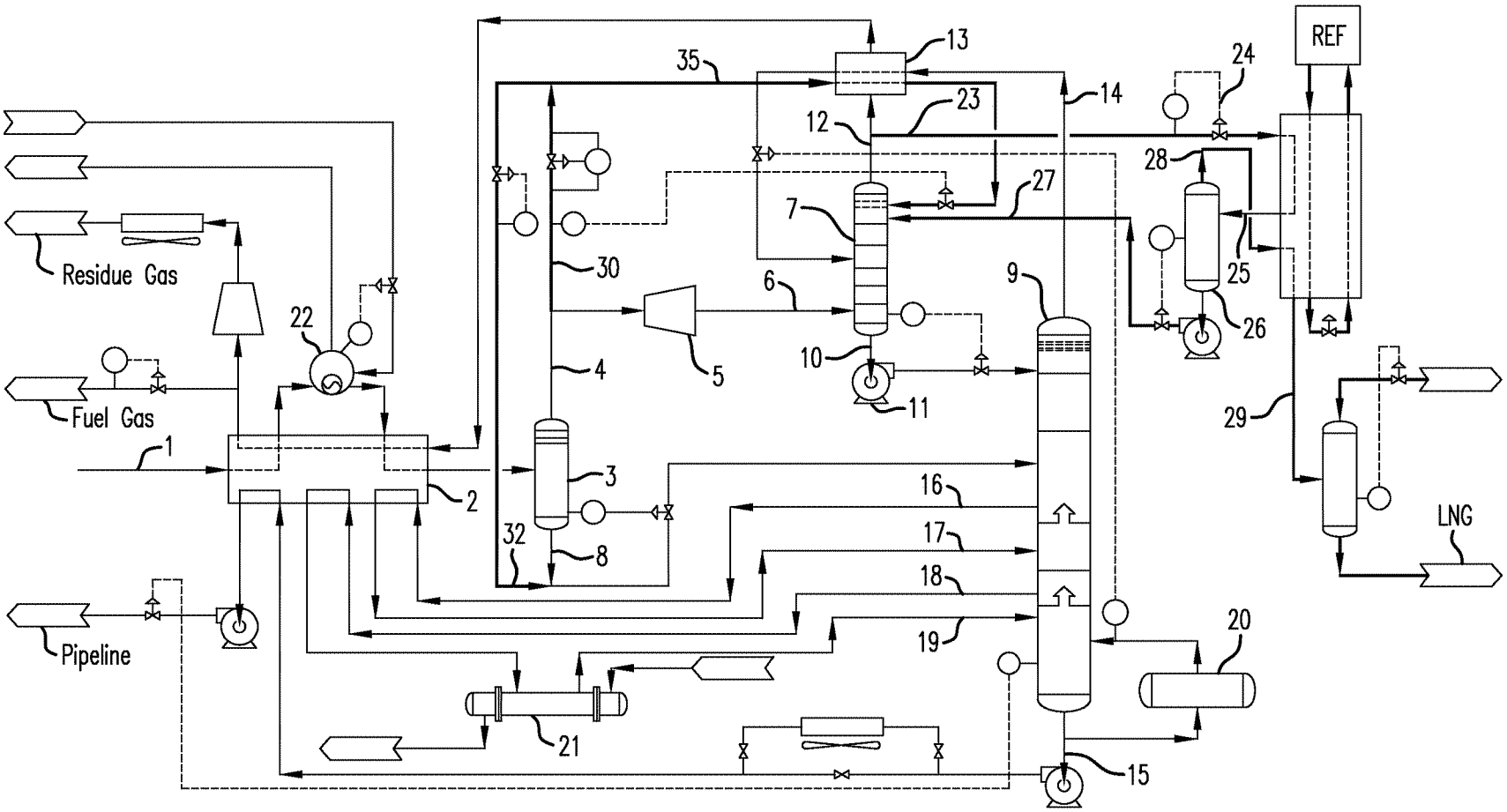

A further embodiment is illustrated in FIG. 3. As in FIGS. 1 and 2, a side stream (23) is taken from the overhead vapor product (12) of the LEFC and partially liquefied across a flow-control valve (24). The partially liquefied vapor undergoes indirect heat exchange with a refrigerant fluid for further cooling and is then fed into a further separation means (e.g., a further gas/liquid separator or further distillation column) where the majority of ethane as well as heavier hydrocarbon components are recovered in as liquid product (27) and returned to the LEFC (7) as a liquid reflux stream. The methane-rich overhead vapor stream (28) from the further separation means undergoes indirect heat exchange with the refrigerant fluid for additional cooling, and is then fed as into the LNG exchanger, where liquefaction occurs.

As in FIG. 2, FIG. 3 provides additional reflux for the LEFC (7). Here again, prior to expansion in the turboexpander (5), a portion (30) is branched off from the gaseous overhead stream (4) removed from the top of cold separator (3) (4). In this case, however, the portion (30) is combined with a portion (32) of bottoms liquid stream (8) removed from the bottom of the cold separator (3). The relative proportions of the liquid and vapor removed provide the mechanism to allow the generation of additional reflux in the indirect heat exchanger (subcooler) that follows. For example, in the combined stream the proportion of the gaseous overhead stream is up to 80%, and the proportion of the bottoms liquid stream is up to 99%

The combined stream (35) is fed to the subcooler (13) where it undergoes indirect heat exchange with the overhead vapor from LEFC (7). Stream (35) is cooled and partially liquefied in the subcooler (13) and introduced into the top region of the LEFC (7) to provide additional reflux. This additional reflux stream for the LEFC (7) improves recovery of the ethane and heavier hydrocarbon components.

Figure 4:
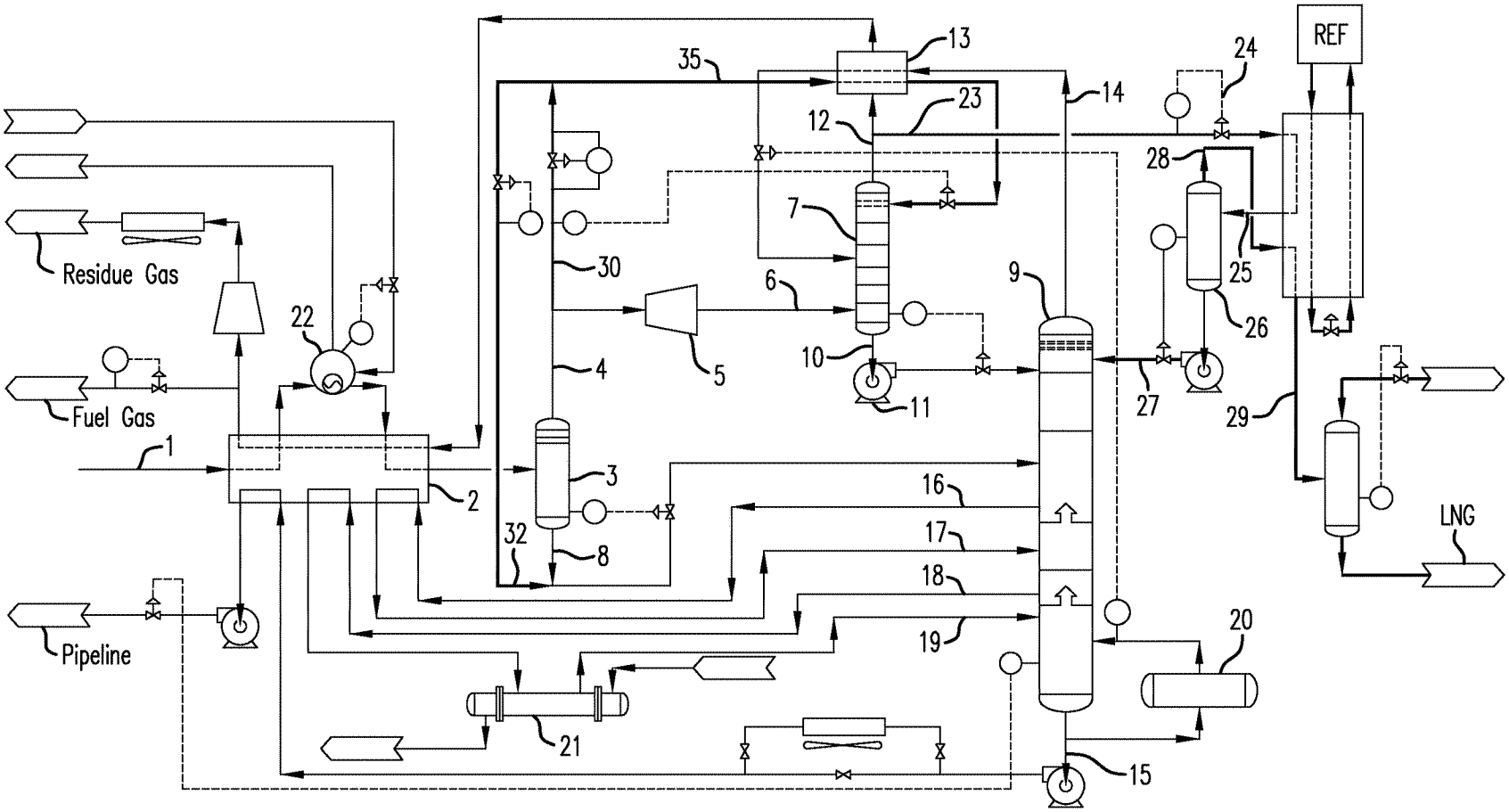

FIG. 4 illustrates a modification of the embodiment of FIG. 3. As in FIGS. 1-3, a side stream (23) is taken from the overhead vapor product (12) of the LEFC and partially liquefied across a flow-control valve (24). In FIG. 4, this partially liquefied stream is treated in the same manner as in FIG. 3. A portion (30) of the gaseous overhead stream (4) removed from the top of cold separator (3) is combined with a portion (32) of bottoms liquid stream (8) removed from the bottom of the cold separator (3). The combined stream (35) is fed to the subcooler (13), where it undergoes indirect heat exchange with the overhead vapor from LEFC (7). The cooled and partially liquefied stream (35) is introduced into the top region of the LEFC (7) to provide additional reflux.

As in FIGS. 1-3, in FIG. 4 a side stream (23) is taken from the overhead vapor product (12) of the LEFC and partially liquefied across a flow-control valve (24). However, in FIG. 4, this side stream (23) taken from the overhead vapor product (12) of the LEFC is treated differently. The partially liquefied vapor undergoes indirect heat exchange with a refrigerant fluid for further cooling and is then fed into a further separation means (e.g., a further gas/liquid separator or further distillation column). The methane-rich overhead vapor stream (28) from the further separation means undergoes indirect heat exchange with the refrigerant fluid for additional cooling, and is then fed as stream 29 into the LNG exchanger, where liquefaction occurs. The majority of ethane as well as heavier hydrocarbon components are recovered from the bottom of the further separation means as liquid product (27). But, instead of being sent to the LEFC (7), in the embodiment of FIG. 4 this liquid product (27) is introduced into the top of the HEFC (9) as a liquid reflux stream.

Figure 5:
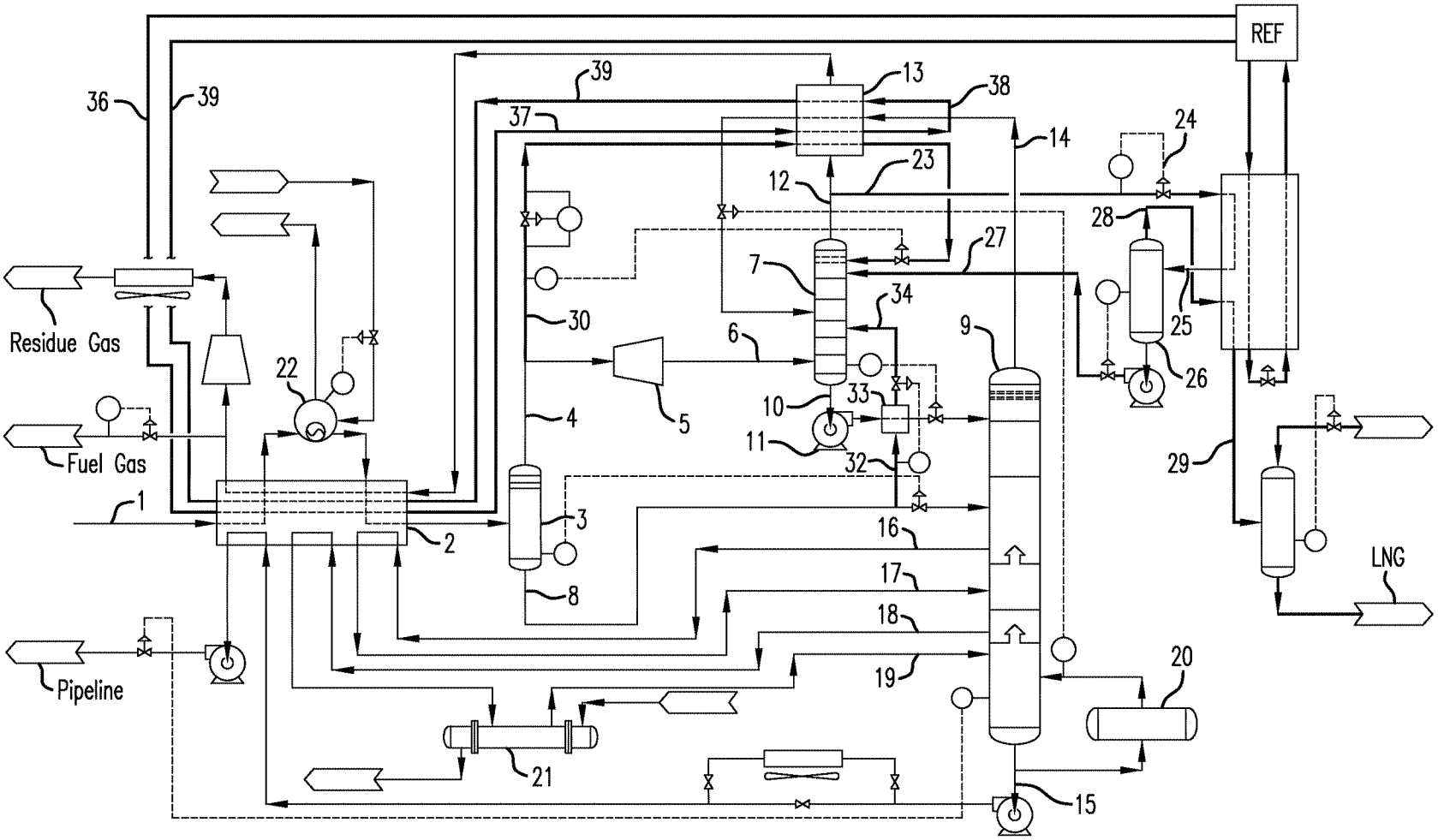

FIG. 5 illustrates a modification of the embodiment of FIG. 2. As in FIG. 2, a side stream (23) is taken from the overhead vapor product (12) of the LEFC and partially liquefied across a flow-control valve (24). The partially liquefied vapor undergoes indirect heat exchange with a refrigerant fluid for further cooling and is then fed into a further separation means (26) where the majority of ethane as well as heavier hydrocarbon components are recovered as liquid product (27) and returned to the LEFC (7) as a liquid reflux stream. The methane-rich overhead vapor stream (28) from the further separation means (26) undergoes indirect heat exchange with the refrigerant fluid for additional cooling, and is then fed as stream 29 into the LNG exchanger, where liquefaction occurs.

Further, as in FIG. 2, additional reflux streams are provided for the LEFC (7). Prior to expansion of the gaseous overhead stream (4), obtained from cold separator (3), in the turboexpander (5), portion (30) of the gaseous overhead stream (4) removed from the top of cold separator (3) is fed to the subcooler (13), where it undergoes indirect heat exchange with the overhead vapor (12) from LEFC (7). In the subcooler (13), portion (30) of the gaseous overhead stream (4) is cooled further and partially liquefied in the subcooler (13) and introduced into the top region of the LEFC (7) to thereby provide additional reflux. In addition, a portion (32) of bottoms liquid stream (8) removed from the bottom of the cold separator (3) is delivered to a liquid/liquid heat exchanger (33), where it undergoes indirect heat exchange with the bottom liquid stream (10) removed from the bottom of the LEFC (7). The resultant stream (34) is then fed to an intermediate region of the LEFC (7) as a liquid reflux.

FIG. 5, however, incorporates a refrigeration loop through the NGL process which results in a reduction in energy consumption. Specifically, a stream of refrigerant fluid (36) from the refrigerant system is fed through the main heat exchanger (2) (e.g., a plate-fin heat exchanger) where it undergoes indirect heat exchange with the gas feed stream (1), the liquid product stream (15) from the bottom of the HEFC (9), the further liquid stream (16) from an intermediate point of the HEFC (9), the reboiler stream (18) removed from the bottom region of the HEFC (9), and the overhead vapor product stream (12) removed from the top of the LEFC (7). The refrigerant stream, cooled and partially liquefied, leaves the main heat exchanger as stream (37). Thereafter, the refrigerant stream is introduced into the subcooler (13) where it is further cooled and liquefied. This stream is then flashed across a valve (38), causing the fluid to reach even colder temperatures and is then fed back to the subcooler (13) to provide cooling to the reflux streams of the LEFC (7). The refrigerant stream (39) then returns to the main heat exchanger (2), where it serves as a coolant to the NGL process streams. The refrigerant stream is then returned to the refrigeration system for compression.

Figure 6:
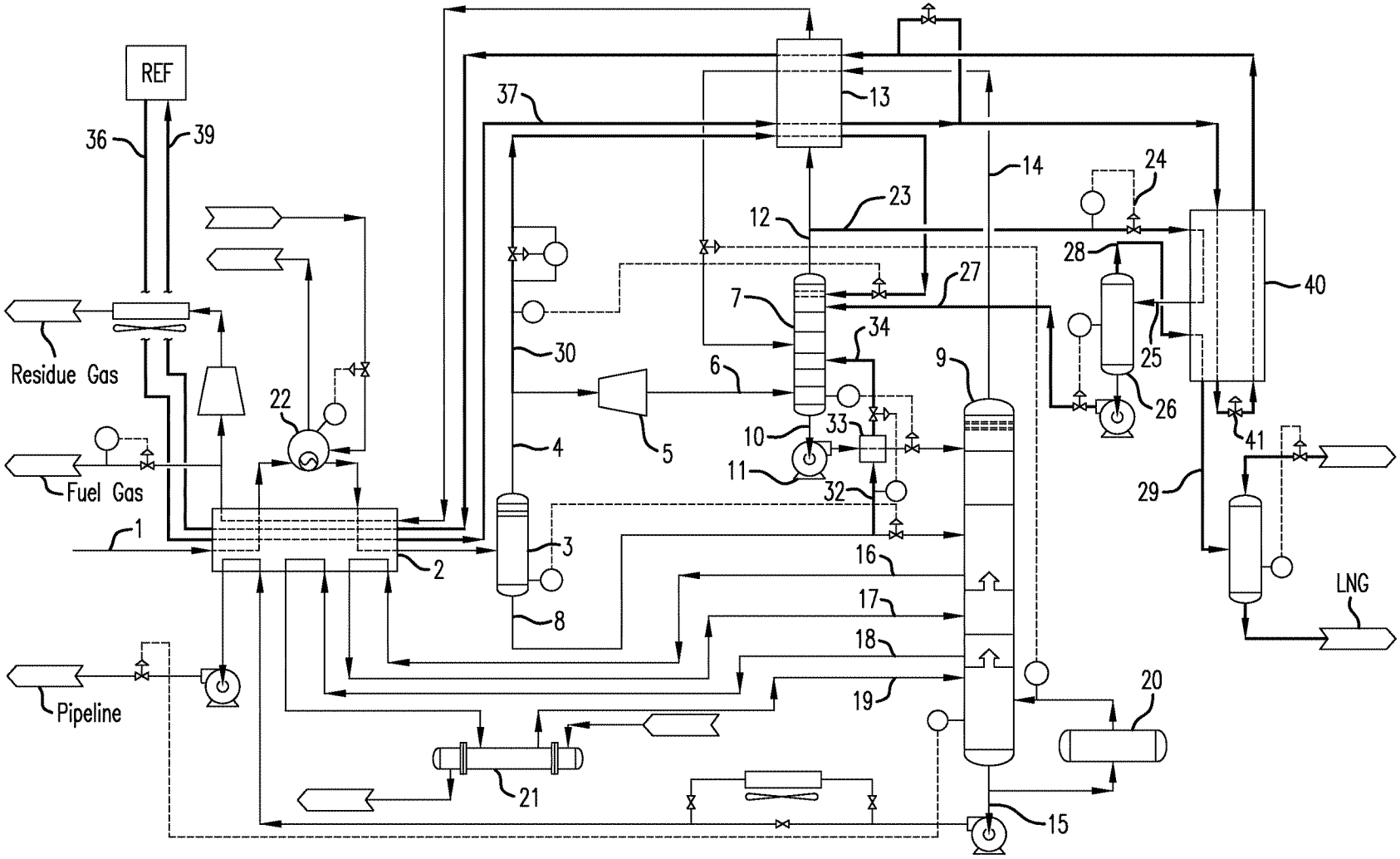

FIG. 6 illustrates an embodiment which is similar to that shown in FIG. 5, but with a modified refrigeration loop. A stream of refrigerant fluid (36) from the refrigerant system is fed through the main heat exchanger (2) where it undergoes indirect heat exchange with the gas feed stream (1), the liquid product stream (15) from the bottom of the HEFC (9), the further liquid stream (16) from an intermediate point of the HEFC (9), the reboiler stream (18) removed from the bottom region of the HEFC (9), and the overhead vapor product stream (12) removed from the top of the LEFC (7). The refrigerant stream, cooled and partially liquefied, leaves the main heat exchanger (2) as stream (37). Thereafter, the refrigerant stream is introduced into the subcooler (13) where it is further cooled and liquefied. This stream is then introduced into a heat exchanger (40) for cooling the side stream (23) from the LEFC overhead vapor product stream (12). The refrigerant stream exits heat exchanger (40) and is flashed across a valve (41), causing the fluid to reach even colder temperatures. The resultant stream is then fed back to the same heat exchanger (40) to provide further cooling. Thereafter, the refrigerant passes through the subcooler (13) and the main heat exchanger (2), and then flows to the refrigeration system for compression.

Figure 7:
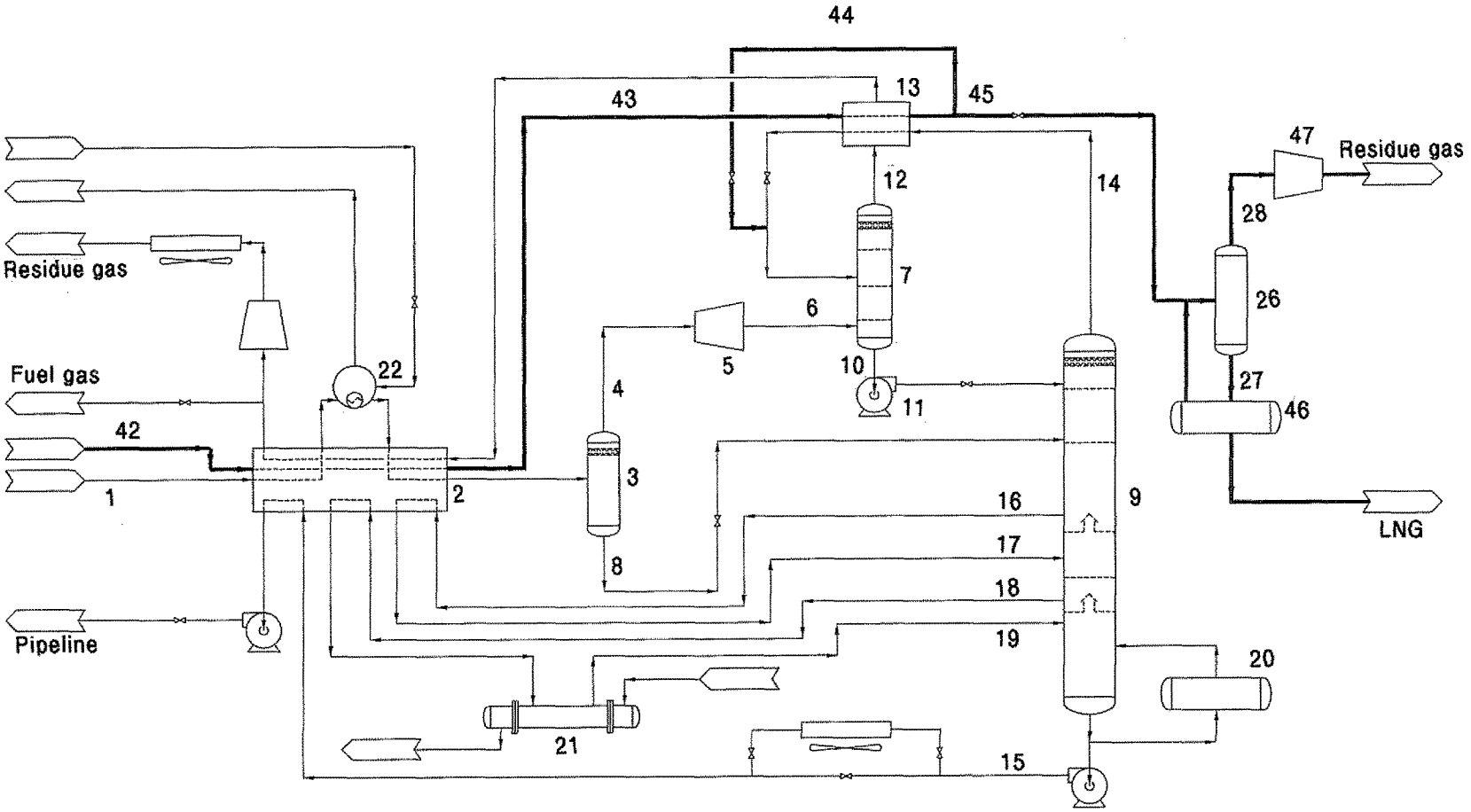

FIG. 7 shows a further embodiment of the invention. In this embodiment, a side stream is not removed from the overhead vapor product of the LEFC. Moreover, a residual gas stream is utilized in the main heat exchanger (2) (and the subcooler (13) and then treated in the further separation means (26). This embodiment allows for a reduction in utility consumption when compared to a standalone LNG unit, thereby rendering the process more energy efficient.

Thus, in FIG. 7, a portion of the high pressure residue gas (42) is introduced into the cryogenic process and passes through the main heat exchanger (2). In main heat exchanger (2), this high pressure residue gas is cooled by heat exchange against various process stream (e.g., residue gas from the top of the LEFC, the feed stream, product stream from the bottom of the HEFC, and side streams from the HEFC). Thereafter, the cooled high pressure residue gas (43) is further cooled in the subcooler (13) by heat exchange with overhead vapor product (12), also called a residue gas, removed from the top of the LEFC (7), and overhead vapor product (12) removed from the top of the HEFC (9).

A portion of the cooled high pressure reside gas stream (44) is then flashed expanded (e.g., via an expansion valve) to the operating pressure of the LEFC (7) and combined with the overhead vapor product (14) removed from the top of the HEFC, after the latter is subcooled in subcooler (13). The combined stream serves as reflux to the LEFC and is considered the top feed to the column. The remaining portion of the cooled high pressure residue gas stream (45) is flashed (e.g., via an expansion valve to a lower pressure then the other portion and is fed to the further separation means (26) (e.g., a LNGL separator). The liquid (27) removed from the bottom of the further separation means is a methane-rich liquid which is sent to an LNG storage vessel (46) before being sent to the LNG production unit. The vapor stream removed from the top of the further separation means (26) is compressed in a boil-off gas (BOG) compressor (47) and removed as a residue gas stream. The BOG compressor, compresses the potentially nitrogen rich stream from the low pressure of the liquefaction temperature to the final discharge pressure of the residue gas compressor. This boil off gas is combined with other residue gas at a point downstream of the removal of any portion of residue gas that is to be used in the system. The potentially high nitrogen concentration in the boil off gas renders it less suitable for use in the system for cooling purposes.

Figure 8:
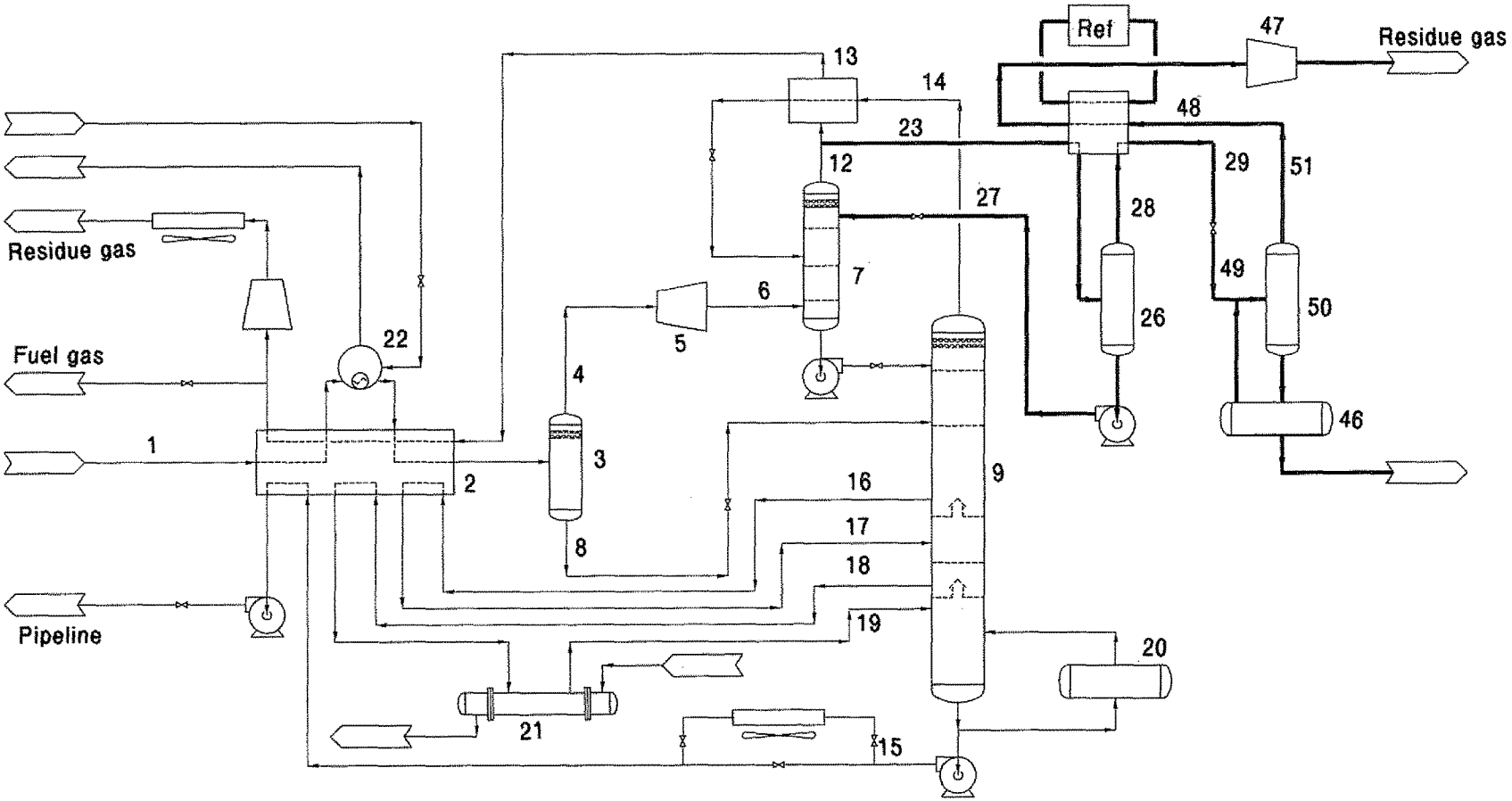

FIG. 8 shows a further embodiment of the invention. In this embodiment, a side stream (23) is removed from the overhead vapor product (12) of the LEFC (7) is used as feed for the LNG production unit. The LEFC overhead vapor side stream, before being used as feed for the LNG production unit, is cooled and liquefied by a standalone refrigeration source (REF). By using a cooled portion of the LEFC overhead vapor as a feed to the LNG unit, the utility consumption of the refrigeration unit is decreased and thereby the process is rendered more energy efficient when compared to a standalone LNG production unit. Additionally, using a portion of the cold liquid from the LNG production unit as reflux for the LEFC increases the efficiency and product recovery.

As shown in FIG. 8, prior to delivery to the subcooler (13) a portion (23) of the LEFC overhead vapor is removed and introduced as feed to the LNG production unit. In particular, this portion of the LEFC overhead vapor is partially liquefied by heat exchange in an LNGL heat exchanger (48) (i.e., a heat exchanger that combines functions of the NGL LNG units) with refrigerant and with a residue gas from the LNG production unit. The resulting stream partially liquefied is fed to a further separation means such as a reflux separator (26), where the majority of ethane as well as heavier hydrocarbon components are separated as liquid, removed as bottom liquid from the reflux separator (26), and returned to the LEFC as reflux (27).

The methane-rich vapors (28) from the top of the reflux separator (26) are further cooled by heat exchange in LNGL heat exchanger (48) against refrigerant and boil off gas from the LNG production unit. The resultant partially liquefied methane-rich stream (29) is then flashed (e.g., by expansion in an expansion valve) to a lower pressure and the resultant stream (49) is fed into a further separator (50), i.e., a LNGL separator. The methane-rich liquid removed the bottom of the further separator (50) is optionally sent to an LNG storage vessel (46) before being sent to further processing, if desired. The vapor 51 (i.e., boil off gas) removed from the top of the further separator (50) is subjected to heat exchange in the LNGL exchanger (48) to provide additional cooling for the portion of the LEFC overhead vapor (23), and is then compressed in a BOG compressor (47) and combined with residue gas from NGL recovery unit.

Figure 9:
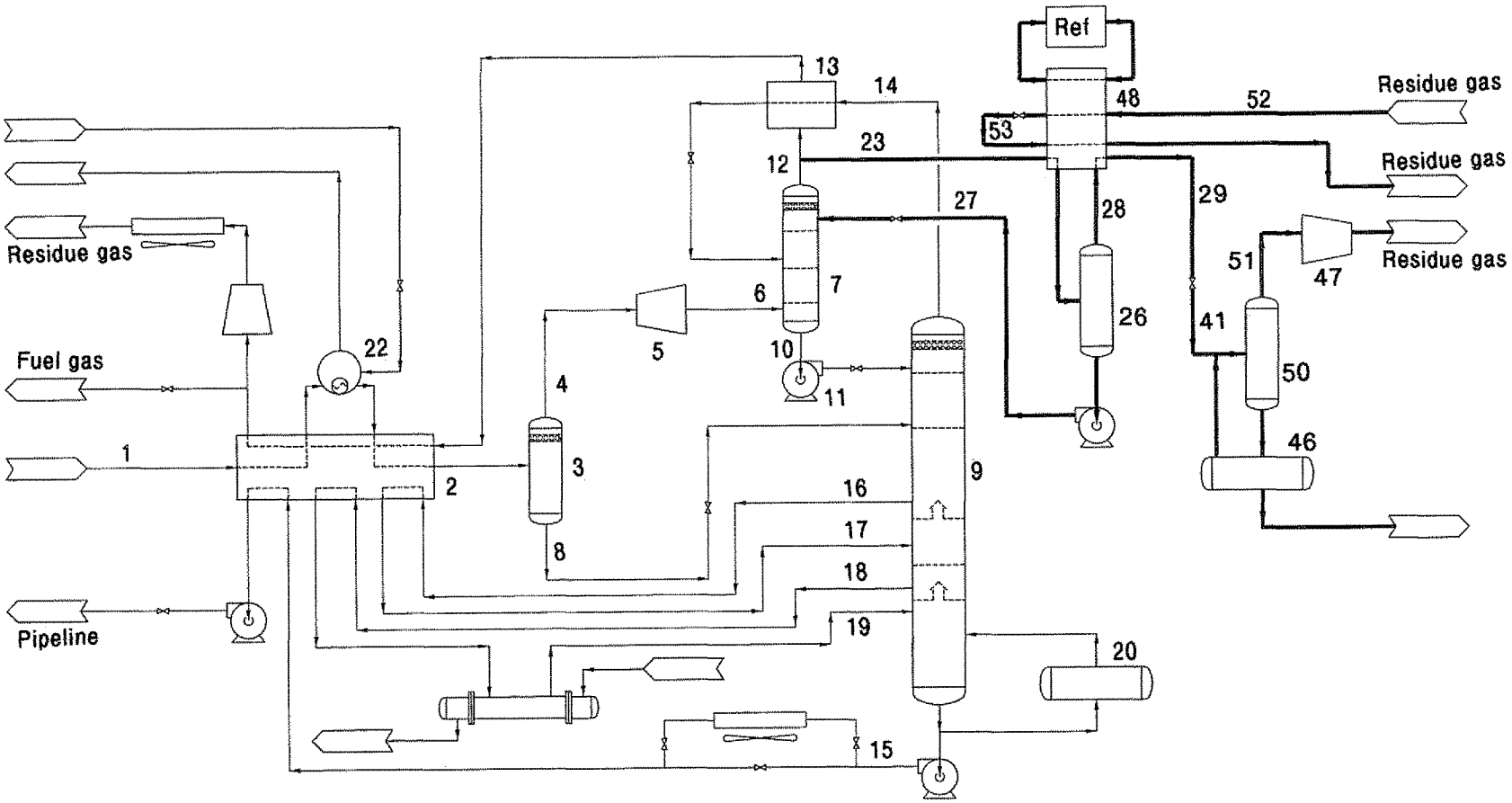

FIG. 9 shows a modification of the embodiment of FIG. 8. In FIG. 8, the vapor (51), i.e., boil off gas, removed from the top of the further separator (50) is subjected to heat exchange in the LNGL exchanger (48) to provide additional cooling for the portion of the LEFC overhead vapor (23), and is then compressed in the BOG compressor (47) and combined with residue gas from NGL recovery unit. However, in FIG. 9, this vapor (51) removed from the top of the further separator (50) is compressed in the BOG compressor (47) without previously being used in the LNGL exchanger (48) to provide additional cooling for the portion of the LEFC overhead vapor (23). Additionally, a residue gas (52) is introduced into the LNGL heat exchanger (48), where it is cooled and liquefied. After exiting the LNGL exchanger (48), the liquefied residue gas is flashed across a valve, causing the fluid to reach even colder temperatures, and is then fed back to LNGL heat exchanger (48) to provide further cooling for the LNG production unit.

Figure 10:
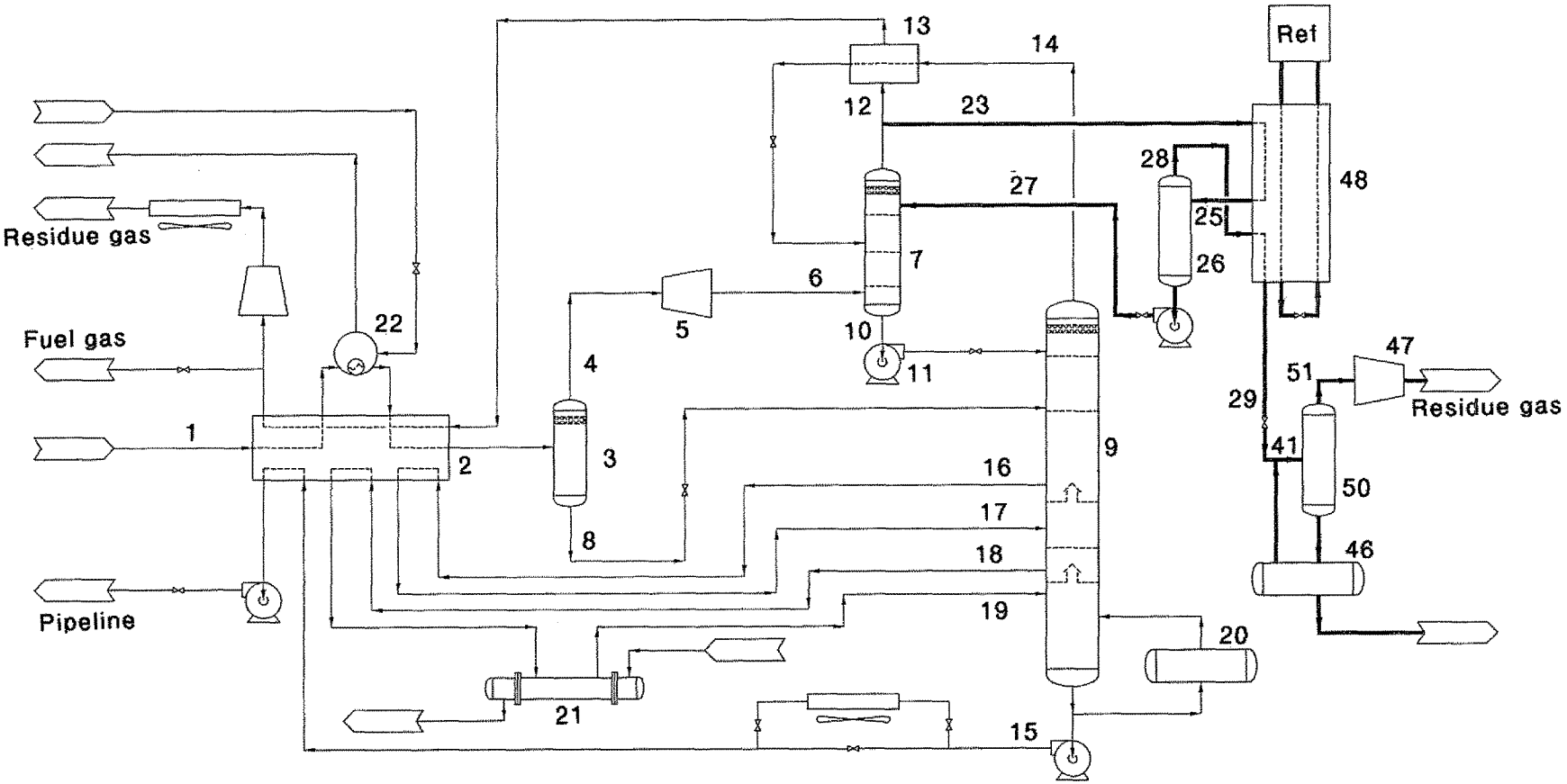

FIG. 10 shows an embodiment that is very similar to the embodiment of FIG. 1, except that the treatment of the overhead vapor stream (28) from the further separation means (26) differs. Thus, as in FIG. 1, in the embodiment of FIG. 10 a side stream (23) is taken from the overhead vapor product of the LEFC (7). The side stream (23) is delivered to a refrigerant system where it undergoes indirect heat exchange with a refrigerant fluid (REF). The resultant stream (25) is then fed into a further separation means (26), such as a further gas/liquid separator or a further distillation column. The majority of ethane and heavier hydrocarbon components are recovered from the bottom of the further separation means (26) as a liquid product stream (27) and returned to the LEFC as a liquid reflux.

The overhead vapor stream (28) from the further separation means (26), rich in methane, undergoes indirect heat exchange in an LNGL heat exchanger with the refrigerant fluid of the refrigerant system for additional cooling. This methane rich stream leaves the LNGL exchanger as a cooled partially liquefied stream (29) and is then flashed (e.g., by expansion in an expansion valve) to a lower pressure. The resultant stream (41) is fed into a further separator (50), i.e., a LNGL separator. The methane-rich liquid removed the bottom of the further separator (50) is optionally sent to an LNG storage vessel (46) before being sent to the LNG production unit. The vapor removed from the top of the further separator (50) is compressed in BOG compressor (47) and sent to residue gas, e.g., combined with other residue gas from NGL recovery unit.

Figure 11:
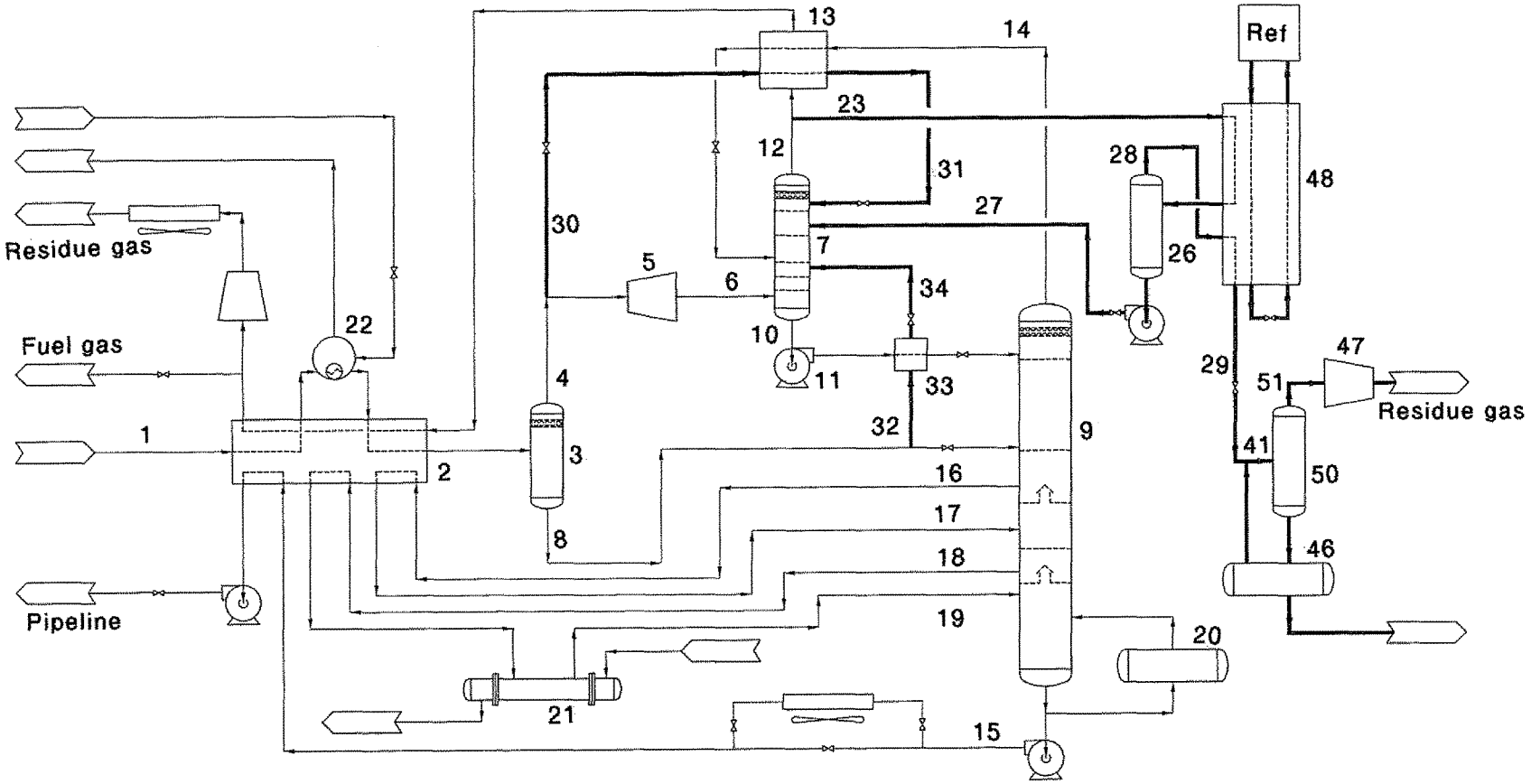

FIG. 11 shows an embodiment which combines the embodiment of FIG. 2 with that of FIG. 10. By using a portion of the cooled LEFC overhead (23) as a feed to the LNG production unit, the utility consumption of the refrigeration unit is decreased and thereby the process is rendered more energy efficient when compared to a standalone LNG production unit. Additionally, returning a portion of the cold liquid from the LNG unit as well as streams from the cold separator as reflux streams to the LEFC increases efficiency and product recovery of the NGL recovery unit.

Thus, as in FIG. 2, additional reflux streams are provided for the LEFC in the embodiment of FIG. 11. Prior to expansion, a portion (30) of the gaseous overhead stream (4) from the cold separator (3) is fed to the subcooler (13) where it undergoes indirect heat exchange with the overhead vapor from LEFC (7). In the subcooler (13), this portion (30) is further cooled and partially liquefied, and then expanded and introduced into the top region of the LEFC (7) to thereby provide additional reflux (31).

In addition, a portion (32) of bottoms liquid stream (8) from cold separator (3) is delivered to a liquid/liquid heat exchanger (33), where it undergoes indirect heat exchange with bottom liquid (10) removed from the bottom of the LEFC (7). The resultant stream (34) is then expanded and fed into an intermediate region of the LEFC (7) as a liquid reflux.

Also, as in FIG. 10, in the embodiment of FIG. 11, the methane-rich vapor stream that leaves LNGL exchanger (48) as a partially liquefied stream (29) is flashed (e.g., by expansion in an expansion valve) to a lower pressure. The resultant stream (41) is fed into a further separator (50), i.e., a LNGL separator. The methane-rich liquid removed the bottom of the further separator (50) is optionally sent to an LNG storage vessel (46) before being sent to the LNG production unit. The vapor (boil off gas) (51) removed from the top of the further separator (50) is compressed in a BOG compressor (47) and sent to residue gas, e.g., combined with other residue gas from NGL recovery unit.

Figure 12:
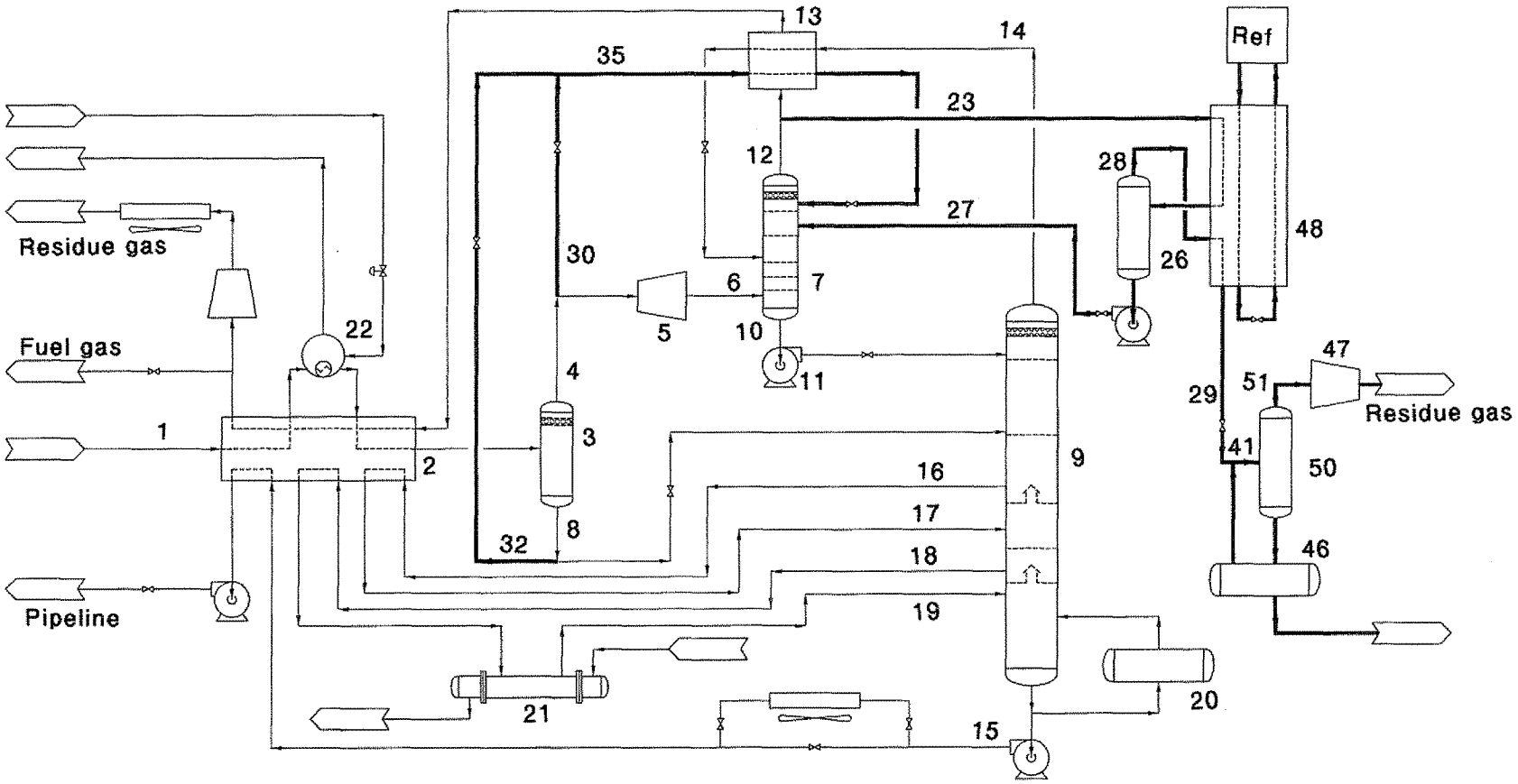

FIG. 12 illustrates a system that combines the embodiment of FIG. 3 with that of FIG. 10. As with the embodiment of FIG. 10, the use of a portion (23) of the cooled LEFC overhead as a feed to the LNG production unit decreases utility consumption of the refrigeration unit and thereby renders the process more energy efficient. Additionally, returning a portion of the cold liquid from the LNG unit as well as streams from the cold separator as reflux streams to the LEFC increases efficiency and product recovery of the NGL recovery unit.

In FIG. 12, as in FIGS. 10 and 11, the methane rich stream that leaves LNGL exchanger (48) as a cooled partially liquefied stream (29) is flashed (e.g., by expansion in an expansion valve) to a lower pressure. The resultant stream (41) is fed into a further separator (50), i.e., a LNGL separator. The methane-rich liquid removed the bottom of the further separator (50) is optionally sent to an LNG storage vessel (46) before being sent to the LNG production unit. The vapor (boil off gas) (51) removed from the top of the further separator (50) is compressed in a BOG compressor (47) and sent to residue gas, e.g., combined with other residue gas from NGL recovery unit.

As in FIG. 3, the system of FIG. 12 provides additional reflux streams for the LEFC (7). Prior to expansion in turboexpander (5), a portion (30) is branched off from the gaseous overhead stream (4) removed from the top of cold separator (3). This portion (30) is combined with a portion of bottoms liquid stream (32) removed from the bottom of the cold separator (3). The combined stream (35) is fed to subcooler (13) where it undergoes indirect heat exchange with the overhead vapor from LEFC (7). Stream (35) is cooled and partially liquefied in the subcooler (13), and then expanded and introduced into the top region of the LEFC (7) to provide additional reflux. This additional reflux stream for the LEFC (7) improves recovery of the ethane and heavier hydrocarbon components.

Figure 13:
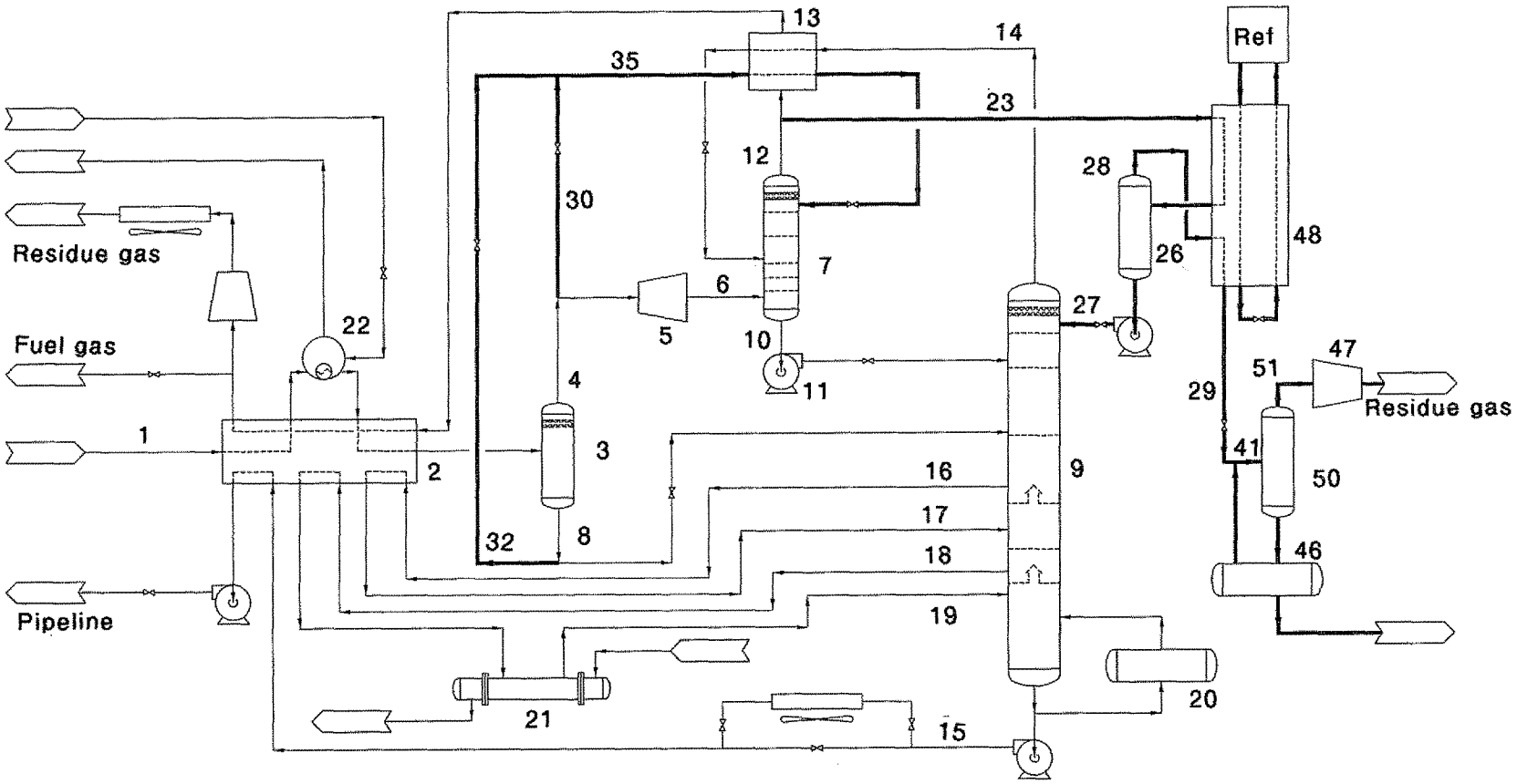

FIG. 13 illustrates a system that combines the embodiments of FIGS. 4 and 10. As with the embodiment of FIG. 10, the use of a portion (23) of the cooled LEFC overhead as a feed to the LNG production unit decreases utility consumption of the refrigeration unit and thereby renders the process more energy efficient. Additionally, returning a portion of the cold liquid from the LNG unit as a reflux stream to the HEFC (see, e.g., FIG. 4), as well as using streams from the cold separator as reflux streams for the LEFC, increases efficiency and product recovery of the NGL recovery unit.

As in FIG. 4, in the system of FIG. 13 the side stream (23) taken from the overhead vapor product (12) of the LEFC undergoes indirect heat exchange in the LNGL exchanger (48) with a refrigerant fluid for cooling and is then fed into a further separation means (26) (e.g., a further gas/liquid separator or further distillation column). The methane-rich overhead vapor stream (28) from the further separation means (26) undergoes indirect heat exchange with the refrigerant fluid for additional cooling in the LNGL exchanger (48). As in FIGS. 10 and 11, the methane rich stream that leaves LNGL exchanger as a cooled partially liquefied stream (29) is flashed (e.g., by expansion in an expansion valve) to a lower pressure. The resultant stream (41) is fed into a further separator (50), i.e., a LNGL separator. The methane-rich liquid removed the bottom of the further separator (50) is optionally sent to an LNG storage vessel (46) before being sent to the LNG production unit. The vapor (boil off gas) (51) removed from the top of the further separator (50) is compressed in BOG compressor (47) and sent to residue gas, e.g., combined with other residue gas from NGL recovery unit.

As in FIG. 4, the system of FIG. 13 provides additional reflux streams for both the LEFC (7) and the HEFC (9). The ethane and heavier hydrocarbon components recovered from the bottom of the further separation means (26) as liquid product (27) are introduced into the top of the HEFC (9) as a liquid reflux stream, rather than being sent to the LEFC (7). Also, prior to expansion in turboexpander (5), a portion (30) is branched off from the gaseous overhead stream (4) removed from the top of cold separator (3). This portion (30) is combined with a portion of bottoms liquid stream (32) removed from the bottom of the cold separator (3). The combined stream (35) is fed to subcooler (13) where it undergoes indirect heat exchange with the overhead vapor (12) from LEFC (7). Stream (35) is cooled and partially liquefied in the subcooler (13), and then expanded and introduced into the top region of the LEFC (7) to provide additional reflux.

Figure 14:
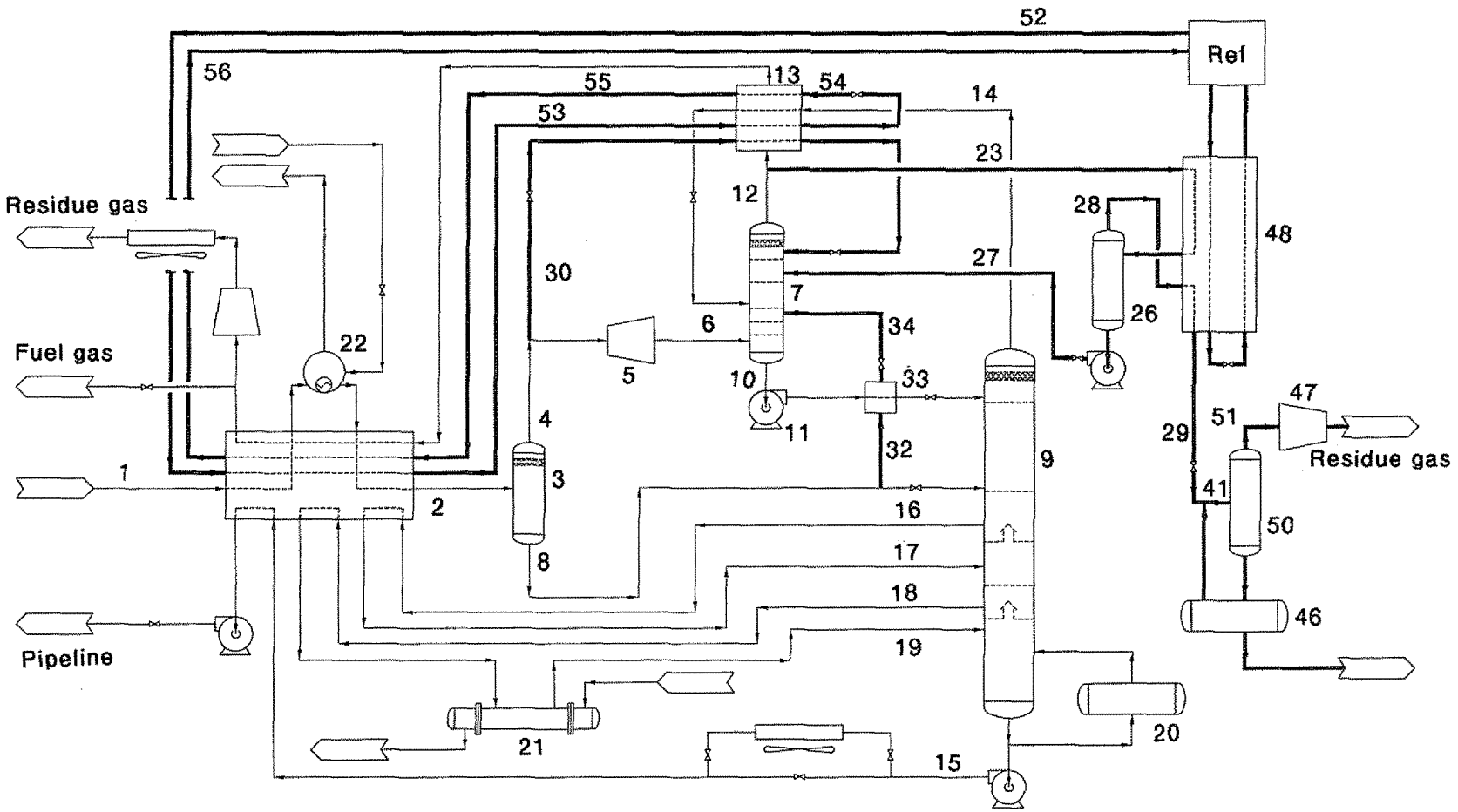

FIG. 14 illustrates a system that combines the embodiments of FIGS. 5 and 10. As with the embodiment of FIG. 10, the use of a portion (23) of the LEFC overhead as a feed to the LNG production unit decreases utility consumption of the refrigeration unit and thereby renders the process more energy efficient. Additionally, returning a portion of the cold liquid from the LNG unit as a reflux stream to the LEFC (see, e.g., FIG. 5), as well as using streams from the cold separator as reflux streams for the LEFC, increases efficiency and product recovery of the NGL recovery unit. Further, the incorporation of a refrigeration loop through the NGL process results in further reduction in energy consumption.

As in FIGS. 2 and 5, in FIG. 14 a side stream (23) is taken from the overhead vapor product (12) of the LEFC and subjected to indirect heat exchange (48) with a refrigerant fluid for further cooling. This stream is then fed to a further separation means (26) where the majority of ethane as well as heavier hydrocarbon components are recovered as liquid product (27) and returned to the LEFC (7) as a liquid reflux stream. The methane-rich overhead vapor stream (28) from the further separation means (26) undergoes indirect heat exchange with the refrigerant fluid for additional cooling in the LNGL exchanger (48).

As in FIGS. 10-12, the methane rich stream that leaves LNGL exchanger as a cooled partially liquefied stream (29) is flashed (e.g., by expansion in an expansion valve) to a lower pressure. The resultant stream (41) is fed into a further separator (50), i.e., a LNGL separator. The methane-rich liquid removed the bottom of the further separator (50) is optionally sent to an LNG storage vessel (46) before being sent to the LNG production unit. The vapor (boil off gas) (51) removed from the top of the further separator (50) is compressed in a BOG compressor (47) and sent to residue gas, e.g., combined with other residue gas from NGL recovery unit.

Further, as in FIGS. 2 and 5, additional reflux streams are provided for the LEFC (7). Prior to expansion of the gaseous overhead stream (4), obtained from cold separator (3) in the turboexpander (5), a portion (30) of the gaseous overhead stream (4) is fed to the subcooler (13), where it undergoes indirect heat exchange with the overhead vapor (12) from LEFC (7). In the subcooler (13), portion (30) is cooled further and partially liquefied, and then expanded and introduced into the top region of the LEFC (7) to provide additional reflux. In addition, a portion of bottoms liquid stream (32) removed from the bottom of the cold separator (3) is delivered to a liquid/liquid heat exchanger (33), where it undergoes indirect heat exchange with the bottom liquid stream (10) removed from the bottom of the LEFC (7). The resultant stream (34) is then fed to an intermediate region of the LEFC (7) as a liquid reflux.

FIG. 14, however, further incorporates a refrigeration loop through the NGL process which results in a reduction in energy consumption. Specifically, a stream of refrigerant fluid (52) from the refrigerant system is fed through the main heat exchanger (2) (e.g., a plate-fin heat exchanger) where it undergoes indirect heat exchange with the liquid product stream (15) from the bottom of the HEFC (9), the further liquid stream (16) from an intermediate point of the HEFC (9), the reboiler stream (18) removed from the bottom region of the HEFC (9), and the overhead vapor product stream (12) removed from the top of the LEFC (7). The refrigerant stream, cooled and partially liquefied, leaves the main heat exchanger as stream (53). Thereafter, the refrigerant stream is introduced into the subcooler (13) where it is further cooled and liquefied. This stream is then flashed across a valve causing the fluid to reach even colder temperatures and is then fed (54) back to the subcooler (13) to provide cooling to the reflux streams of the LEFC (7). The refrigerant stream (55) then returns to the main heat exchanger (2), where it serves as a coolant to the NGL process streams. The refrigerant stream (56) is then returned to the refrigeration system for compression. The incorporation of this refrigeration loop through the NGL process results in a reduction in energy consumption.

Figure 15:
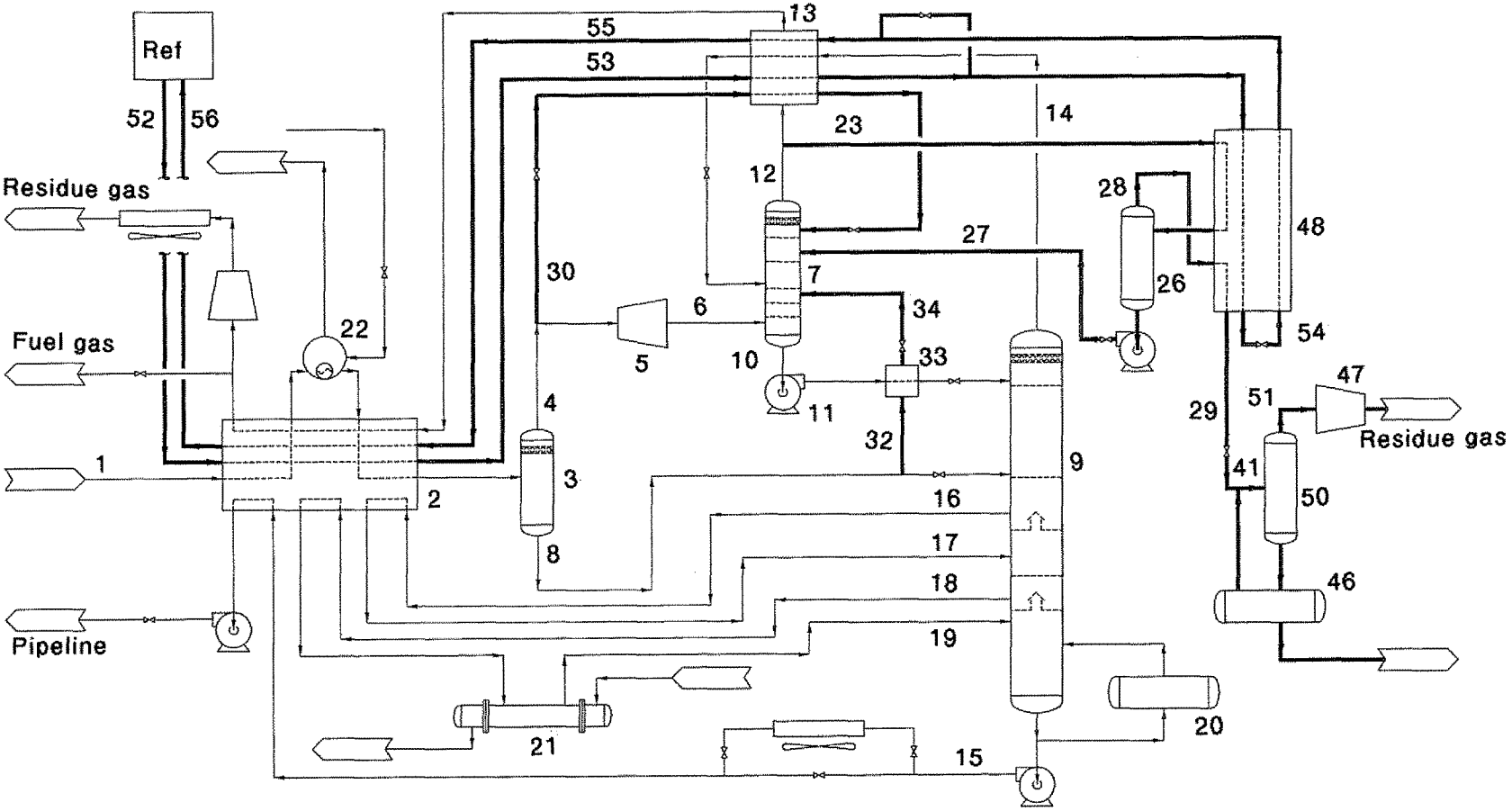

FIG. 15 shows a system that is a modification of the system of FIG. 14 that combines features of the embodiments of FIGS. 6 and 10. Thus, FIG. 15 illustrates an embodiment which is similar to that shown in FIG. 14, but with a modified refrigeration loop. A stream of refrigerant fluid (52) from the refrigerant system is fed through the main heat exchanger (2) where it undergoes indirect heat exchange with the liquid product stream (15) from the bottom of the HEFC (9), the further liquid stream (16) from an intermediate point of the HEFC (9), the reboiler stream (18) removed from the bottom region of the HEFC (9), and the overhead vapor product stream (12) removed from the top of the LEFC (7). The refrigerant stream, cooled and partially liquefied, leaves the main heat exchanger (2) as stream (53). Thereafter, the refrigerant stream is introduced into the subcooler (13) where it is further cooled and liquefied. This stream is then introduced into a heat exchanger (48) for cooling the side stream (23) from the LEFC overhead vapor product stream (12). The refrigerant stream exits heat exchanger (48) and is flashed across a valve, causing the fluid to reach even colder temperatures. The resultant stream (54) is then fed back to the same heat exchanger (48) to provide further cooling. Thereafter, the refrigerant stream passes through the subcooler (13) and exits therefrom as stream (55). Refrigerant stream (55) passes through the main heat exchanger (2), and then flows to the refrigeration system for compression. Here again, the incorporation of a refrigeration loop through the NGL process results in a reduction in energy consumption.

Figure 16:
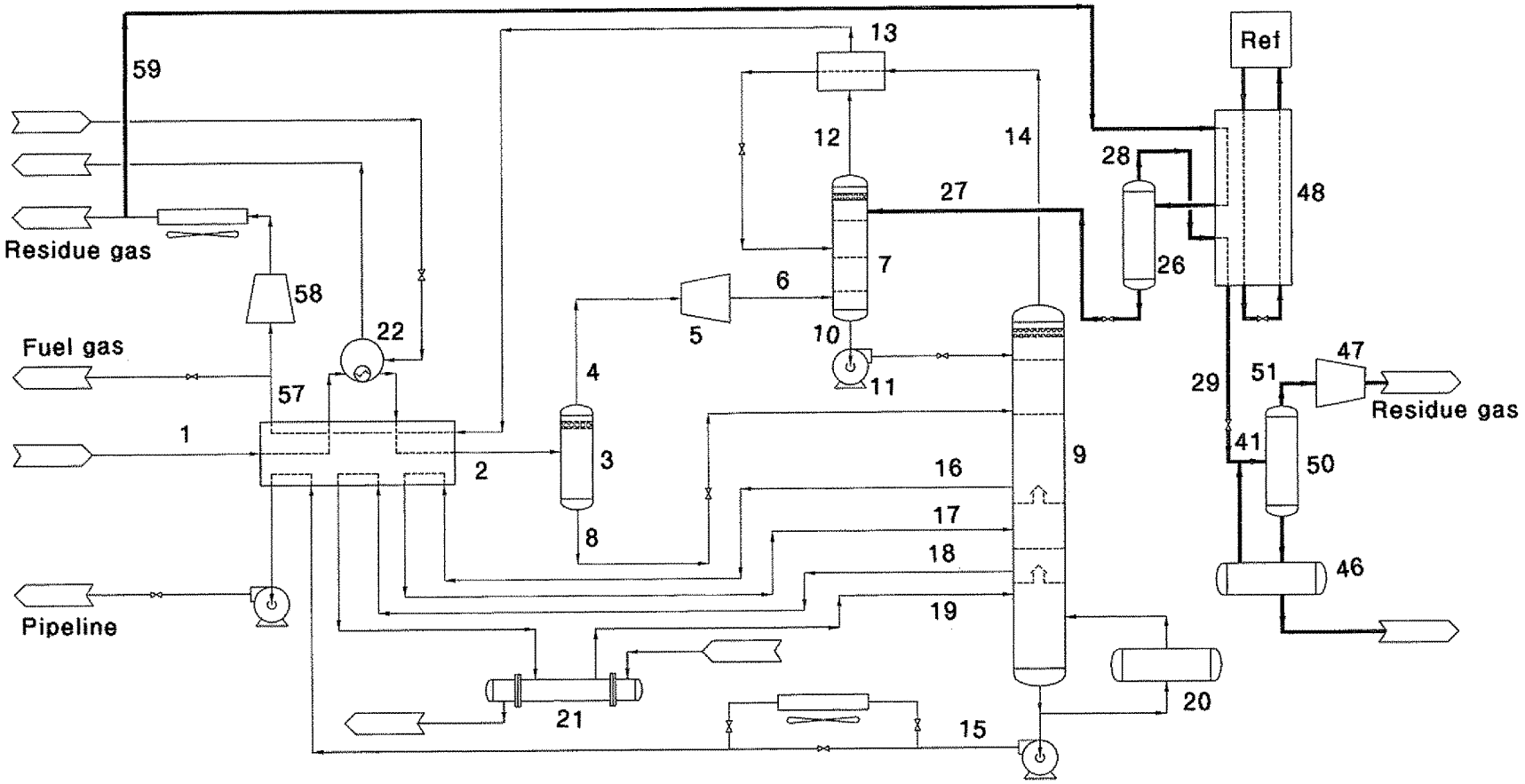

FIG. 16 shows a further embodiment of the invention. In this embodiment, like in the embodiment of FIG. 7, a side stream is not removed from the overhead vapor product (12) of the LEFC before the latter is sent to the subcooler (13). Instead, after the overhead vapor product of the LEFC passes through the subcooler (13), it is sent to the main heat exchanger, and then at least portion thereof is compressed. At least a portion of this compressed residue gas is used as feed for the LNG production unit and to provide a reflux stream for the LEFC. Using the residue gas as a feed to the LNG unit reduces the utility consumption of the refrigeration unit thereby rendering the process more energy efficient when compared to a standalone LNG unit. Also, returning a portion of the cold liquid from the LNG production unit as reflux for the LEFC increases the efficiency and product recovery of the NGL recovery unit.

As shown in FIG. 16, overhead vapor (12) obtained from the top of the LEFC, passes through the subcooler (13) and the main heat exchanger (2). The resultant stream (57) is compressed in compressor (58), and then recycled (59) to a LNGL heat exchanger (48) wherein it is cooled and partially liquefied by heat exchange with refrigerant. The resulting stream is fed to a further separation means such as a reflux separator (26). The majority of ethane and heavier hydrocarbon components are removed as a liquid stream (27) from the bottom of the reflux separator (26) and returned to the LEFC as reflux. The methane-rich vapor stream (28) removed from the top of the reflux separator (26) is sent to the LNGL heat exchanger (48) where it undergoes heat exchange with the refrigerant for additional cooling. The resultant partially liquefied stream (29) exits the LNGL heat exchanger (48) and is flashed (e.g., by expansion in an expansion valve) to a lower pressure, and fed as stream (41) to an LNGL separator (50). A methane-rich liquid is recovered from the LNGL separator (50) and optionally sent to an LNG storage vessel (46). The vapor (boil off gas) (51) from the LNGL separator is compressed in a BOG compressor (47) and sent to residue gas, e.g., combined with other residue gas from NGL recovery unit.

Figure 17:
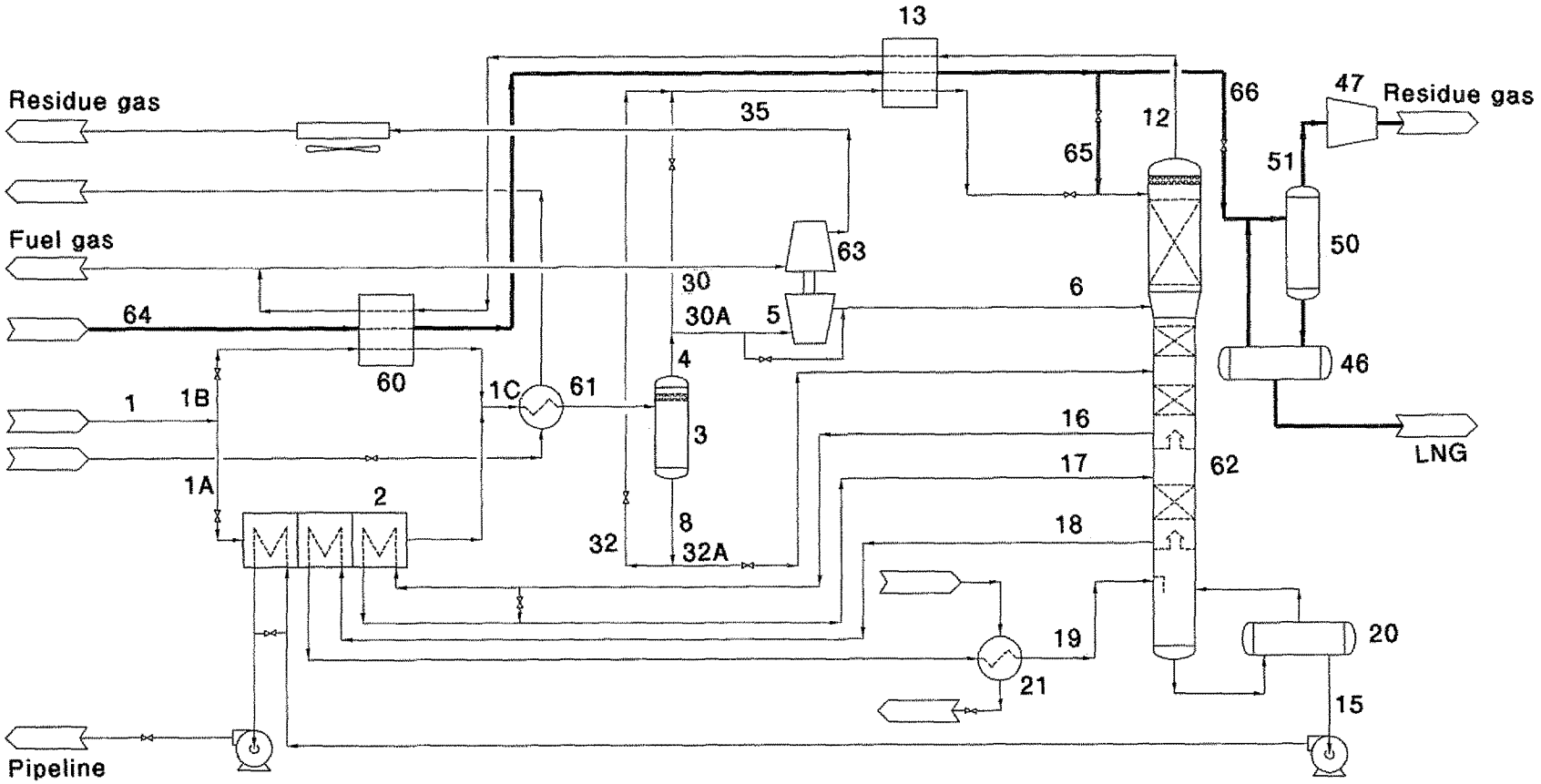

As noted above, FIGS. 17-21 are modifications of the Gas Subcooled Process (GSP). In FIG. 17, gas feed stream (1), containing, for example, helium, nitrogen methane, ethane, ethylene, and C3+ hydrocarbons (e.g., a natural gas feed stream) is introduced into the system at a temperature of, e.g., 4 to 60° C. and a pressure of, e.g., 300 to 1500 psig. The gas feed stream (1) is split into two partial feed streams, first partial feed stream (1A) and second partial feed stream (1B). The first partial feed stream (1A) is cooled and partially condensed by indirect heat exchange in a main heat exchanger (2) against process streams (16, 18, 15), e.g., streams originating from a demethanizer. The second partial feed stream (1B) is cooled and partially condensed by indirect heat exchange in another heat exchanger (60) against a process stream (12), e.g., an overhead stream from a demethanizer (this heat exchanger can share a common core with another heat exchanger, e.g., the subcooler described below). These two partial feed streams are then recombined (1C), optionally further cooled (61) (e.g., by indirect heat exchange against a refrigerant), and then introduced into a gas/liquid cold separator (3).

The gaseous overhead stream (4) removed from the top of the cold separator (3) is split into two potions (30, 30A). Similarly, the bottoms liquid stream (8) from the cold separator (3) is also split into two potions (32, 32A).

A first portion of the gaseous overhead stream (30A) is expanded, for example, in a turboexpander (5), which can be optionally coupled to a compressor (63), and then introduced as stream (6) into an intermediate region of a demethanizer column (62) at a first intermediate point. A first portion of the bottoms liquid stream (32A) from the cold separator (3) is also introduced and expanded into an intermediate region of the demethanizer column (62) at a second intermediate point which is below the first intermediate point, i.e., the point of introduction of the first portion of the gaseous overhead stream (6). The second portion of the gaseous overhead stream (30) is combined with the second portion of the bottoms liquid stream (32) to form a combined cold separator stream (35), which is then cooled in a subcooler (13) by indirect heat exchange with an overhead vapor stream (12) from the top of the demethanizer (62). Stream (35) is then introduced and expanded into the upper region of the demethanizer. The demethanizer column (62) typically operates at a temperature of −70 to −115° C. and a pressure of 100 to 500 psig.

A liquid product stream is removed from the bottom of the demethanizer (62) and sent to a product surge vessel (20). Liquid from the product surge vessel (20) can be recycled to the bottom region of the demethanizer (62). The liquid product stream (15) from the product surge vessel (20) is heated by heat exchange, for example, by passage through the main heat exchanger (2) where it can undergo indirect heat exchange with the first partial feed stream (1A). In addition, a further liquid stream (16) is removed from a third intermediate point of the demethanizer, i.e., below the second intermediate point. This further liquid stream (16) is heated by indirect heat exchange, e.g., in the main heat exchanger (2) against first partial feed stream (1A), and then reintroduced (17) into the demethanizer at a fourth intermediate point i.e., below the third intermediate point. An additional liquid stream (18) is removed from the lower region of the demethanizer, i.e., below the fourth intermediate point. This additional liquid stream (18) is heated by indirect heat exchange, e.g., in the main heat exchanger (2), acting here as a reboiler, against first partial feed stream (1A), and then reintroduced (19) into the lower region of the demethanizer. Further, as noted above, an overhead vapor stream (12) is removed from the top of the demethanizer (62).

A high pressure (e.g., 300 to 1500 psig) residue gas stream (64) is introduced into the system and cooled by indirect heat exchange in heat exchanger (60) against a process stream (12), e.g., an overhead stream from the demethanizer, further cooled in the subcooler (13), and optionally further cooled in a further heat exchanger (e.g., an LNGL exchanger). A portion (65) of this cooled high pressure reside gas stream is expanded (e.g., via an expansion valve) to the operating pressure of the demethanizer (62), combined with the combined cold separator stream (35) and then introduced into the upper region of the demethanizer (62) as the top feed thereof. The remaining portion of the cooled high pressure residue gas stream is expanded (e.g., via an expansion valve) to a pressure below the operating pressure of the demethanizer and fed to a further separation means, e.g., an LNGL separator (50). A methane rich liquid stream is removed from the further separation means (50), optionally stored in an LNG storage vessel (46), before being sent to the LNG production unit. The overhead vapor (boil off gas) (51) from the further separation means is compressed in a BOG compressor (47) and sent to residue gas, e.g., combined with other residue gas from NGL recovery unit.

Figure 18:
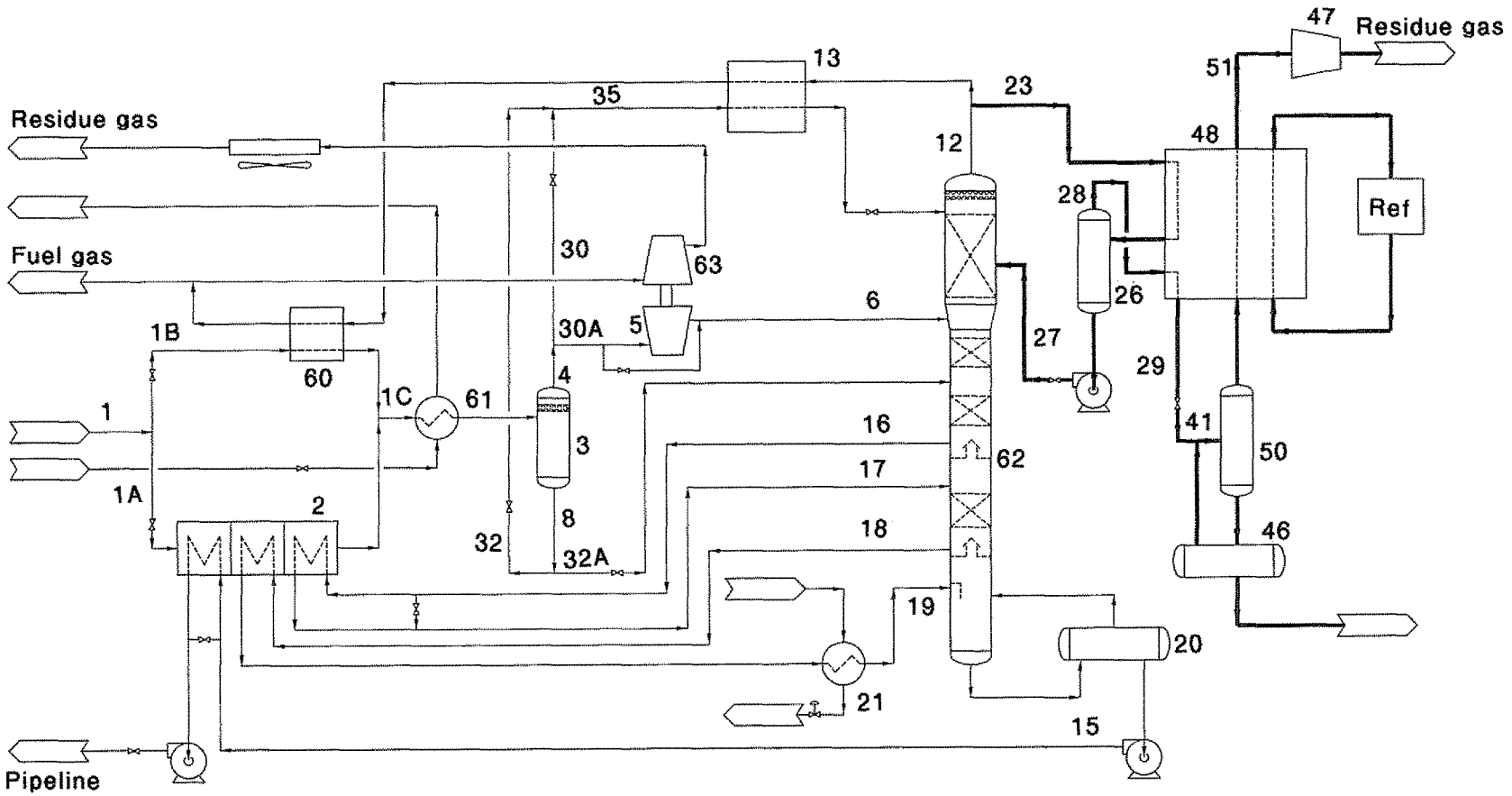

The embodiment of FIG. 18 involves the use of a side stream from the overhead vapor stream of the demethanizer, rather than the high pressure residue gas stream of the embodiment of FIG. 17. Thus, in FIG. 18, a portion of the cooled overhead vapor (12) from the demethanizer (62) is used as feed for the LNG production unit.

Before being cooled in the subcooler (13), a side stream (23) is separated from the overhead vapor stream (12) of the demethanizer and is partially liquefied by heat exchange in an LNGL heat exchanger (48) against a refrigerant. The resulting stream is fed to a further separation means such as a reflux separator (26). In the reflux separator the majority of ethane and higher hydrocarbon components are removed as a bottom liquid stream (27) and returned to the demethanizer as reflux. A methane-rich vapor stream (28) is removed from the top of the reflux separator (26), cooled by heat exchange against the refrigerant in the LNGL heat exchanger (48) and at least partially liquefied therein. The at least partially liquefied stream (29) exits the LNGL exchanger, is flashed-expanded via an expansion valve to a lower pressure and fed into a further separation means (50) (e.g., an LNGL separator). A methane-rich liquid is recovered from the bottom of the further separation means (50) and optionally stored in the LNG storage vessel (46) before being sent as feed to the LNG production unit. A vapor stream (51) (boil off gas) is removed from the top of the further separation means (50) and used in the LNGL heat exchanger (48) to provide additional cooling for the side stream (23) from the demethanizer overhead vapor stream (12) and the methane-rich vapor stream (28) removed from the top of the reflux separator (26). The vapor stream (51) from the top of the further separation means is then compressed in a BOG compressor (47) and combined with other residue gas from the GSP unit.

Figure 19:
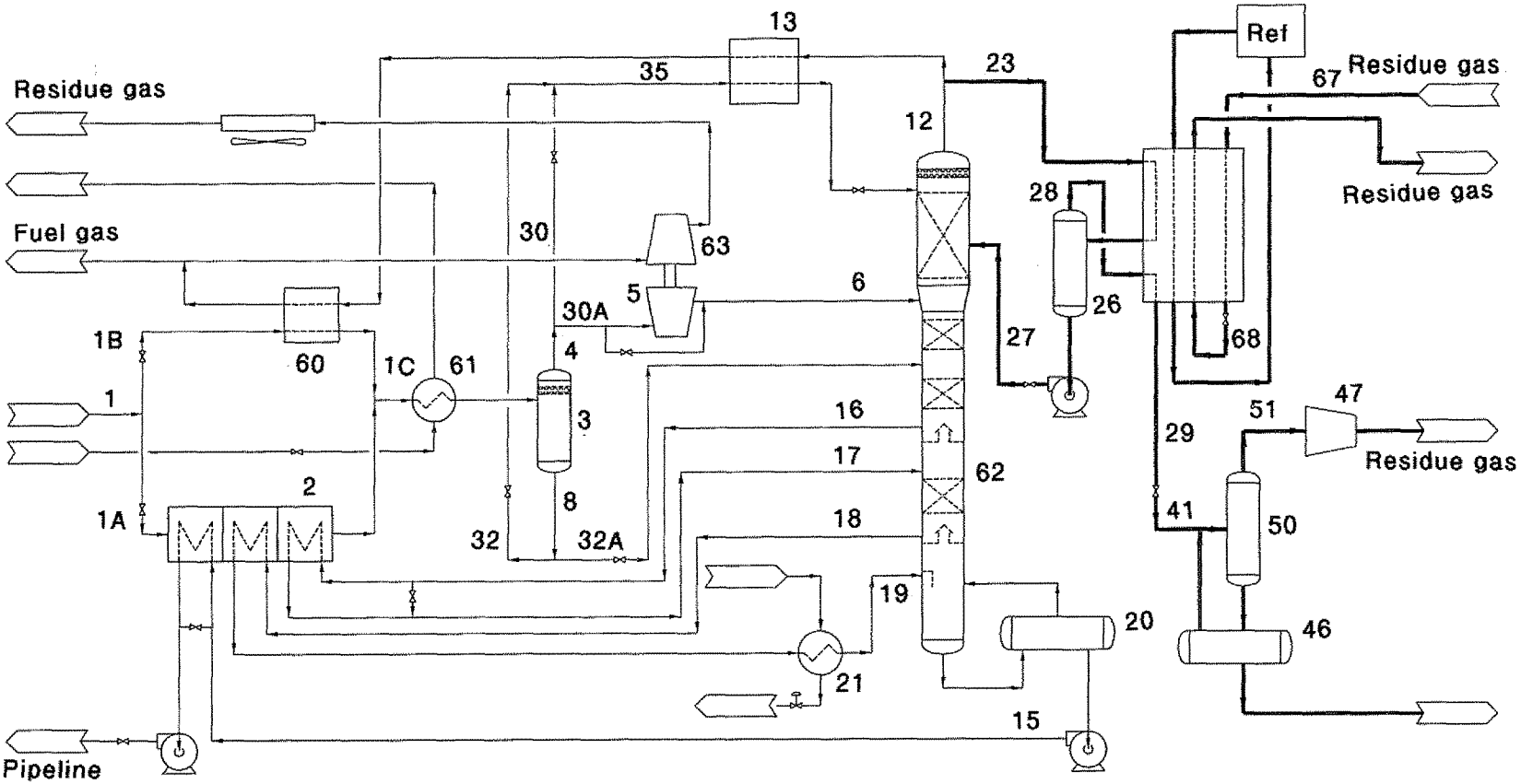

The embodiment of FIG. 19 is similar to the embodiment of FIG. 18, except that additional cooling in the LNGL heat exchanger (48) is achieved by the initially cooling and liquefying a residue gas stream which is then expanded and sent back to the LNGL heat exchanger (48) as a cooling medium.

Thus, in FIG. 19 the side stream (23) from the overhead vapor stream (12) of the demethanizer is partially liquefied by heat exchange in an LNGL heat exchanger (48) against a refrigerant. The resulting stream is fed to a further separation means such as a reflux separator (26). The bottom liquid stream (27) (mostly ethane and higher hydrocarbon components) is returned to the demethanizer as reflux. The methane-rich vapor stream (28) is cooled by heat exchange against the refrigerant in the LNGL heat exchanger (48) and at least partially liquefied therein. The at least partially liquefied stream (29) exits the LNGL exchanger (48), is flashed-expanded via an expansion valve to a lower pressure and fed (41) into a further separation means (50) (e.g., an LNGL separator). A methane-rich liquid is recovered from the bottom of the further separation means (50) and optionally stored in the LNG storage vessel (46) before being sent as feed to the LNG production unit. A vapor stream (51) (boil off gas) is removed from the top of the further separation means (50), compressed in a BOG compressor (47), and combined with other residue gas from the GSP unit.

A residue gas (67) is introduced into the LNGL exchanger (48), where it is cooled and liquefied. The residue gas exits the LNGL exchanger and is flashed across a valve, causing the fluid to reach even colder temperatures. The resultant stream (68) is then fed back to the LNGL exchanger (48) to provide additional cooling for the side stream (23) from the demethanizer overhead vapor stream (12) and the methane-rich vapor stream (28) removed from the top of the reflux separator (26).

Figure 20:
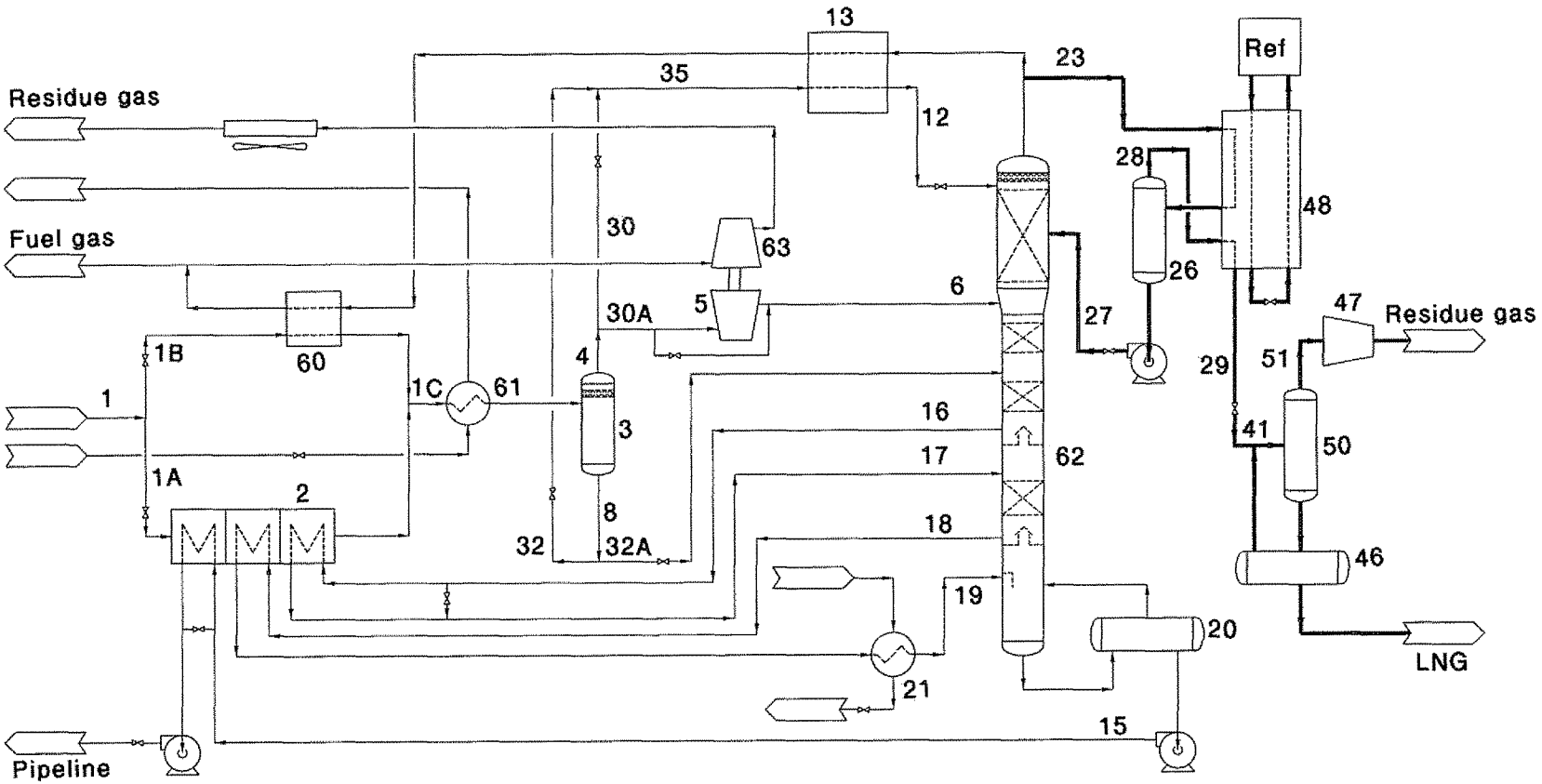

FIG. 20 illustrates an embodiment similar to that of FIGS. 18 and 19. However, in the embodiment of FIG. 20 no additional cooling, such as from residue gas (67) or the vapor stream from the top of the further separation means (50), is used in the LNGL heat exchanger (48).

Figure 21:
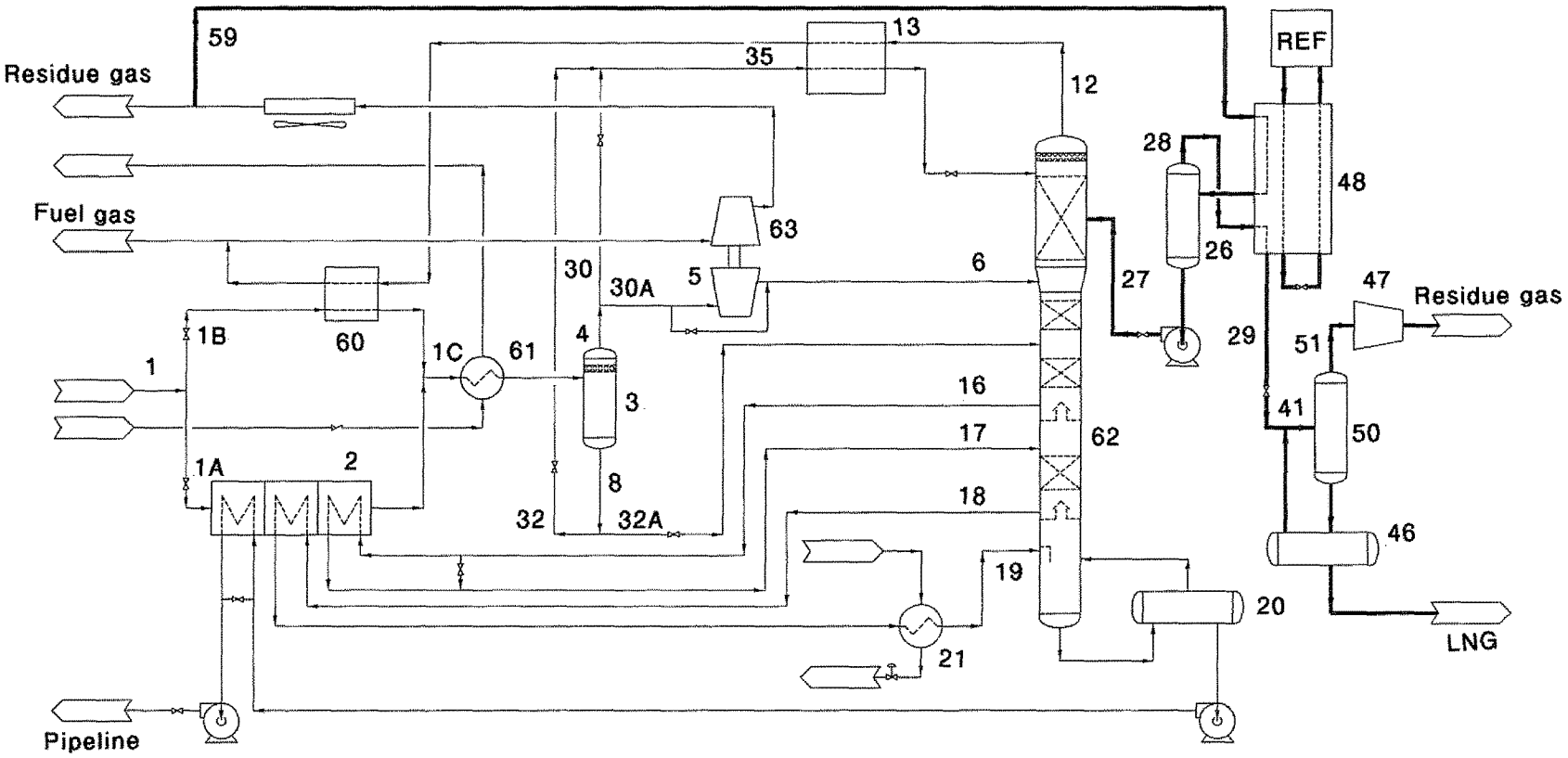

Like FIGS. 18-20, the embodiment of FIG. 21 involves the use of a side stream originating from the overhead vapor stream of the demethanizer. However, in this case, the side stream is separated from the overhead vapor stream of the demethanizer after the latter has undergone further cooling (i.e., in subcooler (13) and heat exchanger (60)). Also, the side stream is compressed before it is introduced into the LNGL exchanger (48).

As shown in FIG. 21, the overhead vapor stream (12) from the top of the demethanizer passes through the subcooler (13) and through the heat exchanger (60) that cools the second partial feed stream (1B). Thereafter, at least a portion of the overhead vapor stream is compressed in compressor (63) (which is coupled to expander (5)) to form a residue gas. Then, a portion (59) of this residue gas is cooled and partially liquefied by heat exchange in an LNGL heat exchanger (48) against a refrigerant. The resulting stream is fed to a further separation means such as a reflux separator (26).

In the reflux separator (26) the majority of ethane and higher hydrocarbon components are removed as a bottom liquid stream (27) and returned to the demethanizer (62) as reflux. A methane-rich vapor stream (28) is removed from the top of the reflux separator (26), cooled by heat exchange against the refrigerant in the LNGL heat exchanger (48) and at least partially liquefied therein. The at least partially liquefied stream (29) exits the LNGL exchanger, is flashed-expanded via an expansion valve to a lower pressure and fed (41) into a further separation means (50) (e.g., an LNGL separator). A methane-rich rich liquid is recovered from the bottom of the further separation means (50) and optionally stored in the LNG storage vessel (46) before being sent as feed to the LNG production unit. A vapor stream (boil off gas) (51) is removed from the top of the further separation means (50), compressed in a BOG compressor (47), and combined with other residue gas from the GSP unit.

Figure 22:
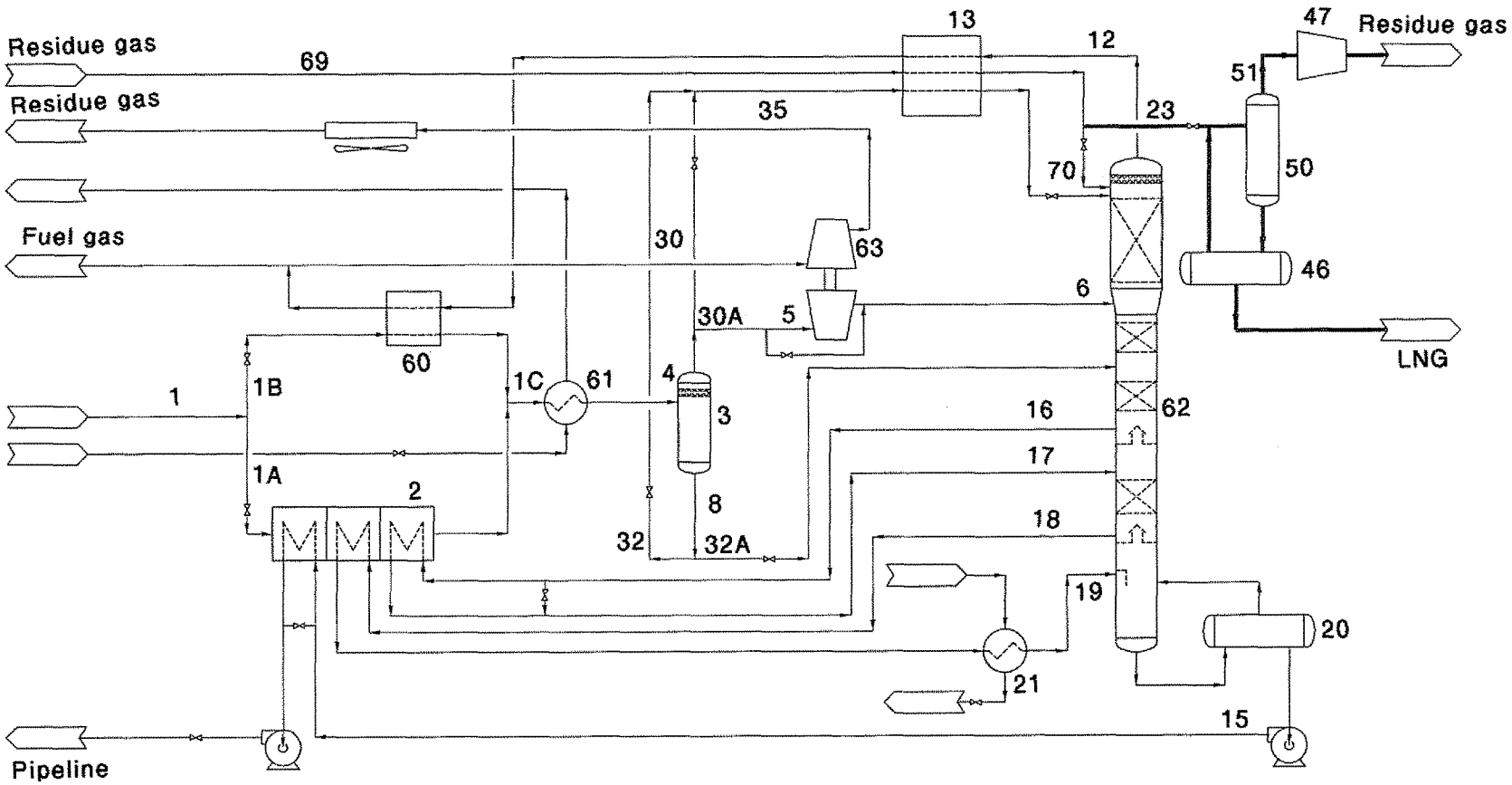

As noted above, FIGS. 22-26 are modifications of the Recycle Split Vapor (RSV) Process. As shown in FIG. 22, gas feed stream (1), containing, for example, helium, nitrogen methane, ethane, ethylene, and C3+ hydrocarbons (e.g., a natural gas feed stream) is introduced into the system at a temperature of, e.g., 4 to 60° C. and a pressure of, e.g., 300 to 1500 psig. The gas feed stream (1) is split into two partial feed streams, a first partial feed stream (1A) and a second partial feed stream (1B). The first partial feed stream (1A) is cooled and partially condensed by indirect heat exchange in a main heat exchanger (2) against process streams (16, 18, 15). The second partial feed stream (1B) is cooled and partially condensed by indirect heat exchange in another heat exchanger (60) against a process stream (12), e.g., an overhead stream from a demethanizer (62) (this heat exchanger can share a common core with another heat exchanger, e.g., the subcooler described below). These two partial feed streams are then recombined (1C), optionally further cooled (61) (e.g., by indirect heat exchange against a refrigerant), and then introduced into a gas/liquid cold separator (3).

The gaseous overhead stream (4) removed from the top of the cold separator (3) is split into two potions (30, 30A). Similarly, the liquid bottom stream (8) removed from the cold separator (3) is also split into two potions (32, 32A).

A first portion of the gaseous overhead stream (30A) is expanded, for example, in a turboexpander (5), which can be optionally coupled to a compressor (63) and then introduced as stream (6) into an intermediate region of a demethanizer column (62) at a first intermediate point. A first portion of the bottoms liquid stream (32A) from the cold separator (3) is also expanded and introduced into an intermediate region of the demethanizer column (62) at a second intermediate point which is below the first intermediate point, i.e., the point of introduction of the first portion of the gaseous overhead stream (6). The second portion of the gaseous overhead stream (30) is combined with the second portion of the bottoms liquid stream (32) to form a combined cold separator stream (35), which is then cooled in a subcooler (13) by indirect heat exchange with an overhead vapor stream (12) from the top of the demethanizer (62), and expanded and introduced into the upper region of the demethanizer as a top feed thereof. The demethanizer column (62) typically operates at a temperature of −70 to −115° C. and a pressure of 100 to 500 psig.

A liquid product stream is removed from the bottom of the demethanizer (62) and sent to a product surge vessel (20). Liquid from the product surge vessel can be recycled to the bottom region of the demethanizer (62). The liquid product stream (15) from the product surge vessel (2) is heated by heat exchange, for example, by passage through the main heat exchanger (2) where it can undergo indirect heat exchange with the first partial feed stream (1A). In addition, a further liquid stream (16) is removed from a third intermediate point of the demethanizer, i.e., below the second intermediate point. This further liquid stream (16) is heated by indirect heat exchange, e.g., in the main heat exchanger (2) against first partial feed stream (1A), and then reintroduced (17) into the demethanizer at a fourth intermediate point i.e., below the third intermediate point. An additional liquid stream (18) is removed from the lower region of the demethanizer, i.e., below the fourth intermediate point. This additional liquid stream (18) is heated by indirect heat exchange, e.g., in the main heat exchanger (2) (in this case acting as a reboiler) against first partial feed stream (1A), and then reintroduced (19) into the lower region of the demethanizer. Further, as noted above, an overhead vapor stream (12) is removed from the top of the demethanizer (62).

A high pressure (e.g., 300 to 1500 psig) residue gas stream (69) is introduced into the system and cooled by indirect heat exchange in the subcooler (13). At least a portion of this residue gas stream (69) is then expanded (e.g., via an expansion valve) to the operating pressure of the demethanizer and introduced (70) into the upper region of the demethanizer as another top feed thereof.

Another portion (23) of the residue gas stream (69) is expanded (e.g., via an expansion valve) to a pressure below the operating pressure of the demethanizer and fed to a further separation means (50), e.g., an LNGL separator. A methane rich liquid stream is removed from the further separation means (50) and optionally stored in an LNG storage vessel (46), before being sent to the LNG production unit. The overhead vapor stream (boil off gas) (51) removed from the further separation means (50) is compressed in a BOG compressor (47) and combined with other residue gas from the RSV unit.

Figure 23:
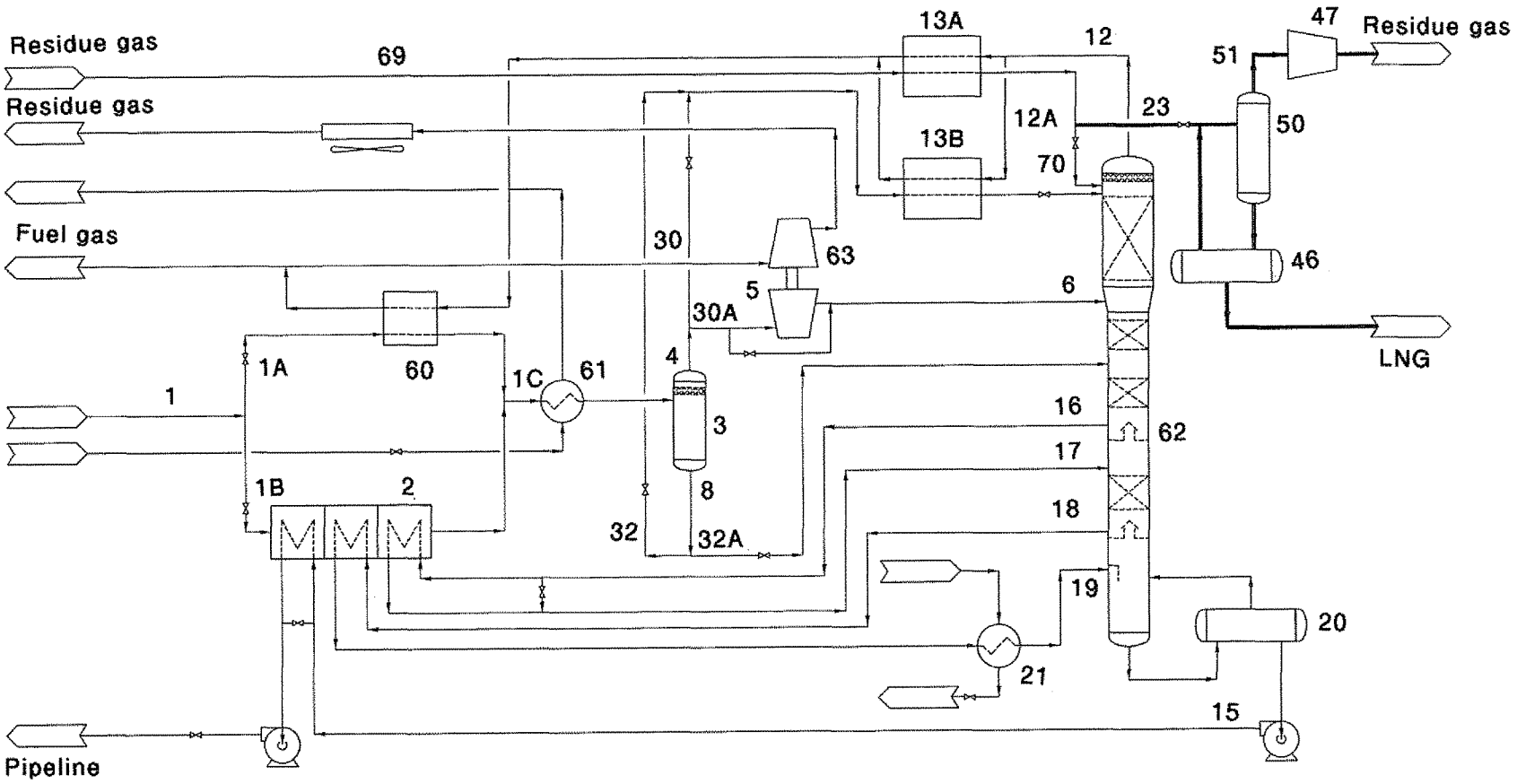

FIG. 23 shows an embodiment which is the same as the embodiment of FIG. 22, except that the subcooler (13) is split into two separate exchangers (13A) and (13B). Thus, in subcooler (13A) the residue gas stream (69) is cooled by heat exchange with a portion of the demethanizer overhead stream (12), and in subcooler (13B) the combined cold separator stream (35) is cooled by heat exchange with another portion (12A) of the demethanizer overhead stream.

Figure 24:
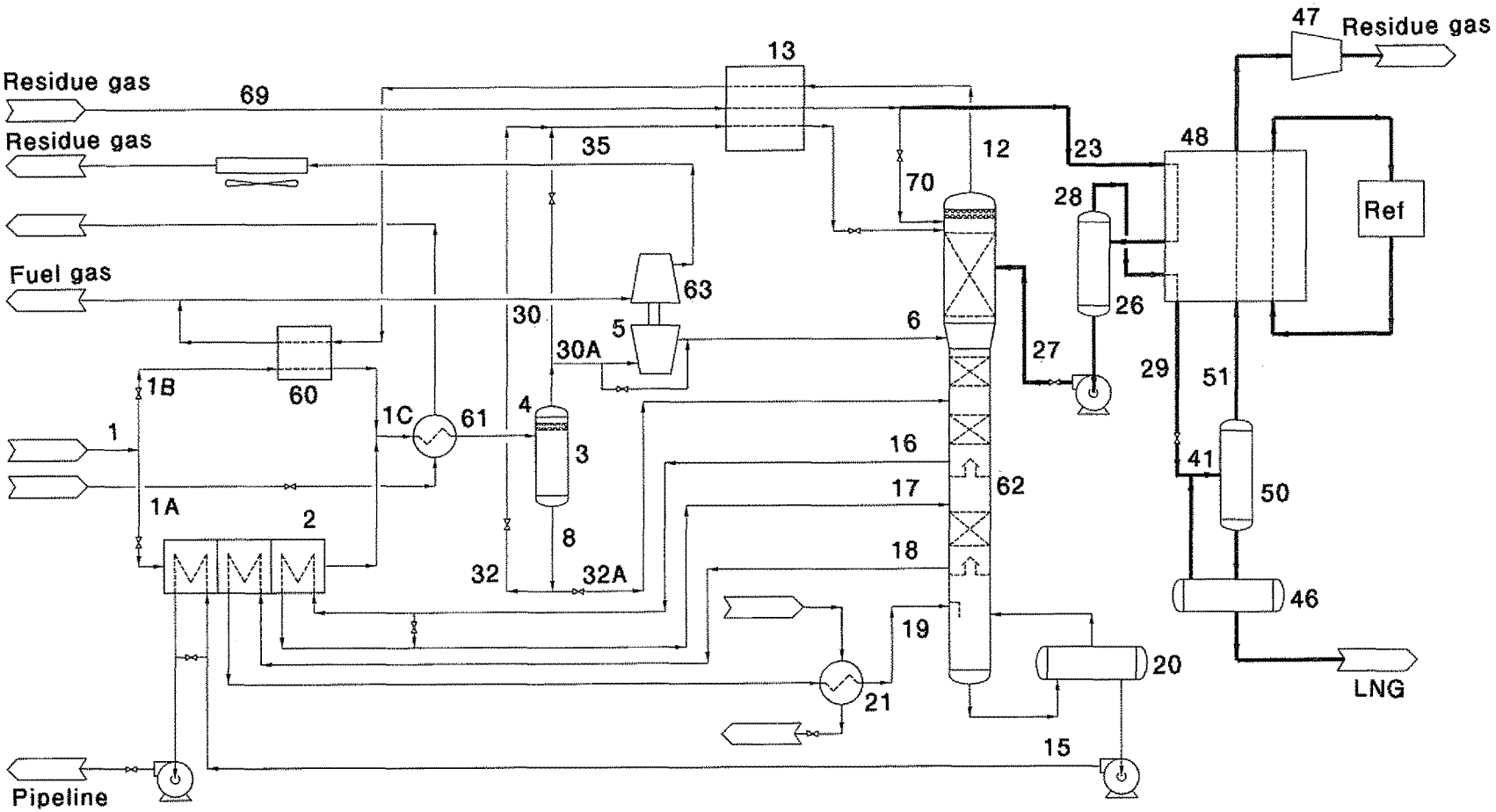

The embodiment of FIG. 24 is similar to the embodiment of FIG. 23, except that the side stream (23) from the residue gas stream (69) is treated in a manner similar to the treatment of side stream (23) in FIG. 18. Thus, after residue gas stream (69) is cooled in the subcooler (13), a side stream (23) is separated therefrom and is partially liquefied by heat exchange in an LNGL heat exchanger (48) against a refrigerant. The resulting stream is fed to a further separation means such as a reflux separator (26). In the reflux separator the majority of ethane and higher hydrocarbon components are removed as a bottom liquid stream (27) and returned to the demethanizer as reflux. A methane-rich vapor stream (28) is removed from the top of the reflux separator (26), cooled by heat exchange against the refrigerant in the LNGL heat exchanger (48) and at least partially liquefied therein. The at least partially liquefied stream (29) exits the LNGL exchanger, is flashed-expanded via an expansion valve to a lower pressure and fed into a further separation means (50) (e.g., an LNGL separator). A methane-rich liquid is recovered from the bottom of the further separation means (50) and optionally stored in the LNG storage vessel (46) before being sent as feed to the LNG production unit. A vapor stream (51) (boil off gas) is removed from the top of the further separation means (50) and used in the LNGL heat exchanger (48) to provide additional cooling for the side stream (23) from the demethanizer overhead vapor stream (12) and the methane-rich vapor stream (28) removed from the top of the reflux separator (26). The vapor stream (51) from the top of the further separation means is then compressed in a BOG compressor (47) and combined with other residue gas from the RSV unit.

Figure 25:
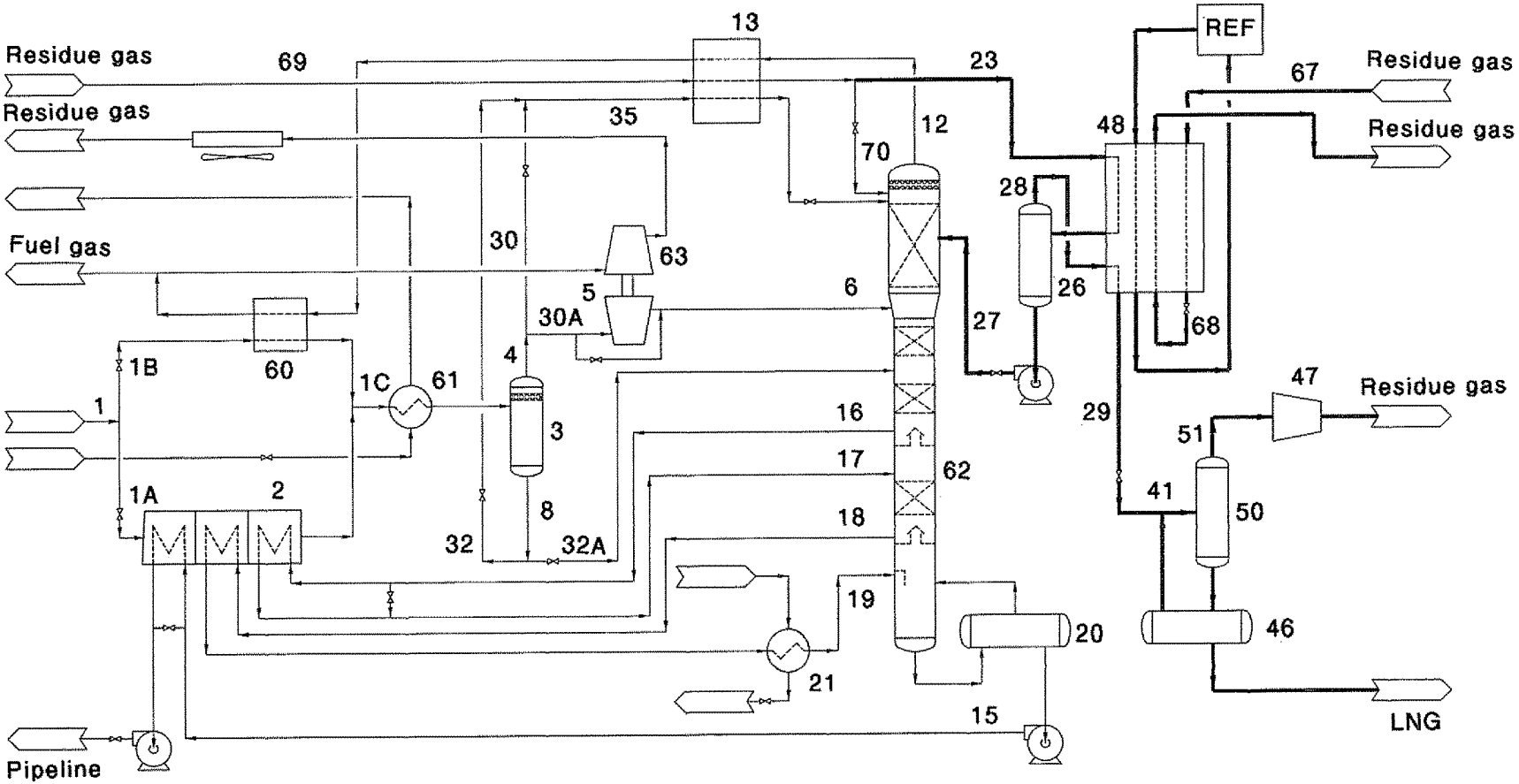

The embodiment of FIG. 25 treats the high pressure residue gas stream, which is cooled by indirect heat exchange in the subcooler, in a manner similar to the way that the side stream from the overhead vapor stream of the demethanizer is treated in FIG. 19. As shown in FIG. 25, the high pressure residue gas stream (69) is cooled by indirect heat exchange in the subcooler (13), and then divided into a first portion (70) and a second portion (23). The first portion (70) of the residue gas stream is expanded (e.g., via an expansion valve) to the operating pressure of the demethanizer and introduced into the upper region of the demethanizer as a top feed thereof. The second portion (23) of the residue gas stream is cooled and partially liquefied by heat exchange in an LNGL heat exchanger (48) against a refrigerant. The resulting stream is fed to a further separation means such as a reflux separator (26).

In the reflux separator, the majority of ethane and higher hydrocarbon components are removed as a bottom liquid stream (27) and returned to the demethanizer as reflux. A methane-rich vapor stream (28) is removed from the top of the reflux separator (26), cooled by heat exchange against the refrigerant in the LNGL heat exchanger (48) and at least partially liquefied therein. The at least partially liquefied stream (29) exits the LNGL exchanger, is flashed-expanded via an expansion valve to a lower pressure and fed (41) into a further separation means (50) (e.g., an LNGL separator). A methane-rich liquid is recovered from the bottom of the further separation means and optionally stored in the LNG storage vessel (46) before being sent as feed to the LNG production unit. A vapor stream (boil off gas) (51) is removed from the top of the further separation means, compressed in a BOG compressor (47) and combined with other residue gas from the RSV unit.

A residue gas (67) is introduced into the LNGL exchanger (48), where it is cooled and liquefied. The residue gas exits the LNGL exchanger (48) and is flashed across a valve, causing the fluid to reach even colder temperatures. The resultant stream (68) is then fed back to the LNGL exchanger to provide additional cooling for the second portion of the residue gas stream (23) and the methane-rich vapor stream (28) removed from the top of the reflux separator (26).

Figure 26:
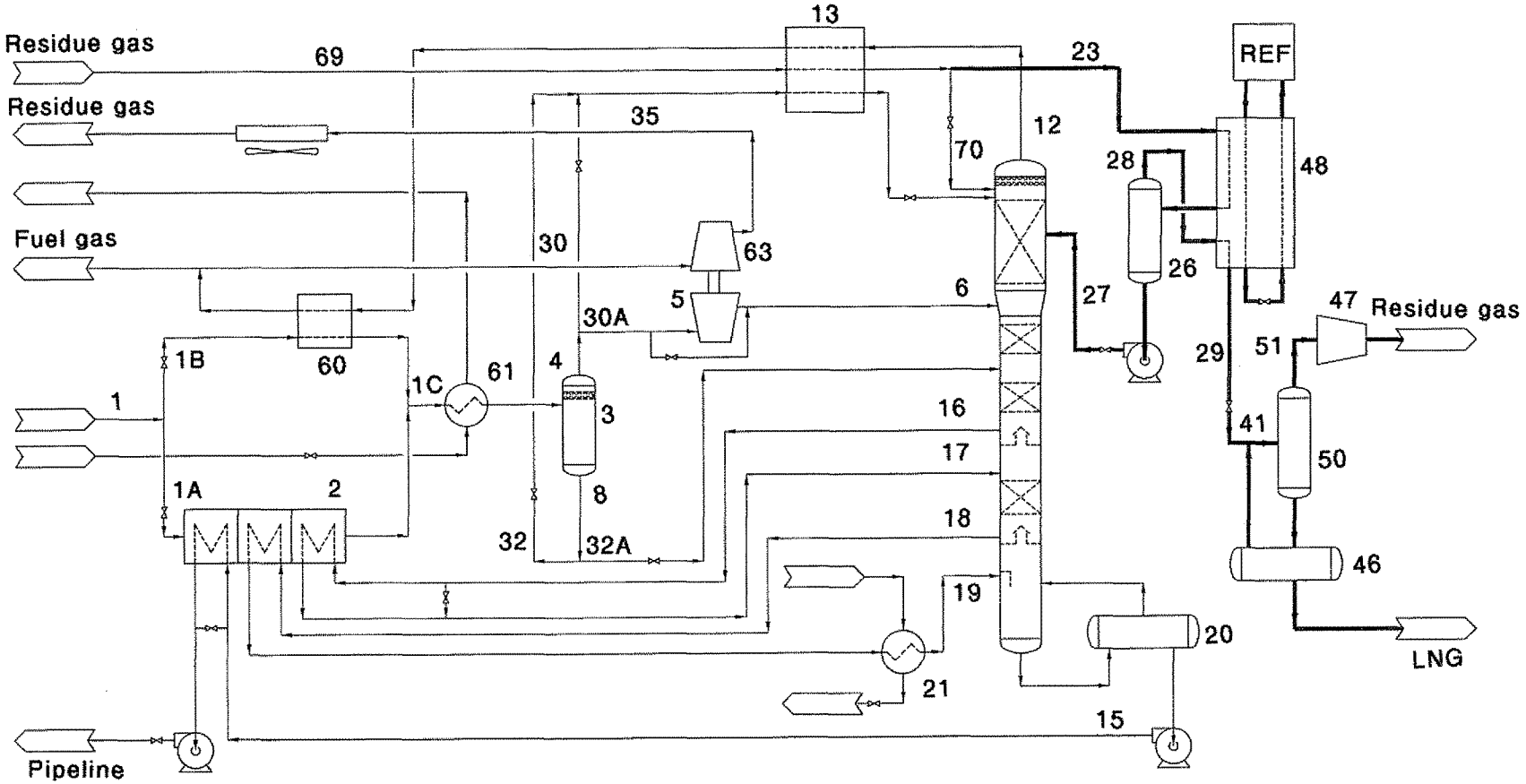

FIG. 26 illustrates an embodiment similar to that of FIGS. 24 and 25. However, in the embodiment of FIG. 26 no additional cooling is used in the LNGL heat exchanger (48). Compare FIG. 20.

Figure 27:
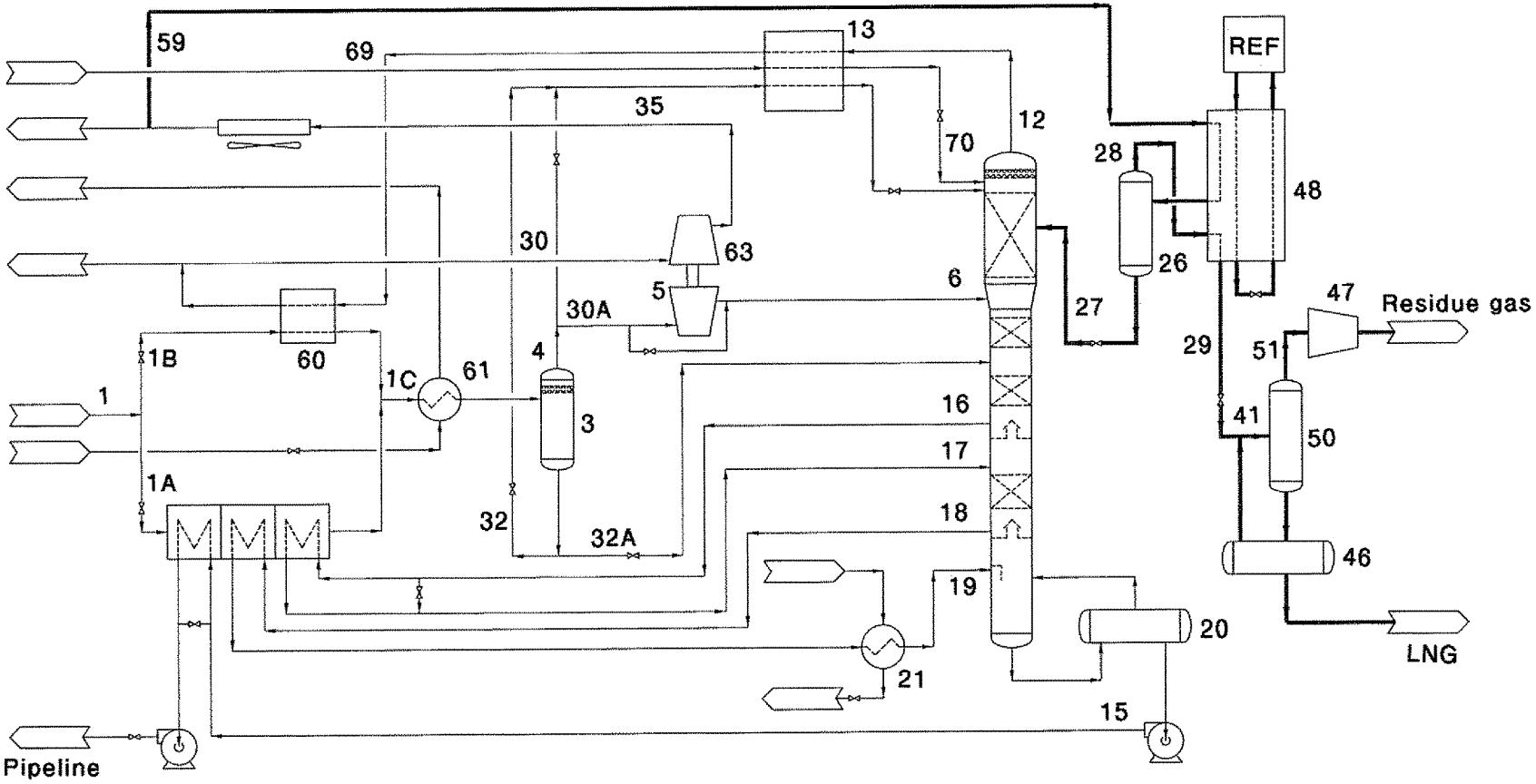

The embodiment of FIG. 27 is similar to the embodiments of FIGS. 23-25, except that the residue gas that is cooled in the LNGL heat exchanger originates from the overhead vapor stream of the demethanizer. See FIG. 21.

As shown in FIG. 27, a high pressure residue gas stream (69) is cooled by indirect heat exchange in the subcooler (13), and then expanded (e.g., via an expansion valve) to the operating pressure of the demethanizer and introduced into the upper region of the demethanizer as a top feed (70) thereof. Thus, unlike the embodiments of FIGS. 24-26, the high pressure residue gas stream that exits the subcooler is not divided into a first portion and a second portion.

As shown in FIG. 27, the overhead vapor stream 12 from the top of the demethanizer (62) passes through the subcooler (13) and the heat exchanger (60) that cools the second partial feed stream (1B). Thereafter, at least a portion of the overhead vapor stream is compressed in compressor (63) (which is shown as being coupled to expander (5)) to form a residue gas. Then, a portion of this residue gas (59) is cooled and partially liquefied by heat exchange in an LNGL heat exchanger (48) against a refrigerant. The resulting stream is fed to a further separation means such as a reflux separator (26).

In the reflux separator (26) the majority of ethane and higher hydrocarbon components are removed as a bottom liquid stream (27) and returned to the demethanizer as reflux. A methane-rich vapor stream (28) is removed from the top of the reflux separator (26), cooled by heat exchange against the refrigerant in the LNGL heat exchanger (48) and at least partially liquefied therein. The at least partially liquefied stream (29) exits the LNGL exchanger (48), is flashed-expanded via an expansion valve to a lower pressure and fed (41) into a further separation means (50) (e.g., an LNGL separator). A methane-rich liquid is recovered from the bottom of the further separation means and optionally stored in the LNG storage vessel (46) before being sent as feed to the LNG production unit. A vapor stream (boil off gas) (51) is removed from the top of the further separation means from the top of the further separation means, compressed in a BOG compressor (47) and combined with other residue gas from the RSV unit.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding examples can be repeated with similar success by substituting the generically or specifically described reactants and/or operating conditions of this invention for those used in the preceding examples.

The entire disclosure[s] of all applications, patents and publications, cited herein and of priority U.S. provisional Application No. 61/746,727, filed Dec. 28, 2012 are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for integrated liquefaction of natural gas and recovery of natural gas liquids, said process comprising:

cooling a feed stream containing light hydrocarbons in one or more heat exchangers, wherein said feed stream is cooled and partially condensed by indirect heat exchange;

introducing the partially condensed feed stream into a gas/liquid cold separator producing an overhead gaseous stream and bottoms liquid stream which are to be introduced into a fractionation system, said fractionation system comprising a light ends fractionation column and a heavy ends fractionation column;

expanding at least a portion of the overhead gaseous stream from the gas/liquid cold separator and introducing said expanded overhead gaseous stream into a lower region of said light ends fractionation column;

introducing at least a portion of the bottoms liquid stream from gas/liquid cold separator into said heavy ends fractionation column at an intermediate point thereof;

removing a first liquid product stream from the bottom of said heavy ends fractionation column;

removing a overhead gaseous stream from the top of said light ends fractionation column, and said process further comprising:

(i) subjecting a first portion of the light ends fractionation column overhead gaseous stream to indirect heat exchange with an overhead gaseous stream removed from the top of said heavy ends fractionation column, whereby said overhead gaseous stream from the top of said heavy ends fractionation column is cooled and partially condensed, and introducing the cooled and partially condensed overhead gaseous stream from the top of said heavy ends fractionation column into the light ends fractionation column;

(ii) removing a second portion of the overhead gaseous stream from said light ends fractionation column as a side stream, and subjecting said side stream to indirect heat exchange for further cooling, partially liquefying said side stream via indirect heat exchange, wherein said side stream of the overhead gaseous stream from the light ends fractionation column is split off from the overhead gaseous stream prior to the indirect heat exchange between said first portion of the light ends fractionation column overhead gaseous stream and the overhead gaseous stream removed from the top of said heavy ends fractionation column;

(iii) introducing the partially liquefied side stream into a further separation means, recovering a liquid stream from said further separation means and introducing the recovered liquid stream into the light ends fractionation column as a liquid reflux stream and/or the heavy ends fractionation column as a liquid reflux stream, and (iv) recovering an overhead vapor stream from said further separation means, subjecting said overhead vapor stream from said further separation means to indirect heat exchange for additional cooling and partial condensation, and feeding the resultant vapor and condensate to an LNG separator wherein a final LNG liquid product is produced.

2. A process according to claim 1, further comprising cooling said feed stream containing light hydrocarbons in a main heat exchanger wherein the feed stream partially condensed by indirect heat exchange;

introducing said first liquid product stream from said heavy ends fractionation column into said main heat exchanger for indirect heat exchanger with said feed stream;

wherein after subjecting said first portion of said overhead gaseous stream from the top of said light ends fractionation column to indirect heat with said overhead gaseous stream removed from the top of said heavy ends fractionation column, removing said first portion of the overhead gaseous stream from said light ends fractionation column as residue gas;

wherein, before said side stream is subjected to said indirect heat exchange for further cooling, said side stream is partially liquefying across a flow-control valve.

3. A process according to claim 1, further comprising:

introducing said feed stream containing light hydrocarbons into a main heat exchanger wherein said feed stream is cooled and partially condensed by indirect heat exchange;

introducing the liquid product stream from the bottom of said heavy ends fractionation column into said main heat exchanger where it undergoes indirect heat exchanger with said feed stream; and wherein the liquid stream recovered from said further separation means is introduced into said light ends fractionation column as reflux.

4. A process according to claim 2, wherein said liquid stream recovered from said further separation means is introduced into said light ends fractionation column as said liquid reflux stream.

5. A process according to claim 1, wherein said liquid stream recovered from the further separation means is introduced into the heavy ends fractionation column as liquid reflux.

6. A process according to claim 1, wherein a portion of said bottoms liquid stream from the gas/liquid cold separator is delivered to a liquid/liquid heat exchanger for indirect heat exchange with said bottom liquid stream removed from the light ends fractionation column, and then said portion of bottoms liquid stream from the gas/liquid cold separator is fed to an intermediate region of the light ends fractionation column as a liquid reflux.

7. A process according to claim 1, wherein a a portion of the gaseous overhead stream removed from the top of cold separator and a portion of bottoms liquid stream from cold separator are combined and the resultant combined stream is subjected to indirect heat exchange with the overhead vapor from the light ends fractionation column, wherein the combined stream is cooled and partially liquefied, and the resultant cooled and partially liquefied combined stream is introduced into the top region of the light ends fractionation column to provide additional reflux.

8. An apparatus for integration of liquefaction of natural gas and recovery of natural gas liquids, said apparatus comprising:

one or more heat exchangers for cooling and partially condensing by indirect heat exchange a feed stream containing light hydrocarbons;

a gas/liquid cold separator and means for introducing a partially condensed feed stream from the one or more heat exchangers into the gas/liquid cold separator, the gas/liquid cold separator having upper outlet means for removing an overhead gaseous stream and lower outlet means for removing a bottoms liquid stream;

means for introducing the overhead gaseous stream and the bottoms liquid stream from the gas/liquid cold separator into a fractionation system comprising a light ends fractionation column and a heavy ends fractionation column, the means comprising an expansion device for expanding at least a portion of overhead gaseous stream from the gas/liquid cold separator and means for introducing expanded overhead gaseous stream into a lower region of said light ends fractionation column, and means for introducing at least a portion of the bottoms liquid stream from the gas/liquid cold separator into said heavy ends fractionation column at an intermediate point thereof;

means for removing a first liquid product stream from the bottom of the heavy ends fractionation column;

means for removing an overhead gaseous stream from the top of the light ends fractionation column, and means for removing a bottoms liquid stream from a lower region of the light ends fractionation column, and introducing this bottoms liquid stream from the light ends fractionation column into an upper region of the heavy ends fractionation column;

said apparatus further comprising:

(i) a first heat exchanger for subjecting a first portion of the light ends fractionation column overhead gaseous stream to indirect heat exchange with an overhead gaseous stream removed from the top of the heavy ends fractionation column, whereby the overhead gaseous stream from the top of the heavy ends fractionation column is cooled and partially condensed, means for removing the cooled and partially condensed overhead gaseous stream from said first heat exchanger, and means for introducing this cooled and partially condensed overhead gaseous stream from the top of the heavy ends fractionation column into the light ends fractionation column;

(ii) means for removing a second portion of the overhead gaseous stream from the light ends fractionation column as a side stream, and a further heat exchanger for subjecting the side stream to indirect heat exchange to further cool, and partially liquefy the side stream, wherein said side stream of the overhead gaseous stream from the light ends fractionation column is split off from the overhead gaseous stream from the light ends fractionation column prior to the indirect heat exchange between said first portion of the light ends fractionation column overhead gaseous stream and the overhead gaseous stream removed from the top of said heavy ends fractionation column in said first heat exchanger;

(iii) means for introducing the partially liquefied side stream into a further separation means, means for recovering a liquid stream from the further separation means and means for introducing the recovered liquid stream into the light ends fractionation column as a liquid reflux stream and/or the heavy ends fractionation column as a liquid reflux stream, (iv) means for recovering an overhead vapor stream from the further separation means, a further heat exchanger for subjecting this overhead vapor stream to indirect heat exchange for additional cooling and partial condensation, means for feeding the resultant vapor and condensate to an LNG separator, and means for recovering LNG liquid product from the LNG separator, and (v) means for recovering an overhead vapor stream from the further separation means, a compressor for compressing this overhead vapor stream to form a residue gas.

9. An apparatus according to claim 8, said apparatus further comprising:

a main heat exchanger for cooling and partially condensing the feed stream by indirect heat exchange;

means for introducing the first liquid product stream from the bottom of the heavy ends fractionation column into the main heat exchanger for indirect heat exchange with the feed stream; and a flow-control valve for partially liquefying the side stream before introducing said side stream into said further heat exchanger.

10. A process for integrated liquefaction of natural gas and recovery of natural gas liquids, said process comprising:

cooling a feed stream containing light hydrocarbons by indirect heat exchange in a feed heat exchanger;

introducing the cooled feed stream into a gas/liquid cold separator, removing from said gas/liquid cold separator an overhead gaseous stream and bottoms liquid stream, and introducing said overhead gaseous stream and bottoms liquid stream into a fractionation system, said fractionation system comprising a light ends fractionation column and a heavy ends fractionation column;

removing a liquid product stream from said fractionation system;

removing an overhead gaseous stream from said fractionation system;

generating a residue gas stream from said overhead gaseous stream from said fractionation system;

introducing said residue gas stream into a further separation means, and recovering from said further separation means a liquid product stream and an overhead vapor stream;

introducing either said liquid product stream or said overhead vapor stream to an LNG exchanger/separator;

subjecting either said liquid product stream or said overhead vapor stream to liquefaction in said LNG exchanger/separator; and removing LNG liquid product from said LNG exchanger/separator, wherein an overhead gaseous stream is removed from the top of said light ends fractionation column as said overhead gaseous stream from said fractionation system;

said overhead gaseous stream from said light ends fractionation column is split into a first portion and a second portion;

after said overhead gaseous stream from said light ends fractionation column is split into a first portion and a second portion, said first portion is heated by indirect heat exchange with an overhead gaseous stream removed from the top of said heavy ends fractionation column, whereby said overhead gaseous stream from the top of said heavy ends fractionation column is cooled by said indirect heat exchange;

said second portion of overhead gaseous stream is cooled by indirect heat exchange; and the cooled second portion of overhead gaseous stream is introduced into said further separation means as said residue gas.

11. A process according to claim 10, said process further comprising:

introducing the cooled overhead gaseous stream from the top of said heavy ends fractionation column into said light ends fractionation column;

introducing said liquid product stream from said further separation means into said light ends fractionation column and/or said heavy ends fractionation column as a liquid reflux stream; and introducing said overhead vapor stream from said further separation means into said LNG exchanger/separator.

12. A process according to claim 10, said process further comprising:

heating said overhead gaseous stream by indirect heat exchange with an overhead gaseous stream removed from the top of said heavy ends fractionation column, and said overhead gaseous stream from the top of said heavy ends fractionation column is cooled by said indirect heat exchange;

introducing the cooled overhead gaseous stream from the top of said heavy ends fractionation column into said light ends fractionation column;

heating and compressing the heated overhead gaseous stream from the light ends fractionation column;

cooling and expanding said overhead gaseous stream from the light ends fractionation column;

splitting the cooled and expanded overhead gaseous stream from the light ends fractionation column into a first expanded stream and a second expanded stream;

introducing said first expanded stream into said light ends fractionation column;

introducing said second expanded stream into further separation means as said residue gas; and introducing said liquid product stream from said further separation means into said LNG exchanger/separator.

13. A process according to claim 10, wherein said process further comprises introducing said liquid product stream recovered from said further separation means into said light ends fractionation column as said liquid reflux stream.

14. A process according to claim 10, wherein said process further comprises introducing said liquid product stream recovered from said further separation means into said heavy ends fractionation column as said liquid reflux stream.

15. A process according to claim 10, wherein said process further comprises removing a bottoms liquid stream from a lower region of said heavy ends fractionation column, heating said bottoms liquid stream from said heavy ends fractionation column in said feed heat exchanger, and returning said bottoms liquid stream from said heavy ends fractionation column to the lower region of said heavy ends fractionation column.

16. A process according to claim 10, wherein said process further comprises removing a liquid stream from a first intermediate point of said heavy ends fractionation column, heating said liquid stream removed from said heavy ends fractionation column by indirect heat exchange with the feed stream in said feed heat exchanger, and introducing said liquid stream into said heavy ends fractionation column at another intermediate point below said first intermediate point.

17. A process according to claim 10, wherein said process further comprises splitting said bottoms liquid stream from the gas/liquid cold separator in to a first bottom liquid stream and a second bottoms liquid stream, introducing said first bottom liquid stream into said heavy ends fractionation column, delivering said second bottoms liquid stream is delivered to a liquid/liquid heat exchanger for indirect heat exchange with bottom liquid stream removed from said light ends fractionation column, and then introducing said second bottoms liquid stream into an intermediate region of said light ends fractionation column as a liquid reflux.

18. A process according to claim 10, wherein said process further comprises:

splitting said overhead gaseous stream from said gas/liquid cold separator into a first cold separator overhead gaseous stream and a second cold separator overhead gaseous stream;

splitting said bottoms liquid stream from said gas/liquid cold separator into a first cold separator bottoms liquid stream and a second cold separator bottoms liquid stream;

combining said second cold separator overhead gaseous stream and said second cold separator bottoms liquid stream;

cooling the resultant combined stream by indirect heat exchange with an overhead vapor from said light ends fractionation column, and introducing the cooled combined stream into the top region of said light ends fractionation column to provide reflux.

* * * * *